US010145097B2

(12) United States Patent
McHale et al.

(10) Patent No.: US 10,145,097 B2
(45) Date of Patent: Dec. 4, 2018

(54) PRIMED SIPHONIC FLUSH TOILET

(71) Applicant: AS IP Holdco, L.L.C., Piscataway, NJ (US)

(72) Inventors: James McHale, Hillsborough, NJ (US); Christophe Bucher, Hillsborough, NJ (US); David Grover, Hamilton, NJ (US)

(73) Assignee: AS IP HOLDCO, LLC, Piscataway, NJ (US)

( * ) Notice: Subject to any disclaimer, the term of this patent is extended or adjusted under 35 U.S.C. 154(b) by 378 days.

(21) Appl. No.: 14/619,989

(22) Filed: Feb. 11, 2015

(65) Prior Publication Data

US 2015/0197928 A1 Jul. 16, 2015

Related U.S. Application Data

(63) Continuation of application No. PCT/US2013/069961, filed on Nov. 13, 2013.
(Continued)

(51) Int. Cl.
*E03D 9/08* (2006.01)
*E03D 11/13* (2006.01)
(Continued)

(52) U.S. Cl.
CPC ..... *E03D 11/13* (2013.01); *E03D 1/145* (2013.01); *E03D 1/306* (2013.01); *E03D 11/02* (2013.01);
(Continued)

(58) Field of Classification Search
USPC ..... 4/422, 423
See application file for complete search history.

(56) References Cited

U.S. PATENT DOCUMENTS 685,621 A 10/1901 Maddock
796,458 A 8/1905 Scott
(Continued)

FOREIGN PATENT DOCUMENTS

CN 102587473 A 7/2012
CN 202466751 U 10/2012
(Continued)

OTHER PUBLICATIONS

International Search Report and Written Opinion from counterpart PCT/US2013/069961 dated Apr. 21, 2014 (12 pages).
(Continued)

*Primary Examiner* — Lauren Crane
(74) *Attorney, Agent, or Firm* — Venable LLP; Michele V. Frank

(57) ABSTRACT

A siphonic flush toilet system and method of priming the same having a toilet bowl assembly comprising at least one jet flush valve assembly and at least one rim valve; and bowl having a rim and a jet defining at least one jet channel, the at least one jet channel having an inlet port and a jet outlet port configured for discharging fluid to a sump area, wherein the sump area is in fluid communication with a trapway. The bowl has a closed jet pathway including the jet channel and extending from the jet flush valve assembly outlet to the jet channel outlet port to maintain the jet channel in a primed state with fluid from the jet flush valve assembly so as to assist in preventing air from entering the closed jet pathway. Flush valves are also disclosed having back-flow preventer mechanisms and/or at least partly flexible valve covers for use with the toilet systems and methods herein.

50 Claims, 42 Drawing Sheets

Related U.S. Application Data

(60) Provisional application No. 61/810,664, filed on Apr. 10, 2013, provisional application No. 61/725,832, filed on Nov. 13, 2012.

(51) Int. Cl.

| | |
|---|---|
| ***E03D 11/06*** | (2006.01) |
| ***E03D 11/08*** | (2006.01) |
| ***E03D 1/14*** | (2006.01) |
| ***E03D 1/30*** | (2006.01) |
| ***E03D 11/02*** | (2006.01) |

(52) U.S. Cl.

CPC ..... *E03D 11/06* (2013.01); *E03D 11/08* (2013.01); *E03D 2201/20* (2013.01); *E03D 2201/30* (2013.01); *E03D 2201/40* (2013.01)

(56) References Cited

U.S. PATENT DOCUMENTS

| | | | | |
|---|---|---|---|---|
| 1,939,118 | A | 12/1933 | Hinsdale | |
| 2,122,834 | A | 7/1938 | Brooks | |
| 3,908,203 | A | 9/1975 | Jackson | |
| 4,003,097 | A | 1/1977 | Book | |
| 4,080,667 | A | 3/1978 | Walsh et al. | |
| 4,135,262 | A | 1/1979 | Overbey | |
| 4,172,299 | A | 10/1979 | del Pozo | |
| 4,499,616 | A | 2/1985 | Johnson | |
| 5,234,714 | A | 8/1993 | Patel et al. | |
| 5,353,444 | A | 10/1994 | Osmond | |
| 5,832,546 | A | 11/1998 | Inch | |
| 6,032,303 | A | 3/2000 | Schmidt | |
| 7,325,258 | B2 * | 2/2008 | Asada | E03D 11/08 4/363 |
| 8,032,956 | B2 | 10/2011 | Prokopenko et al. | |
| 8,266,733 | B2 | 9/2012 | Jensen | |
| 8,534,313 | B1 | 9/2013 | Achterman | |
| 2005/0015871 | A1 | 1/2005 | Tomita et al. | |
| 2008/0201833 | A1 | 8/2008 | Scruggs | |
| 2008/0276361 | A1 | 11/2008 | Mueller et al. | |
| 2009/0276947 | A1 | 11/2009 | Schuster et al. | |
| 2009/0313150 | A1 | 12/2009 | Okubo et al. | |
| 2010/0242160 | A1 | 9/2010 | Canfield | |
| 2010/0243064 | A1 * | 9/2010 | Ahmady | E03D 1/14 137/1 |
| 2011/0113542 | A1 | 5/2011 | Stauber et al. | |
| 2012/0174310 | A1 | 7/2012 | Grover et al. | |
| 2012/0198610 | A1 | 8/2012 | McHale et al. | |
| 2013/0312173 | A1 | 11/2013 | Wu et al. | |
| 2015/0260319 | A1 | 9/2015 | Wu et al. | |
| 2016/0002903 | A1 | 1/2016 | Grover et al. | |

FOREIGN PATENT DOCUMENTS

| | | | |
|---|---|---|---|
| CN | 202809774 | U | 3/2013 |
| CN | 202831138 | U | 3/2013 |
| CN | 202831168 | U | 3/2013 |
| CN | 202882090 | U | 4/2013 |
| CN | 202925651 | U | 5/2013 |
| CN | 202936868 | U | 5/2015 |
| GB | 1449062 | A | 9/1976 |
| JP | H0235132 | A | 2/1990 |
| JP | 2010-121410 | A | 6/2010 |
| WO | WO 2007/139371 | A | 12/2007 |
| WO | 2014/078461 | A2 | 5/2014 |
| WO | WO 2015172042 | A1 | 11/2015 |

OTHER PUBLICATIONS

Article 34 Amendment from counterpart PCT/US2013/069961, submitted Sep. 15, 2014 (10 pages).

International Preliminary Report on Patentability in counterpart PCT/US2013/069961, dated Dec. 22, 2014 (29 pages).

Chinese Office Action for Chinese Counterpart Application 201380059416.4 and Partial English Translation, dated Apr. 20, 2016 (15 pages).

Response to Chinese Office Action in Chinese Counterpart Application 20138005916.4, filed Oct. 10, 2016 (21 pages).

Response to Colombian Office Action in Colombian in counterpart Application No. 15 133.283 and translation (18 pages) dated Sep. 10, 2015.

Translation of Colombian Office Action in Colombian counterpart Application No. 15 133.283, dated Oct. 1, 2016 (4 pages).

International Search Report and Written Opinion from counterpart PCT/US2015/050052 of related US filing, dated Jan. 28, 2016 (15 pages).

International Preliminary Report on Patentability issued in International Application No. PCT/US2015/050052 dated Mar. 3, 2017 (12 pages).

Extended European Search Report from counterpart European Application No. 13855884.6, dated Jan. 20, 2017 (9 pages).

Chinese Office Action for corresponding Chinese Application No. 201380059416.4 with English translation, dated Nov. 14, 2016 (32 pages).

Australian Examination Report No. 1 for corresponding Australian Application No. 2013344755, dated Feb. 16, 2017 (3 pages).

Japanese Office Action for corresponding Japanese Application No. 2015-542041 with English translation, dated Nov. 7, 2017 (20 pages).

Chinese Office Action for corresponding Chinese Application No. 201380059416.4 with English translation, dated Jul. 6, 2017 (10 pages).

Non-final Office Action dated Dec. 4, 2017, in corresponding U.S. Appl. No. 14/853,984 (9 pages).

European Search Report for corresponding European Application No. 15840761.9 dated May 23, 2018 (10 pages).

Colombian Office Action for corresponding Colombian Application No. NC2017/0003510 received Aug. 9, 2018 (18 pages).

Mexican Office Action for corresponding Mexican Application No. MX/a/2015/006048 dated Jun. 14, 2018 (6 pages).

Chilean Office Action for corresponding Chilean Application No. 201700602 dated Aug. 22, 2018 (18 pages).

* cited by examiner

PRIMED SIPHONIC FLUSH TOILET

CROSS-REFERENCE TO RELATED APPLICATIONS

This patent application is a continuation of PCT/US2013/069961 filed Nov. 13, 2013, entitled, "Primed Siphonic Flush Toilet," and claims the benefit under 35 U.S.C. § 119(e) of U.S. Provisional Patent Application No. 61/810,664, filed Apr. 10, 2013, entitled, "Primed Siphonic Flush Toilet," and of U.S. Provisional Patent Application No. 61/725,832, filed Nov. 13, 2012, entitled, "Primed Siphonic Flush Toilet," the disclosures of which are incorporated herein by reference in their entirety.

BACKGROUND OF THE INVENTION

Field of the Invention

The present invention relates to the field of gravity-powered toilets for removal of human and other waste. The present invention further relates to the field of toilets that operate by a primed water delivery system to improve performance.

Description of Related Art

Toilets for removing waste products, such as human waste, are well known. Gravity powered toilets generally have two main parts: a tank and a bowl. The tank and bowl can be separate pieces which are coupled together to form the toilet system (commonly referred to as a two-piece toilet) or can be combined into one integral unit (typically referred to as a one-piece toilet).

The tank, which is usually positioned over the back of the bowl, contains water that is used for initiating flushing of waste from the bowl to the sewage line, as well as refilling the bowl with fresh water. When a user desires to flush the toilet, he pushes down on a flush lever on the outside of the tank, which is connected on the inside of the tank to a movable chain or lever. When the flush lever is depressed, it moves a chain or lever on the inside of the tank which acts to lift and open the flush valve, causing water to flow from the tank and into the bowl, thus initiating the toilet flush.

There are three general purposes that must be served in a flush cycle. The first is the removal of solid and other waste to the drain line. The second is cleansing of the bowl to remove any solid or liquid waste which was deposited or adhered to the surfaces of the bowl, and the third is exchanging the pre-flush water volume in the bowl so that relatively clean water remains in the bowl between uses. The second requirement, cleansing of the bowl, is usually achieved by way of a hollow rim that extends around the upper perimeter of the toilet bowl. Some or all of the flush water is directed through this rim channel and flows through openings positioned therein to disperse water over the entire surface of the bowl and accomplish the required cleansing. The third requirement is to refill the bowl with clean water, restoring the seal depth against backflow of sewer gas, and readying it for the next usage and flush.

Gravity powered toilets can be classified in two general categories: wash down and siphonic. In a wash-down toilet, the water level within the bowl of the toilet remains relatively constant at all times. When a flush cycle is initiated, water flows from the tank and spills into the bowl. This causes a rapid rise in water level and the excess water spills over the weir of the trapway, carrying liquid and solid waste along with it. At the conclusion of the flush cycle, the water level in the bowl naturally returns to the equilibrium level determined by the height of the weir.

In a siphonic toilet, the trapway and other hydraulic channels are designed such that a siphon is initiated in the trapway upon addition of water to the bowl. The siphon tube itself is an upside down U-shaped tube that draws water from the toilet bowl to the wastewater line. When the flush cycle is initiated, water flows into the bowl and spills over the weir in the trapway faster than it can exit the outlet to the sewer line. Sufficient air is eventually removed from the down leg of the trapway to initiate a siphon which in turn pulls the remaining water out of the bowl. The water level in the bowl when the siphon breaks is consequently well below the level of the weir, and a separate mechanism needs to be provided to refill the bowl of the toilet at the end of a siphonic flush cycle to reestablish the original water level and protective "seal" against back flow of sewer gas.

Siphonic and wash-down toilets have inherent advantages and disadvantages. Siphonic toilets, due to the requirement that most of the air be removed from the down leg of the trapway in order to initiate a siphon, tend to have smaller trapways which can result in clogging. Wash-down toilets can function with large trapways but generally require a smaller amount of pre-flush water in the bowl to achieve the 100:1 dilution level required by plumbing codes in most countries (i.e., 99% of the pre-flush water volume in the bowl must be removed from the bowl and replaced with fresh water during the flush cycle). This small pre-flush volume manifests itself as a small "water spot." The water spot, or surface area of the pre-flush water in the bowl, plays an important role in maintaining the cleanliness of a toilet. A large water spot increases the probability that waste matter will contact water before contacting the ceramic surface of the toilet. This reduces adhesion of waste matter to the ceramic surface making it easier for the toilet to clean itself via the flush cycle. Wash-down toilets with their small water spots therefore frequently require manual cleaning of the bowl after use.

Siphonic toilets have the advantage of being able to function with a greater pre-flush water volume in the bowl and greater water spot. This is possible because the siphon action pulls the majority of the pre-flush water volume from the bowl at the end of the flush cycle. As the tank refills, a portion of the refill water can be directed into the bowl to return the pre-flush water volume to its original level. In this manner, the 100:1 dilution level required by many plumbing codes is achieved even though the starting volume of water in the bowl is significantly greater relative to the flush water exited from the tank. In the North American markets, siphonic toilets have gained widespread acceptance and are now viewed as the standard, accepted form of toilet. In European markets, wash-down toilets are still more accepted and popular, whereas both versions are common in the Asian markets.

Gravity powered siphonic toilets can be further classified into three general categories depending on the design of the hydraulic channels used to achieve the flushing action. These categories are: non-jetted, rim jetted, and direct jetted.

In non jetted bowls, all of the flush water exits the tank into a bowl inlet area and flows through a primary manifold into the rim channel. The water is dispersed around the perimeter of the bowl via a series of holes positioned underneath the rim. Some of the holes may be designed to be larger in size to allow greater flow of water into the bowl. A relatively high flow rate is needed to spill water over the weir of the trapway rapidly enough to displace sufficient air in the down leg and initiate a siphon. Non-jetted bowls typically have adequate to good performance with respect to cleansing of the bowl and exchange of the pre-flush water, but are relatively poor in performance in terms of bulk removal. The feed of water to the trapway is inefficient and turbulent, which makes it more difficult to sufficiently fill the down leg of the trapway and initiate a strong siphon. Consequently, the trapway of a non-jetted toilet is typically smaller in diameter and contains bends and constrictions designed to impede flow of water. Without the smaller size, bends, and constrictions, a strong siphon would not be achieved. Unfortunately, the smaller size, bends, and constrictions result in poor performance in terms of bulk waste removal and frequent clogging, conditions that are extremely dissatisfying to end users.

Designers and engineers of toilets have improved the bulk waste removal of siphonic toilets by incorporating "siphon jets." In a rim-jetted toilet bowl, the flush water exits the tank, flows through the toilet inlet area and through the primary manifold into the rim channel. A portion of the water is dispersed around the perimeter of the bowl via a series of holes positioned underneath the rim. The remaining portion of water flows through a jet channel positioned at the front of the rim. This jet channel connects the rim channel to a jet opening positioned in the sump of the bowl. The jet opening is sized and positioned to send a powerful stream of water directly at the opening of the trapway. When water flows through the jet opening, it serves to fill the trapway more efficiently and rapidly than can be achieved in a non jetted bowl. This more energetic and rapid flow of water to the trapway enables toilets to be designed with larger trapway diameters and fewer bends and constrictions, which, in turn, improves the performance in bulk waste removal relative to non jetted bowls. Although a smaller volume of water flows out of the rim of a rim jetted toilet, the bowl cleansing function is generally acceptable as the water that flows through the rim channel is pressurized by the upstream flow of water from the tank. This allows the water to exit the rim holes with higher energy and do a more effective job of cleansing the bowl.

Although rim jetted bowls are generally superior to non-jetted, the long pathway that the water must travel through the rim to the jet opening dissipates and wastes much of the available energy. Direct-jetted bowls improve on this concept and can deliver even greater performance in terms of bulk removal of waste. In a direct-jetted bowl, the flush water exits the tank and flows through the bowl inlet and through the primary manifold. At this point, the water divides into two portions: a portion that flows through a rim inlet port to the rim channel with the primary purpose of achieving the desired bowl cleansing, and a portion that flows through a jet inlet port to a "direct-jet channel" that connects the primary manifold to a jet opening in the sump of the toilet bowl. The direct jet channel can take different forms, sometimes being unidirectional around one side of the toilet, or being "dual fed," wherein symmetrical channels travel down both sides connecting the manifold to the jet opening. As with the rim jetted bowls, the jet opening is sized and positioned to send a powerful stream of water directly at the opening of the trapway. When water flows through the jet opening, it serves to fill the trapway more efficiently and rapidly than can be achieved in a non-jetted or rim jetted bowl. This more energetic and rapid flow of water to the trapway enables toilets to be designed with even larger trapway diameters and minimal bends and constrictions, which, in turn, improves the performance in bulk waste removal relative to non-jetted and rim jetted bowls.

Although direct-fed jet bowls currently represent a large portion of the state of the art for bulk removal of waste, there are still major areas for improvement in toilet performance. Government agencies have continually demanded that municipal water users reduce the amount of water they use. Much of the focus in recent years has been to reduce the water demand required by toilet flushing operations. In order to illustrate this point, the amount of water used in a toilet for each flush has gradually been reduced by governmental agencies from 7 gallons/flush (prior to the 1950's), to 5.5 gallons/flush (by the end of the 1960's), to 3.5 gallons/flush (in the 1980's). The National Energy Policy Act of 1995 now mandates that toilets sold in the United States can use water in an amount of only 1.6 gallons/flush (6 liters/flush). Regulations have recently been passed in the State of California which require water usage to be lowered ever further to 1.28 gallons/flush. The 1.6 gallons/flush toilets currently described in the patent literature and available commercially lose the ability to consistently siphon when pushed to these lower levels of water consumption. Thus, manufacturers are being and will continue to be forced to reduce trapway diameters and sacrifice performance without development of improved technology and toilet designs.

Several inventions have been aimed at improving the performance of siphonic toilets through optimization of the direct jetted concept. For example, in U.S. Pat. No. 5,918,325, performance of a siphonic toilet is improved by improving the shape of the trapway. In U.S. Pat. No. 6,715,162, performance is improved by the use of a flush valve with a radiused inlet and asymmetrical flow of the water into the bowl.

U.S. Pat. No. 8,316,475 B2 demonstrates a pressurized rim and direct fed jet configuration that enables enhanced washing and adequate siphon for use with low volume water meeting current environmental water-use standards.

U.S. Patent Publication No. 2012/0198610 A1 also shows a high performance toilet achieved by a control element in the primary manifold that divides the flow of flush water entering the toilet manifold from the tank inlet into the inlet port of the rim and the inlet port of the direct-fed jet. U.S. Pat. No. 2,122,834 shows a toilet with an air manifold and a hydraulic manifold for introducing air into the toilet flush cycle to terminate siphonic action and prevent back flow into the system. Other inventions attempt to address performance between the rim and the jet by dividing the toilet tank into separate sections. See U.S. Pat. No. 1,939,118.

When flush volumes are pushed below about 6.0 liters, minimization of turbulence and flow restriction in the internal channels of a toilet is of paramount importance. One of the most significant factors in minimizing turbulence and restriction to flow is management of the air that occupies the rim and jet channels prior to initiation of the flush cycle. If the air is not able to escape the system ahead of the oncoming rush of flush water, it will continue to occupy space in the channels and restrict flow. U.S. Pat. No. 5,918,325 describes a toilet with jet channels that include an air discharging means, a passageway that connects the jet channel to the rim, allowing air to escape from the jet channels into the rim during the flush. U.S. Patent Publication No. 2012/0198610 A1 discloses a toilet with a downstream communication port that likewise enables air and/or water to pass between the jet channel and the rim channel.

A need in the art remains to further improve siphonic toilet performance, and in particular, to manage the pre-flush air that occupies the jet channel(s). There is also a need in the art for a toilet which improves on the above noted deficiencies in prior art toilets, by resisting clogging and allowing for significantly improved cleansing during flushing without sacrifice to flush performance. Such toilets should also still comply with water conservation standards and government guidelines while providing an adequate siphon for low water consumption for a variety of trapway geometries.

BRIEF SUMMARY OF THE INVENTION

Included within the scope of the invention is a siphonic flush toilet bowl assembly, comprising at least one jet flush valve assembly having a jet flush valve inlet and a jet flush valve outlet, the jet flush valve assembly configured for delivery of fluid from the jet flush valve outlet to a closed jet fluid pathway; at least one rim valve having a rim valve inlet and a rim valve outlet, the rim valve configured for delivery of fluid from the outlet of the rim valve to a rim inlet port; and a bowl having an interior surface defining an interior bowl area and comprising (a) at least one rim inlet port for introducing water to an upper perimeter area of the bowl; (b) a jet defining at least one jet channel, the jet having an inlet port in fluid communication with the outlet of the jet flush valve and a jet outlet port positioned in a lower portion of the bowl and configured for discharging fluid to a sump area of the bowl, wherein the sump area is in fluid communication with an inlet to a trapway having a weir and the closed jet fluid pathway comprises the jet channel; wherein the jet flush valve is positioned above the weir of the trapway and wherein the closed jet fluid pathway comprising the jet channel extends from the outlet of the jet flush valve to the outlet of the jet and once primed, the closed jet fluid pathway is capable of remaining primed with fluid and assisting in preventing air from entering the closed jet fluid pathway before actuation of and after completion of a flush cycle.

The toilet bowl assembly may, in one embodiment further comprise a rim manifold, wherein the rim manifold has a rim manifold inlet opening for receiving fluid from the outlet of the rim flush valve assembly and a rim manifold outlet opening for delivery of fluid to the rim inlet port. In such an embodiment, the bowl may also comprise a rim that extends at least partially around an upper perimeter of the bowl, the rim defining a rim channel extending from the rim inlet port around the upper perimeter of the bowl and having at least one rim outlet port in fluid communication with an interior area of the bowl, and wherein the rim inlet port is in fluid communication with the rim manifold outlet opening.

In another embodiment of the assembly, bowl may have a rim that comprises a rim shelf extending transversely along an interior surface of the bowl in an upper perimeter area thereof from the rim inlet port at least partially around the bowl so that fluid is able to travel along the rim shelf and enter the interior space of the bowl in at least one location displaced from the rim inlet port.

The assembly may also include a tank configured for receiving fluid from a source of fluid, the tank containing at least one fill valve. The tank may include at least one jet reservoir and at least one a rim reservoir, the jet reservoir comprising a jet fill valve and the at least one jet flush valve assembly, and the rim reservoir comprising the at least one rim valve. In such an embodiment, the rim reservoir may further comprises a rim fill valve, the rim valve is a rim flush valve assembly and the rim flush valve assembly comprises an overflow tube.

At least a portion of an interior wall of the toilet bowl in the sump area may also be configured to upwardly incline from the jet outlet port toward the inlet of the trapway.

The toilet assembly is preferably capable of operating at a flush volume of no greater than about 6.0 liters, more preferably no greater than about 4.8 liters and in some embodiments no greater than about 2.0 liters.

The at least one jet channel may also be configured so as to be positioned to extend at least partially around a lower portion of an exterior surface of the bowl.

The sump area of the bowl in one embodiment has a jet trap defined by the interior surface of the bowl and having an inlet end and an outlet end, wherein the inlet end of the jet trap receives fluid from the jet outlet port and the interior area of the bowl and the outlet end of the jet trap is in fluid communication with the inlet to the trapway; and wherein the jet trap has a seal depth. The surface of the jet outlet port may be within the jet trap and positioned at a seal depth below an upper surface of the inlet to the trapway as measured longitudinally through the sump area. The jet trap seal depth may be about 1 cm to about 15 cm, and preferably about 2 cm to about 12 cm, and further may be about 3 cm to about 9 cm.

The rim valve in one embodiment of the assembly may be a rim flush valve assembly having a rim flush valve body extending from the rim flush valve inlet to the rim flush valve outlet and a rim flush valve cover, such as a flapper cover.

The at least one jet channel may also be positioned so as to pass at least partially under the bowl. The jet flush valve assembly in one embodiment comprises a jet flush valve body extending from the jet flush valve inlet to the jet flush valve outlet and a flush valve cover, and wherein the jet flush valve also comprises a back-flow preventer mechanism.

The flush valve covers herein on either a jet flush valve assembly or optional rim flush valve assembly may be formed so as to be at least partly flexible and to be able to be peeled upwardly upon opening.

If a back-flow preventer mechanism is provided, it may be one or more of a hold-down linkage mechanism, a hook and catch mechanism, a poppet mechanism, and a check valve.

The jet flush valve assembly may also comprise a jet flush valve body extending from the jet flush valve inlet to the jet flush valve outlet and a flush valve cover. In such an embodiment, the flush valve cover may be formed so as to be at least partly flexible and to be able to be peeled upwardly upon opening. The jet flush valve cover may also further comprise hinged arms and/or at least one grommet for attachment of a chain having a float thereon. In such an embodiment having a cover that is at least partly flexible, the assembly may also comprise a back-flow preventer mechanism.

Also within the invention is a method of maintaining a siphonic flush toilet assembly in a primed state, the method comprising, (a) providing a toilet bowl assembly, comprising at least one jet flush valve assembly having an jet flush valve inlet and a jet flush valve outlet, the jet flush valve assembly configured for delivery of fluid from the jet flush valve outlet to a closed jet fluid pathway; at least one rim valve having a rim valve inlet and a rim valve outlet, the rim valve configured for delivery of fluid from the outlet of the rim valve to a rim inlet port; and a bowl having an interior surface defining an interior bowl area and comprising (i) at least one rim inlet port for introducing water to an upper perimeter area of the bowl; (ii) a jet defining at least one jet channel, the jet having an inlet port in fluid communication with the outlet of the jet flush valve and a jet outlet port positioned in a lower portion of the bowl and configured for discharging fluid to a sump area of the bowl, wherein the sump area is in fluid communication with an inlet to a trapway having a weir and the closed jet fluid pathway comprises the jet channel; the jet flush valve is positioned above the weir of the trapway and the closed jet fluid pathway comprising the jet channel extends from the jet flush valve outlet to the outlet port of the jet and, once primed, the closed jet fluid pathway is capable of remaining primed with fluid and assisting in preventing air from entering the closed jet fluid pathway before actuation of and after completion of a flush cycle; (b) actuating a flush cycle; (c) providing fluid through the at least one jet flush valve assembly and the at least one rim valve; and (d) maintaining the closed jet fluid pathway in a primed state after completion of a flush cycle. In a preferred embodiment, flow is continued until the level in the sump is above the jet outlet port.

In the method noted above, the toilet bowl assembly may further comprise a rim manifold, wherein the rim manifold has a rim manifold inlet opening configured for receiving fluid from the outlet of the rim valve and a rim manifold outlet opening for delivery of fluid to the rim inlet port; and wherein the bowl comprises a rim around the upper perimeter of the bowl and the rim defines a rim channel extending from the rim inlet port at least partially around the upper perimeter of the bowl and having at least one rim outlet port in fluid communication with an interior area of the bowl; and the rim inlet port is in fluid communication with the rim channel and with the rim manifold outlet opening, and the method further comprises introducing fluid from the outlet of the rim valve into the interior area of the toilet bowl through the rim manifold inlet, the rim manifold outlet, the rim inlet port, the rim channel and the at least one rim channel outlet port.

In an embodiment of the method, the rim may also comprises a rim shelf extending transversely along an interior surface of the bowl in an upper perimeter area thereof from the rim inlet port at least partially around the interior surface of the bowl, and the method may further comprise introducing fluid from the rim shelf inlet port so that it travels along the rim shelf and enters the interior space of the bowl in at least one location displaced from the rim inlet port.

The toilet bowl assembly in the method may further comprise a tank configured to receive fluid from a source of fluid, the tank having at least one fill valve, and the method further comprises filling the tank using the at least one fill valve and providing fluid from the tank to the bowl through the at least one jet flush valve assembly and the at least one rim valve. The tank may include at least one jet reservoir and at least one rim reservoir, the jet reservoir comprising a jet fill valve and the at least one jet flush valve assembly configured for delivery of fluid to the jet inlet port, and the rim reservoir comprising the at least one rim valve and configured for delivery of fluid to the rim inlet port through the at least one rim valve, and the method further comprises filling the at least one jet reservoir with fluid from the at least one fill valve before actuating the flush cycle. The at least one rim reservoir may further comprise a rim fill valve and the method further comprises filling the at least one rim reservoir with the rim fill valve.

The method may also further comprise maintaining the level of fluid in the at least one jet reservoir above a jet flush valve assembly inlet from the at least one fill valve of the tank after completion of a flush cycle.

In another embodiment of the method, in the jet trap, an upper surface of the jet outlet port may be configured to be positioned at a seal depth below an upper surface of the inlet to the trapway as measured longitudinally through the sump area, and the method may further comprise maintaining the seal depth to facilitate the closed jet fluid pathway being primed with fluid from the jet flush valve assembly before actuation of and after completion of a flush cycle.

Also included in the invention herein is a siphonic flush toilet bowl assembly, comprising at least one jet flush valve assembly configured for delivery of fluid to a direct-fed jet and at least one rim valve configured for delivery of fluid to a rim; a rim manifold, wherein the rim manifold has a rim manifold inlet opening configured for receiving fluid from the rim valve and a rim manifold outlet opening for delivery of fluid to a rim inlet port; a bowl having an interior surface defining an interior bowl area and (a) a rim provided around an upper perimeter thereof and defining a rim channel, the rim channel having an inlet port in fluid communication with the rim manifold outlet opening and at least one rim outlet port in fluid communication with an interior area of the bowl, (b) a jet defining at least one jet channel, the jet having an inlet port in fluid communication with the jet flush valve assembly outlet for receiving fluid from the jet flush valve assembly and a jet outlet port configured for discharging fluid to a sump area in a bottom portion of the bowl, wherein the sump area is in fluid communication with an inlet of a trapway, and (c) the sump area of the bowl has a jet trap defined by an interior wall of the bowl and having an inlet end and an outlet end, wherein the inlet end of the jet trap receives fluid from the jet outlet port and the interior of the bowl and the outlet end of the jet trap is in communication with the inlet to the trapway; and wherein the jet trap has a seal depth sufficient to maintain the jet channel and the jet manifold primed with fluid from the jet flush valve assembly before actuation of and after completion of a flush cycle so as to assist in preventing air from entering the closed jet fluid pathway before actuation of and after completion of a flush cycle.

The invention further includes a siphonic flush toilet bowl assembly, comprising at least one jet flush valve assembly configured for delivery of fluid to a direct-fed jet and at least one rim valve configured for delivery of fluid to a rim inlet port in an upper peripheral portion of a bowl; the bowl having an interior surface defining an interior area of the bowl and (a) the upper peripheral portion around an upper perimeter of the bowl configured to direct fluid from the rim inlet port at least partially around the upper peripheral portion of the bowl and into a sump area, (b) a jet defining at least one jet channel, the jet having an inlet port in fluid communication with the outlet of the jet flush valve assembly and a jet outlet port in a lower portion of the bowl configured for discharging fluid to the sump area, wherein the sump area is in fluid communication with an inlet of a trapway, and (c) the sump area in the bottom portion of the bowl has a jet trap defined by an interior surface of the bowl and having an inlet end and an outlet end, wherein the inlet end of the jet trap receives fluid from the jet outlet port and the interior of the bowl and the outlet end of the jet trap is in fluid communication with the inlet to the trapway; and wherein the jet trap is configured to have a seal depth sufficient to maintain the jet channel and jet manifold primed with fluid from the jet flush valve assembly before actuation of and after completion of a flush cycle so as to assist in preventing air from entering the closed jet fluid pathway before actuation of and after completion of a flush cycle.

The invention further encompasses a method of maintaining a siphonic flush toilet bowl assembly in a primed state, the method comprising (a) providing a toilet bowl assembly, having at least one jet flush valve assembly having a jet flush valve inlet and a jet flush valve outlet, the jet flush valve assembly configured for delivery of fluid from the jet flush valve outlet to a closed jet fluid pathway; at least one rim valve having a valve inlet and a rim valve outlet, the rim valve configured for delivery of fluid from the outlet of the rim valve to a rim inlet port; and a bowl having an interior surface defining an interior bowl area and wherein (i) the rim inlet port is configured for introducing water to one of (A) a rim provided around an upper perimeter of the bowl and defining a rim channel extending from the rim inlet port around the upper perimeter of the bowl and having at least one rim outlet port in fluid communication with an interior area of the bowl or (B) a rim shelf extending transversely along the interior surface of the bowl in the upper perimeter area thereof from the rim inlet at least partially around the bowl, and (ii) a jet defining at least one jet channel, the jet having an inlet port in fluid communication with the outlet of the jet flush valve assembly and a jet outlet port positioned in a lower portion of the bowl and configured for discharging fluid to a sump area of the bowl, wherein the sump area is in fluid communication with an inlet to a trapway having a weir and the closed jet fluid pathway comprises the jet channel; wherein the jet flush valve is positioned above the weir of the trapway and wherein the closed jet fluid pathway comprising the jet channel extends from the outlet of the jet flush valve to the outlet of the jet so that once primed, the closed jet fluid pathway is capable of remaining primed with fluid to assist in preventing air from entering the closed jet fluid pathway before actuation of and after completion of a flush cycle; (b) actuating a flush cycle; (c) providing fluid through the at least one jet flush valve assembly at a flow rate sufficient to keep air from entering the jet outlet and to generate a siphon in the trapway; and (d) lowering the flow rate of fluid through the jet channel for about 1 second to about 5 seconds until the siphon breaks.

The method of priming may also include, step (c) further comprising providing fluid through the at least one rim valve during the flush cycle. The method may also further comprise initial priming of the bowl upon installation by providing a flow rate through the jet flush valve assembly outlet sufficient to keep air from entering the jet outlet port until the sump fills with fluid.

The invention also includes a flush valve for use in a siphonic flush toilet bowl, wherein the flush valve has a flush valve body extending from a flush valve inlet to a flush valve outlet and a flapper cover configured to extend over the flush valve inlet, wherein the flush valve further comprises a back-flow preventer mechanism. The back-flow preventer mechanism may be one or more of a hold-down linkage mechanism, a hook and catch mechanism, a poppet mechanism, and a check valve. The flush valve may also comprise a flush valve cover that is at least partly flexible and is able to be peeled upwardly upon opening. The flush valve cover may also further comprise hinged arms to assist in lifting the cover and/or at least one grommet for attachment of a chain having a float.

Also within the invention is a flush valve for use in a siphonic flush toilet bowl assembly, comprising a flush valve body extending from a flush valve inlet to a flush valve outlet and a flapper cover configured to extend over the flush valve inlet, wherein the flapper cover is at least partly flexible and is able to be peeled upward upon opening. In this embodiment, the flush valve may further comprise a back-flow preventer mechanism as described above and elsewhere herein.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings:

FIG. 3 A is a perspective view of the bowl in the embodiment of FIG. 1 showing a rim jet flow path in a jet channel that curves around the bottom of the exterior surface of the bowl;

DETAILED DESCRIPTION OF THE INVENTION

Figure 1:
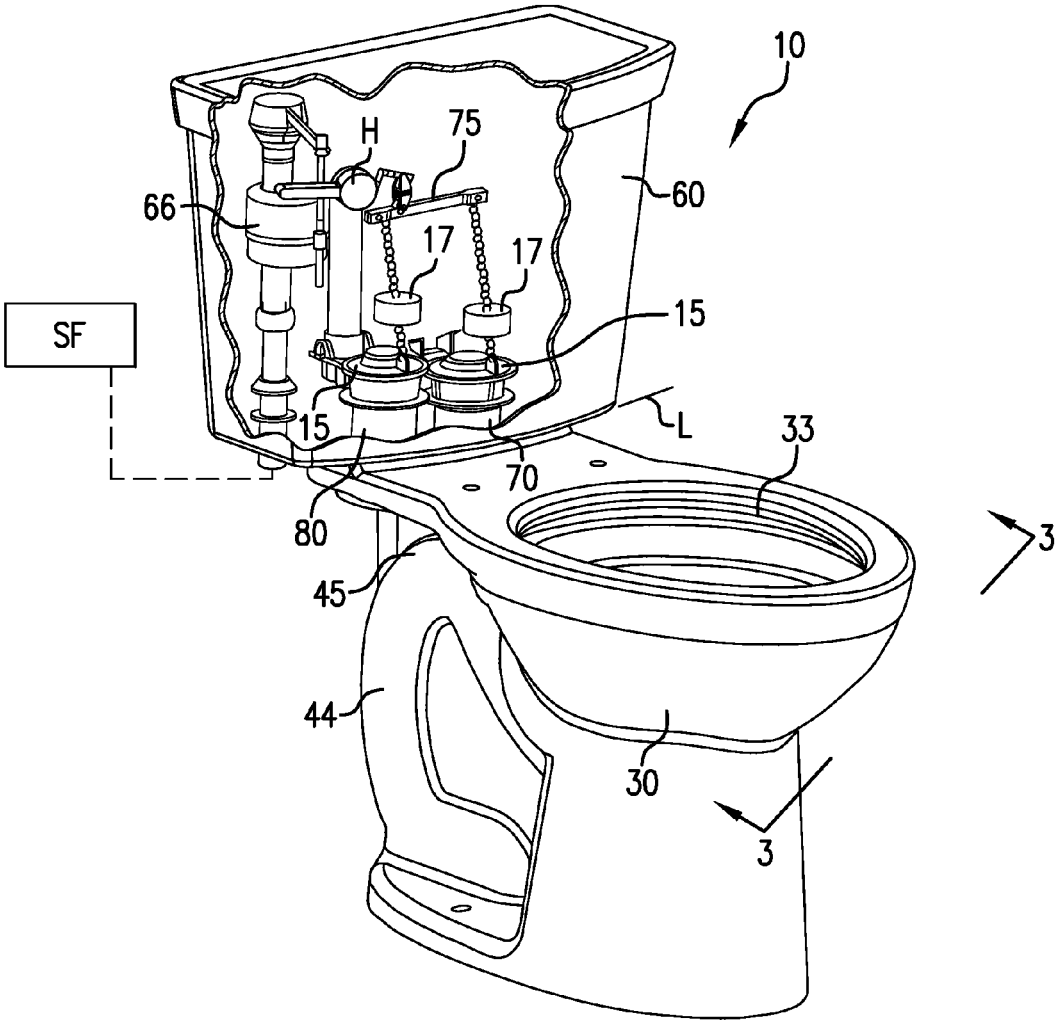
FIG. 1 is a perspective view of a siphonic toilet bowl assembly according to one embodiment of the invention showing an interior of the tank having a jet flush valve assembly and a rim flush valve assembly.
Figure 2:
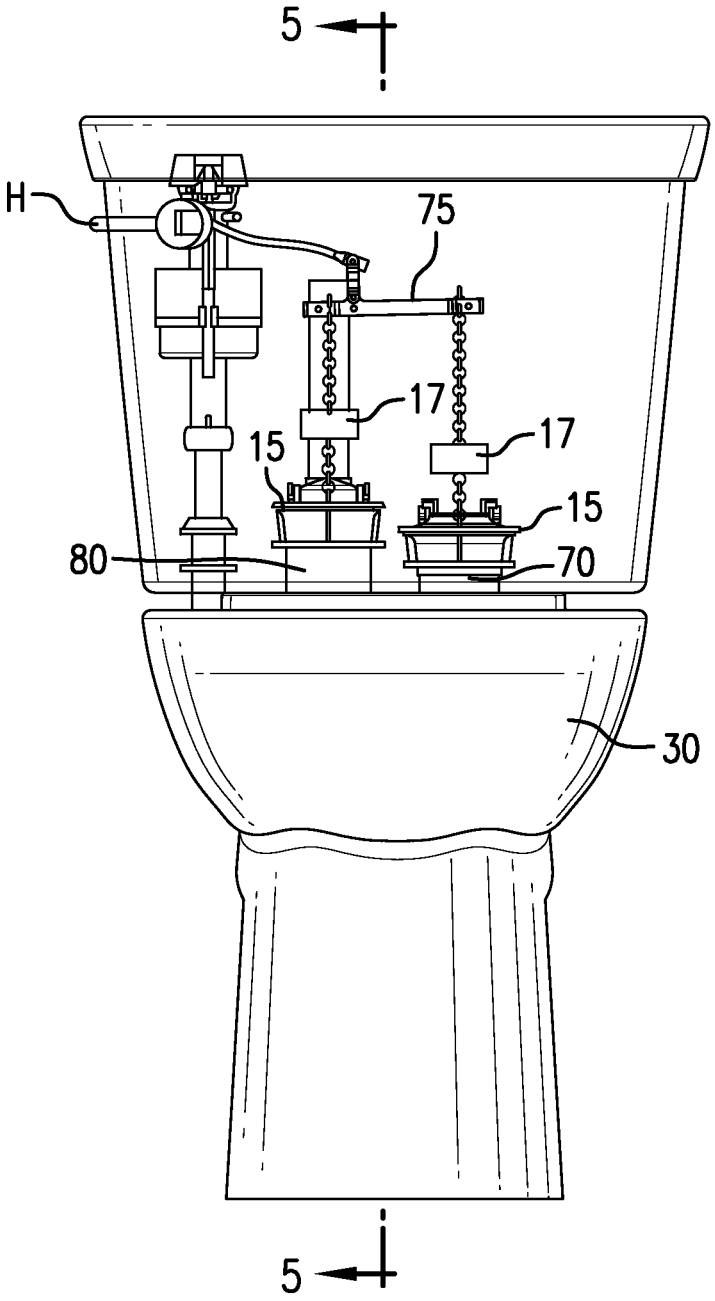
FIG. 2 is a front elevational view of the toilet bowl assembly of FIG. 1 showing the interior of the tank.

As used herein, words such as "inner" and "outer," "upper" and "lower," "forward" and "backward," "front" and "back," "left" and "right," "upward" and "downward" and words of similar import are intended to assist in understanding the preferred embodiment of the invention with reference to the accompanying drawing Figures with respect to the orientation of the toilet assembly as shown, and are not intended to be limiting to the scope of the invention or to limit the invention scope to the preferred embodiment as shown in the Figures. The embodiments 10, 1010, 110, 210, 310 and 410, etc. herein each use like reference numbers to refer to analogous features of the invention as described herein and as shown in the drawings, such that absent language to the contrary describing an alternative configuration for a particular feature, one skilled in the art would understand based on this disclosure and the drawings attached hereto that description of one such feature should be applicable in another embodiment describing an analogous feature.

In the present invention, a siphonic flush toilet assembly is provided which can operate to maintain a primed closed jet fluid pathway including a jet channel by isolating the fluid flow introduced into the bowl assembly so as to deliver different fluid volumes from a jet flush valve and a rim valve, such as a rim flush valve, preferably through a separate closed jet fluid path. This provides a more powerful performance in comparison to standard, gravity flush siphonic toilets that operate with air-filled jet channels and must expel the air to minimize turbulence and flow restriction.

The toilet bowl assembly of the present invention has a closed jet fluid path that includes a jet channel(s) within the toilet assembly exterior to the bowl. The jet channel(s) may have various configurations and extension areas, additional ports or side-channels, and the like depending on the bowl mold geometry, including an optional jet manifold so long as the closed jet fluid path receives fluid from the jet valve outlet into a jet inlet port and into and through a jet channel to a jet outlet port. The closed jet fluid path maintains the jet channel in a perpetually primed state, and substantially isolates it thereby assisting in preventing air from entering into the jet channel. This is accomplished by (1) isolating the jet channel from rim flow or other pathways open to the atmosphere, (2) closing the jet channel flush valve before the level of water in the tank falls to the level of the opening of the flush valve, (3) helping to prevent air flow from entering the jet channel(s) and any other jet paths, areas, or an optional jet manifold if used, which in one embodiment may include establishing a seal depth in a jet trap in the sump area to assist in blocking air from entering the jet channel outlet and/or (4) configuring and operating the assembly to ensure that the water level in the jet trap does not fall to a level that enables air to travel back up and into the jet channel.

In general, the ratio of the volume of fluid to the rim to the volume of fluid to the jet also affects toilet performance. In typical prior art siphonic jetted toilets, about 70% of the flush water is required to power the jet and initiate the siphon, leaving only about 30% to cleanse the bowl through the rim. In the primed toilet herein, much less water is required to initiate the siphon, which allows more water to be used in cleaning the bowl. Applicants have determined that more than about 50% or more of the flush water can be directed to the rim for significant improvement in bowl cleaning. In preferred embodiments, more than about 60% and as great as more than about 70% of the water can be directed to the rim.

In addition to the above-noted factors, another method for maintaining a sufficient seal depth of water in the sump area and/or for preventing backflow of air into the jet channels from the sump is to maintain a slower flow of water through and from the jet channels after breaking the siphon. For example, with a bowl filled to the weir (i.e., an excess of water present to contribute to the siphon), initiating and maintaining a siphon in a trapway of roughly about 54 mm in diameter requires a volumetric flow rate from the jet of more than about 950 ml/s. This translates to a linear flow rate of 127 cm/s across a jet outlet port area of 7.47 $cm^2$. Larger trapway sizes will require higher flow rates to initiate and maintain siphon and smaller trap ways will require smaller values. When the flow rate from the jet is reduced below about 950 ml/s, the siphon will break. Maintaining the volumetric flow rate from the jet below about 950 ml/s but above about 175 ml/s (i.e., a linear flow rate of 23.4 cm/s through the 7.47 $cm^2$ area of the jet outlet port) will prevent air from entering the closed jet channel. When the bowl is completely filled to the level of the trapway weir, the flow from the jet can be stopped without losing the prime, as long as the top of the jet channel is located below the weir of the trapway.

Controlling such flush valve actuation for the jet flush valve and the rim flush valve can be done in a number of ways. One way is through the use of electromagnetic valves, as disclosed in U.S. Patent Application Publication No. 2009/0313750 and U.S. Pat. No. 6,823,535, which are incorporated herein by reference in relevant part. This valve control method can also be accomplished through purely mechanical methods, such as by modifications to dual inlet flush valves like those disclosed in U.S. Pat. No. 6,704,945, which is also incorporated herein by reference in relevant part. Alternatively, a flush actuation bar balanced for optimal performance of the two flush valves in sequence as shown herein may be used.

Further, as discussed in more detail below, system performance can be enhanced by providing a "peel-back" valve cover to facilitate self-priming of the jet. The cover acts to reduce the activation force needed to open the jet flapper. In the present invention, where the jet channel(s) are primed, more than two times the force is needed than in a conventional flapper valve because of the weight of the water both above and below the flapper. By peeling the cover open, the seal breaks and some water comes through while air moves back so that the cover opens easier. In addition, during initial priming, when the valve is closed, the jet is full of air, and if the flapper opens all at once, flush water rushes in too quickly and air in the jet channel(s) may become trapped and not be sufficiently expelled depending on the geometry of the toilet and its jet channel(s). Further, as the embodiments herein provide a primed and closed jet-path, when the toilet requires plunging, an optional back-flow prevention device as described further hereinbelow may be provided to the jet flush valve.

Sufficient post-flush depth in the sump area and/or stopping water from entering the closed jet fluid pathway through the jet outlet port can also be achieved by maintaining flow of water to a rim shelf in a rimless toilet or through a rim channel in more traditional toilet design while the siphon is breaking. As the toilet system described herein includes separate channels and valve mechanisms for controlling flow to the rim and jet, the system can be designed to continue flow through the rim inlet port during the siphon break. The flow of water to the rim inlet port is preferably sufficient to maintain the level of water in the sump area above the height of the jet outlet port, yet insufficient to maintain the siphon in the trapway. In this manner, added security can be provided for maintaining the jet channel free of air, reducing the dependence on a seal depth in the sump area. It should be noted that the flow through the jet and rim can also be utilized together to maintain sufficient post-flush depth in the sump area.

A related area in which the present invention provides an improvement over the prior art is in high efficiency siphonic toilets with flush volumes below 6.0 liters, and preferably below 4.8 liters. The embodiments of the toilet bowl assembly of the present invention herein described are able to maintain resistance to clogging consistent with today's toilets having no greater than about 6.0 liters/flush, and preferably no greater than about 4.8 liters/flush in a single flush toilet and or dual-flush toilet assembly while still delivering superior bowl cleanliness at reduced water usages. As much less water is required through the jet channel to initiate the siphon, the primed toilet assembly embodiments herein enable production of ultra high efficiency toilets that can function up to no greater than about 4.8 liters per flush, and preferably can function at or below about 3.0 liters per flush and as low as about 2.0 liters per flush.

Moreover, a second related area in which the present invention provides an improvement over the prior art is in siphonic toilets with larger trapways. By altering the size of the trapway, water consumption and toilet performance are significantly affected. In the present invention, the toilet bowl assembly is able to stay primed in siphonic toilets of various trapway sizes and volumes because of the reduction in turbulence and restriction to flow achieved through the closed jet fluid pathway, including in preferred embodiments, the primed jet manifold and primed jet channel, which permits the toilet bowl assembly to maintain excellent flushing and cleansing capabilities.

To achieve the maximum potential performance of the inventive toilet system, the closed fluid jet path must be "primed," that is, it should be filled with water and contain little or no air. When the closed fluid jet path and jet channel contains significant quantities of air, as would be the case after initial installation of a toilet or after a major repair or maintenance, the closed jet channel must be primed before the full potential performance of the system will be achieved. For priming to occur, two basic requirements must be met: (1) water must be allowed to flow into the closed fluid jet path faster than it can exit the closed jet channel, and (2) air contained in the jet channel and closed jet fluid path must be provided a route of escape through, with, or against the flow of water into the closed jet channel.

The simplest way to prime the closed jet channel, which can be referred to as "manual priming," is to open the jet flush valve assembly described herein while leaving the rim valve closed and blocking or partially blocking flow from the jet outlet port(s). The jet flush valve should be held open until bubbles of air are no longer seen escaping from the channel into the tank, at which point the jet flush valve can be closed and the jet outlet ports unblocked. Upon refilling of the tank, the system should then be completely primed and ready for use at full performance potential. In preferred embodiments the system is designed to "self-prime" over the first several flushes after installation or loss of prime for other unforeseen reasons (maintenance, repair, etc.). To self-prime, the same two requirements must be met, but are made inherent to the system. Ensuring a self-priming system is largely a function of geometry and design of the jet flush valve, closed fluid jet path including the jet channel, and jet outlet port. As will be discussed in more detail below, the jet flush valve preferably enables a high flow rate into the closed jet channel, and radiused flush valves may be used that increase flow velocity (such as that described in U.S. Pat. No. 8,266,723, incorporated herein by reference). In most closed jet channel designs, the last portion of air entrapped in the jet channel is likely to rise to the space immediately below the flapper (or other opening mechanism) of the jet flush valve. The valve design, therefore, must also facilitate the escape of this remaining air. As will be discussed below, valves that open gradually, such as a flapper that can peel back, can confine the flow of water to one side of the valve and facilitate escape of air around the flow. Certain patterns or ribs in the throat of the flush valve can facilitate this escape of air, as well.

FIGS. 1-15, 17-19 and 29-34 show a first embodiment of a toilet bowl assembly, generally referred to herein as assembly 10. The assembly 10 includes at least one jet flush valve assembly 70 having a jet flush valve inlet 71 and a jet flush valve outlet 13. A jet flush valve body 21 extends between the inlet 71 and outlet 13 defining an interior flow path. The jet flush valve assembly may have a variety of configurations and may be any suitable flush valve assembly known or to be developed in the art. Preferably, it is configured to be similar to that described in co-pending U.S. Patent Application Publication No. 2014/0090158 A1, incorporated herein in relevant part by reference for description of such valves and the use of a cover having a float as well as with respect to the various embodiments of jet flush valves described hereinbelow and shown in FIGS. 35-68. As shown in FIGS. 1-2 and 7-11, the jet flush valve assembly 70 has a shorter valve height profile than the rim flush valve assembly 80 (wherein the rim valve is herein described with respect to the assembly 80), for controlling flow through the jet flush valve assembly. Each of the rim flush valve assembly 80 and the jet flush valve assembly 70 preferably has a cover 115 preferably having a float 117 attached thereto via a chain 119 or other linkage. As described in co-pending U.S. Patent Application Publication No. 2014/0090158 A1, such features help provide advanced performance and control of buoyancy in the particular flush valve design. However, it should be understood that other flush valve assemblies can be used operating on the principles of the invention and provide improved flushing capability.

The jet flush valve assembly 70 delivers fluid from its jet flush valve outlet 13 to a closed jet fluid pathway 1. The closed jet fluid pathway 1 includes at least one jet channel (s). As shown herein, a single jet path may be used (see, e.g., the arrows shown in FIG. 3 highlighting only one leg of the dual jet path of assembly 10) or multiple channels. As shown in this embodiment, two such channels 38 are provided stemming from one inlet and joining at one outlet while each of the channels flows around the bowl on its underside as illustrated by the flow paths shown in FIG. 3 A. A jet manifold may optionally be provided.

At least one rim valve is used. The rim flush valve may be a variety of valves, including a solenoid valve, an in-line valve, electronic valve or water may simply be provided by an electronically controlled valve through an inlet tube. As shown herein, a rim flush valve assembly 80 is provided as shown in FIGS. 1-2, 7-8 and 12-14. Each rim valve assembly has a rim flush valve inlet 83 and a rim flush valve outlet 81, and a rim flush valve body 31 extending from the inlet 83 to the outlet 81. The rim flush valve 80 or any other suitable rim valve may be any suitable flush valve assembly or rim valve as noted above so long as it is configured for delivery of fluid from the outlet of the rim valve to a rim inlet, also known herein as a rim inlet port 28.

In the embodiment shown, the rim 32 is of a "rimless" design in that fluid is introduced into the bowl 30 through a rim inlet port 28 and travels along a contour or geometric feature(s) formed into the interior surface 36 of the bowl 30. That is, the contour may be one or more shelf(s) 27 or similar features formed along an upper perimeter portion 33 of the bowl 30. As shown, the shelf is inset into the bowl's chinaware as best shown in FIGS. 29-34. The shelf(s) also referred to herein as a rim shelf 27 extend generally transversely along the interior surface 39 of the bowl 30 in an upper perimeter portion 33 thereof from the rim inlet port 28 at least partially around the bowl and, as shown best in FIGS. 30-34 in an inset contour of the interior surface 36 of the bowl 30. The toilet bowl 30 may be of a variety of shapes and configurations, and may have a variety of toilet seat lids and/or lid hinge assemblies. As such lids and are optional they are not shown in the drawings, and there are many such lids and assemblies known in the art, so that and any suitable lid known or to be developed may be used with the invention.

Figure 3:
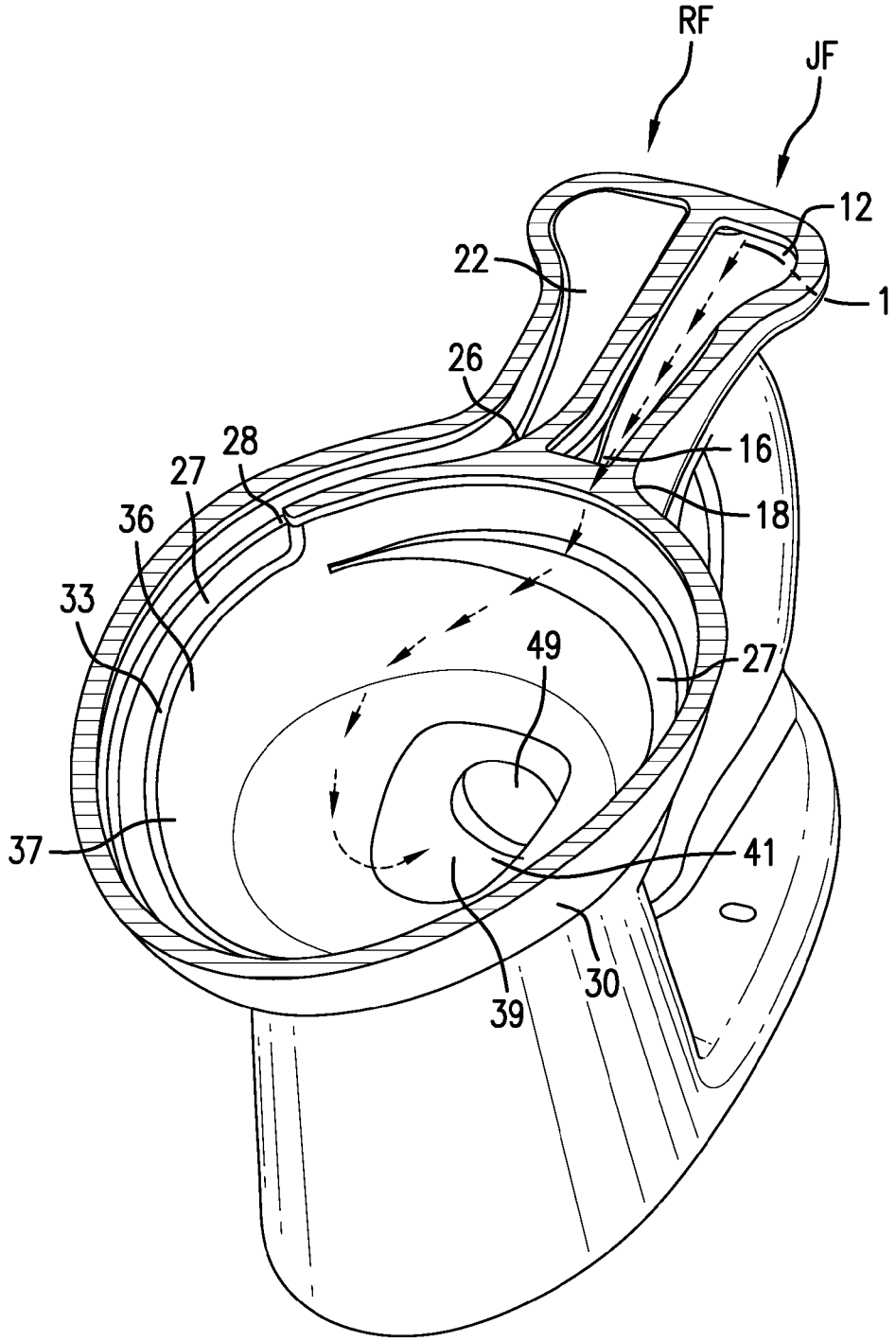
FIG. 3 is a perspective transverse cross-sectional view of the toilet assembly of FIGS. 1-2 taken along line 3-3.
Figure 3A:
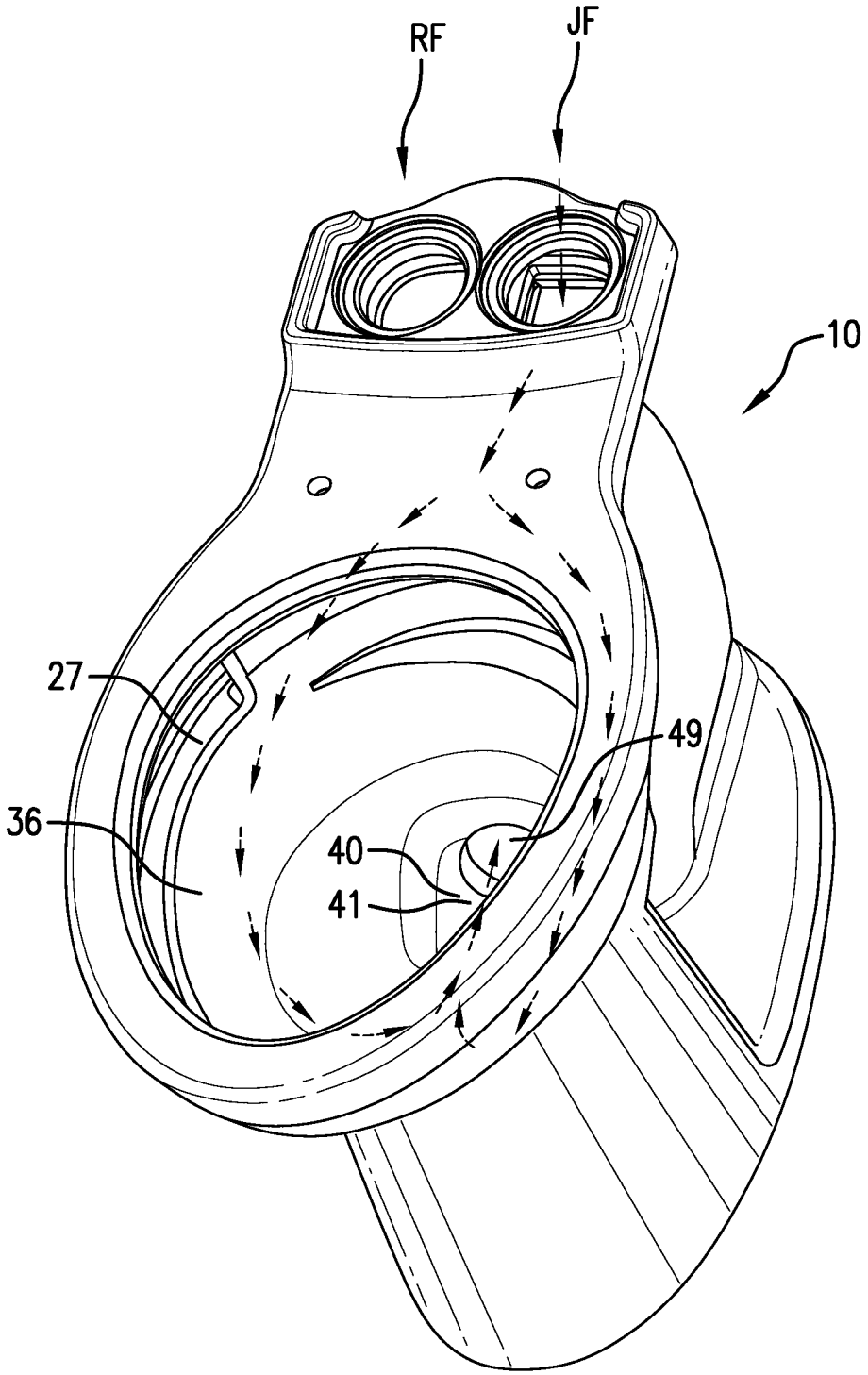
FIG. 3B is a perspective view of the bowl in the embodiment of FIG. 1 showing a rim shelf flow path.
FIGS. 3C-3G are schematic views of the interior space that is primed in the embodiment of FIG. 1 within the closed jet flow path that includes the dual jet channels having dual flow paths as in FIG. 3 A.
Figure 3B:
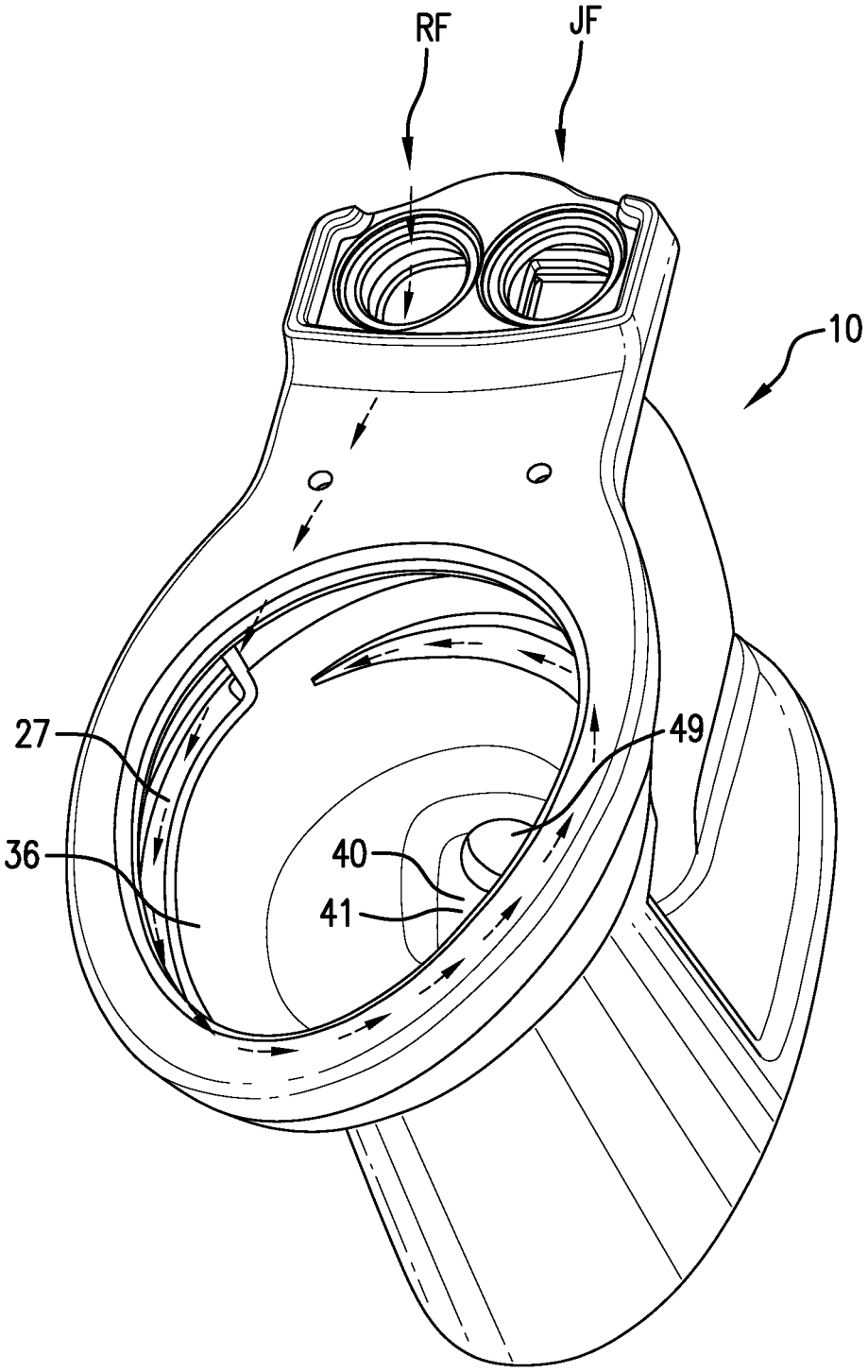
Figure 3D:
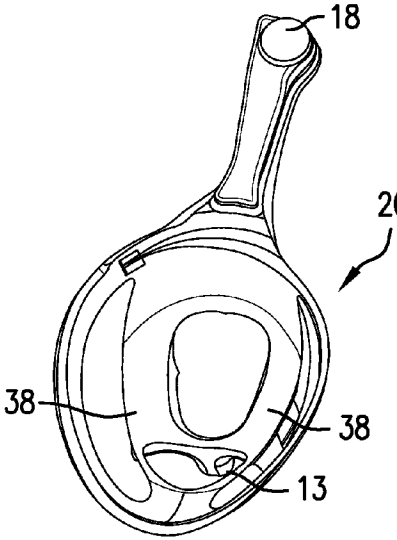
Figure 3C:
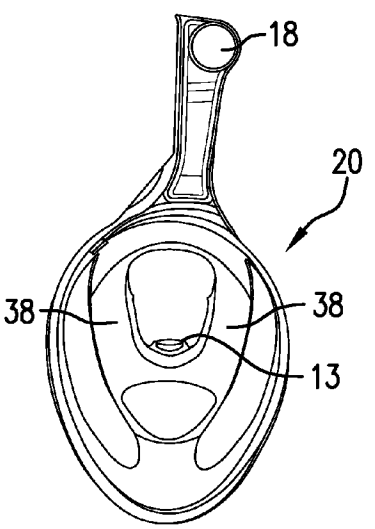
Figure 3G:
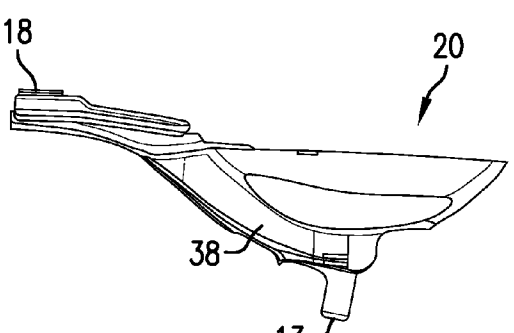
Figure 3F:
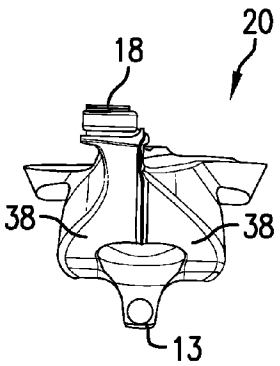
Figure 3E:
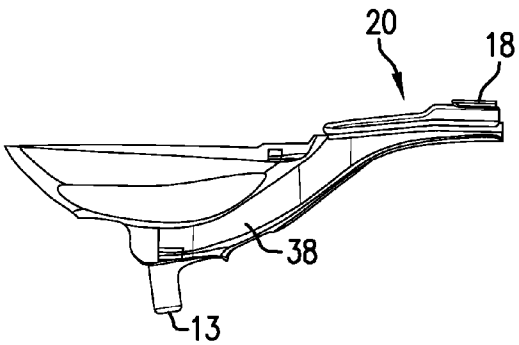
Figure 4A:
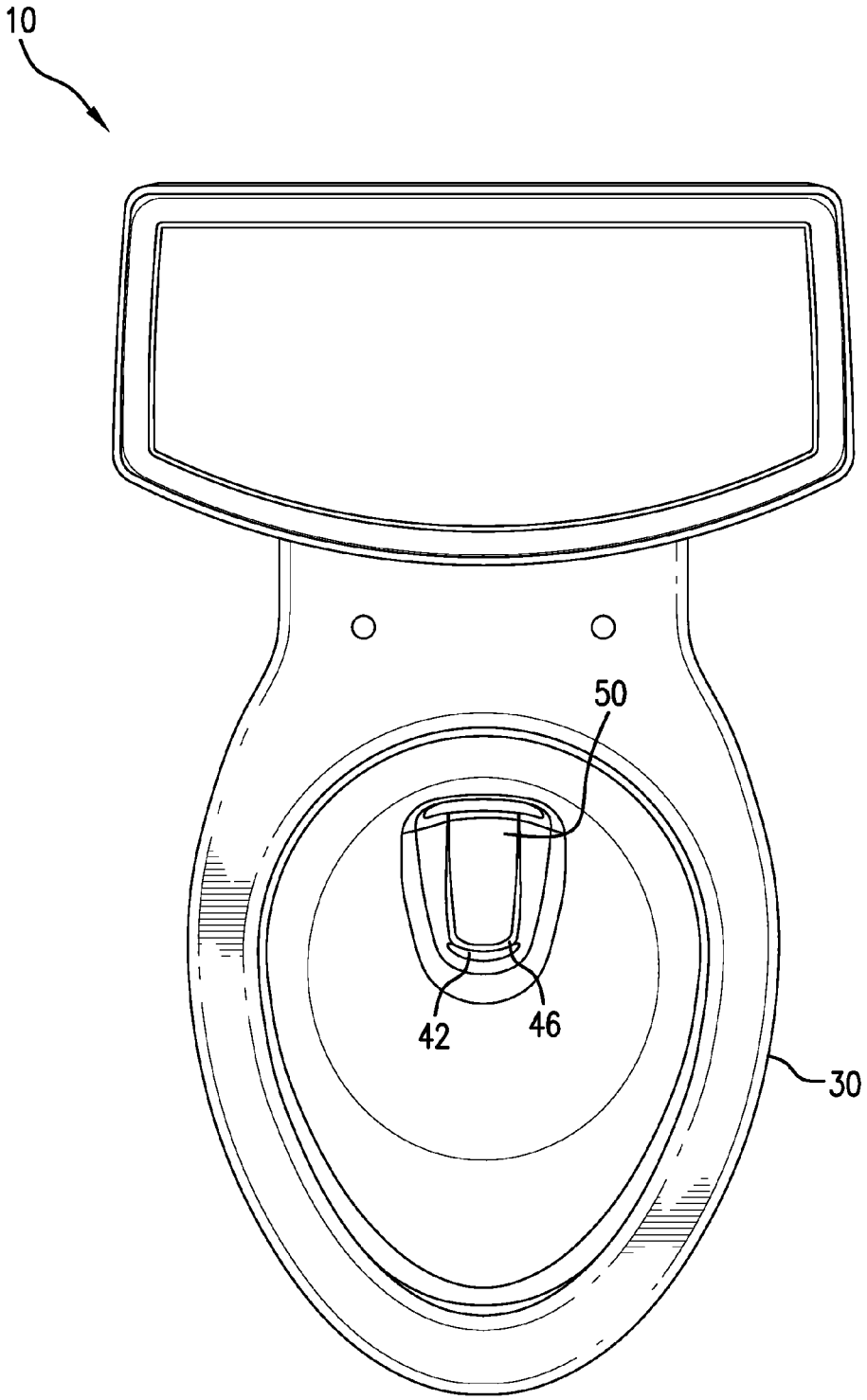
FIG. 4A is a top elevational view of the toilet assembly of FIG. 1.
Figure 4B:
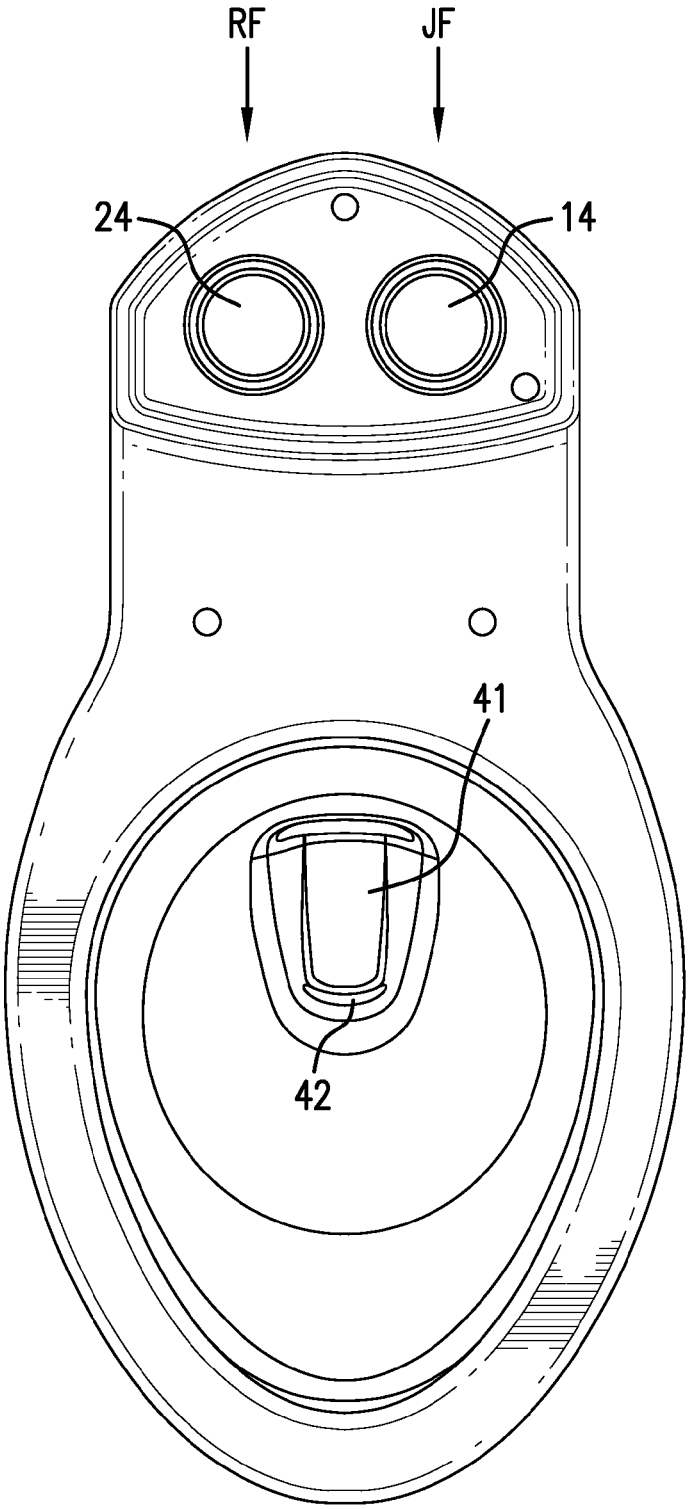
FIG. 4B is a top elevational view of the bowl portion of the toilet assembly showing the jet manifold opening and the rim manifold opening.
Figure 5:
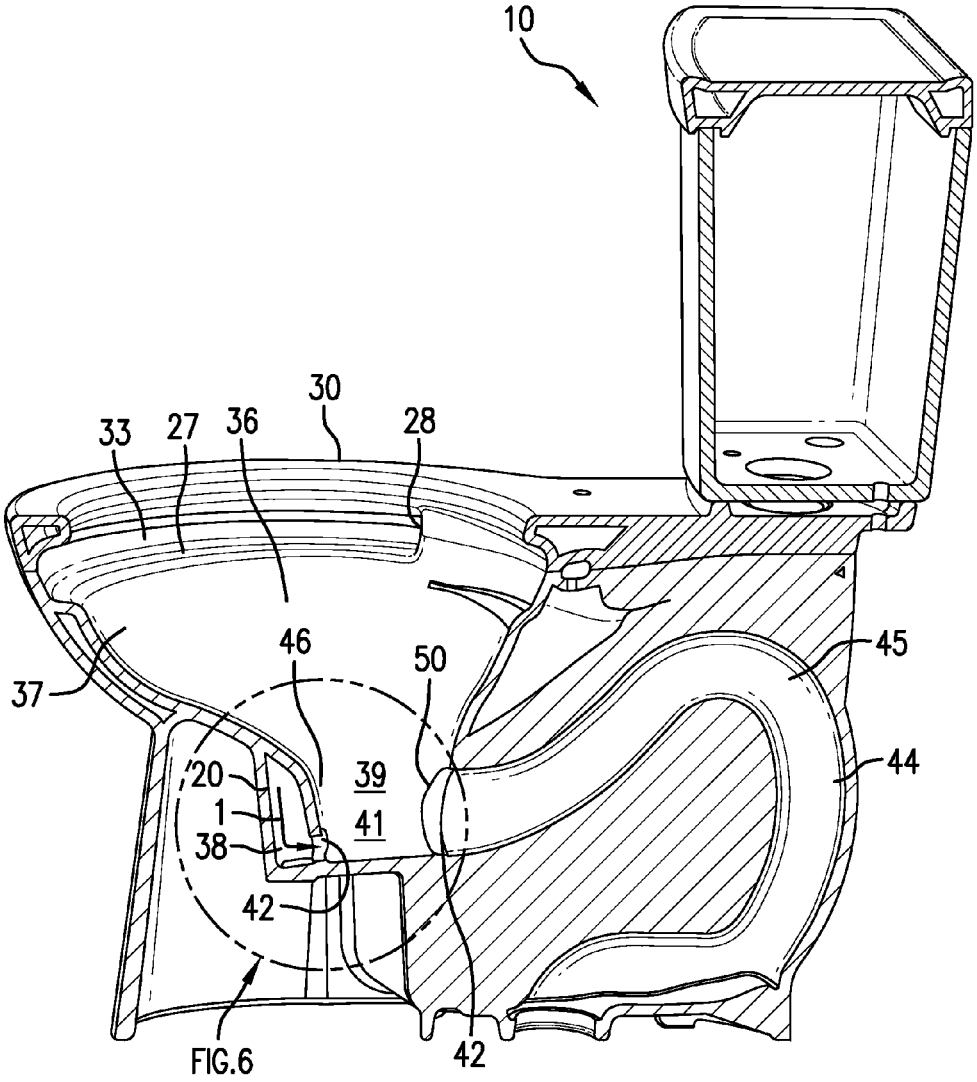
FIG. 5 is a longitudinal cross-sectional view of the toilet assembly of FIG. 1 taken along line 5-5 of FIG. 2 with the flush valves omitted.
Figure 6:
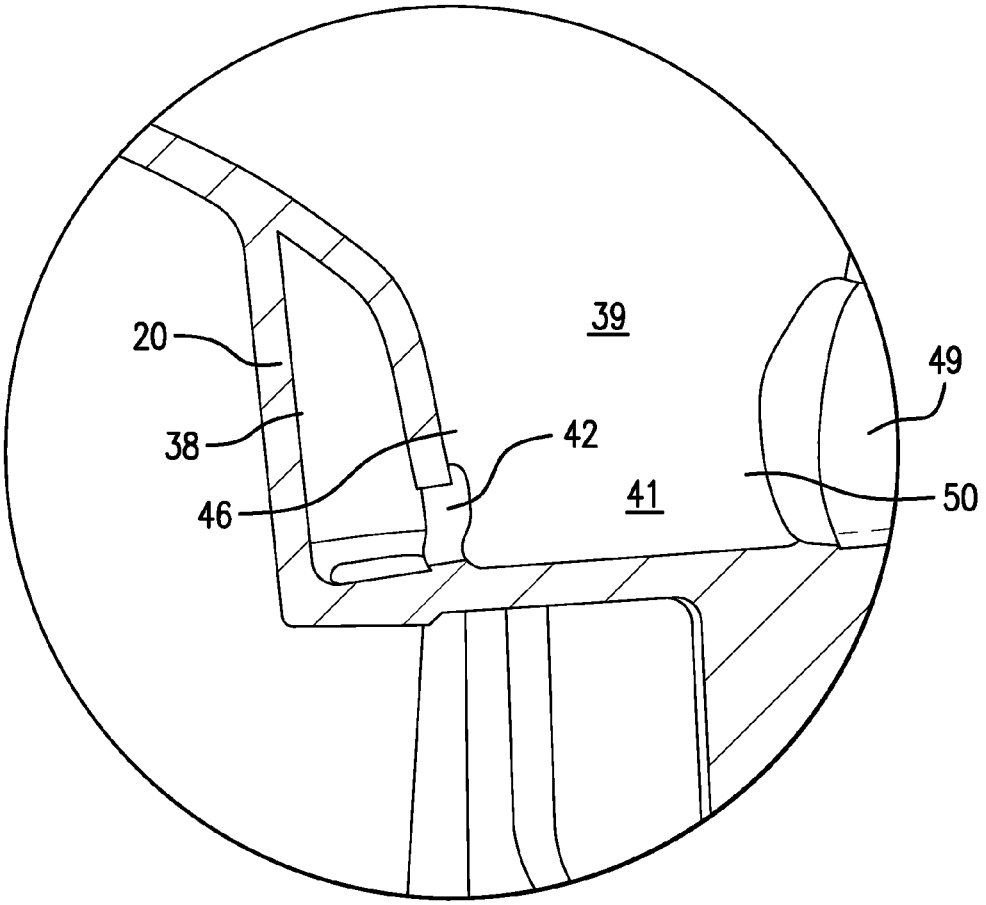
FIG. 6 is a greatly enlarged portion of the toilet assembly of FIG. 5 showing the jet outlet.
Figure 7:
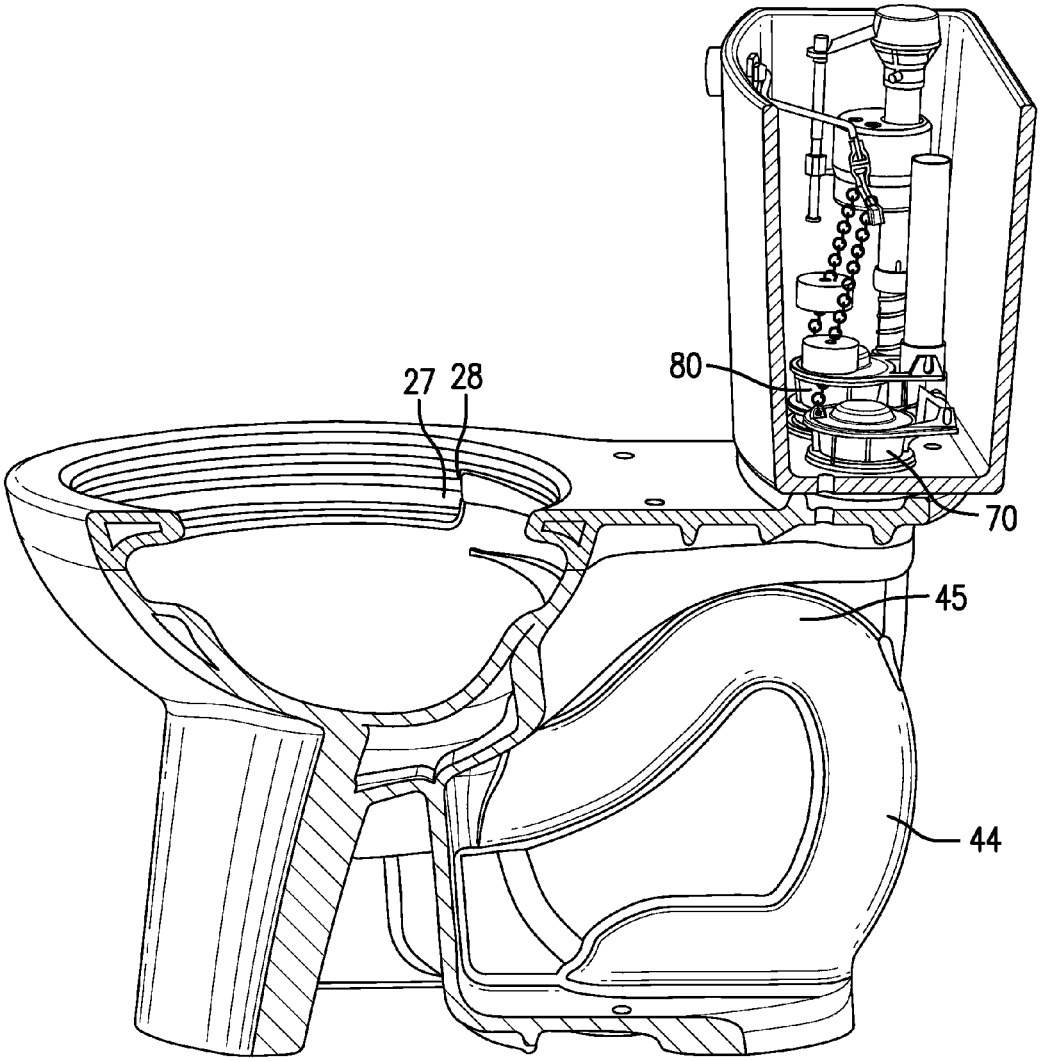
FIG. 7 is a longitudinal cross-sectional view of FIG. 8 taken along line 7-7.
Figure 8:
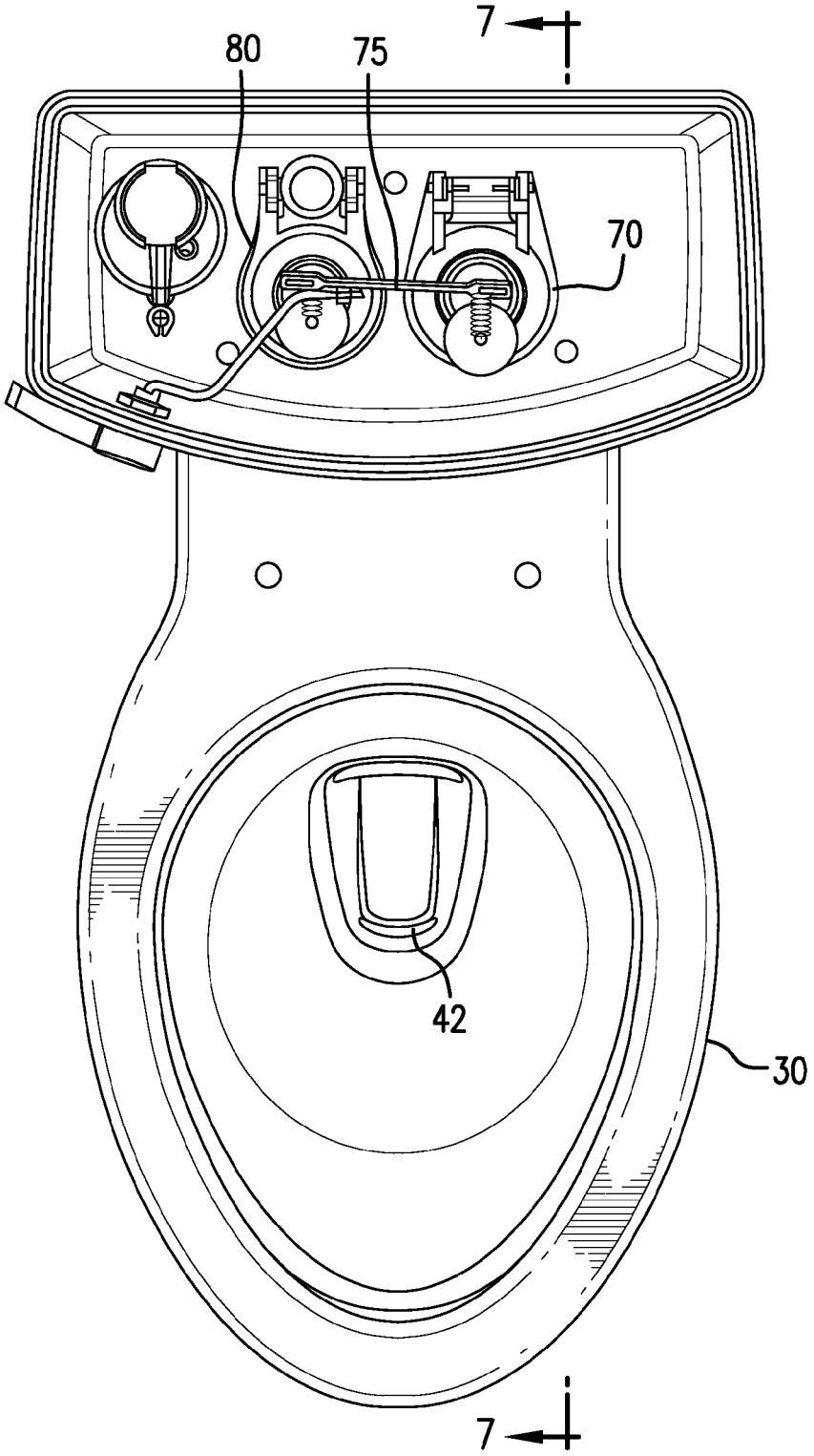
FIG. 8 is a top plan view of the toilet assembly of FIG. 1 having the lid removed from the tank.
Figure 9:
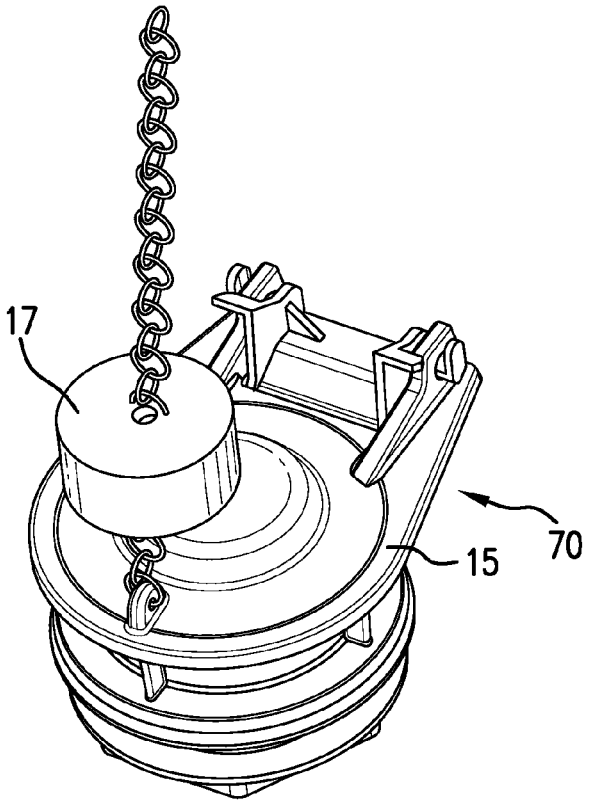
FIG. 9 is a perspective view of the jet flush valve of the toilet assembly of FIG. 1.
Figure 10:
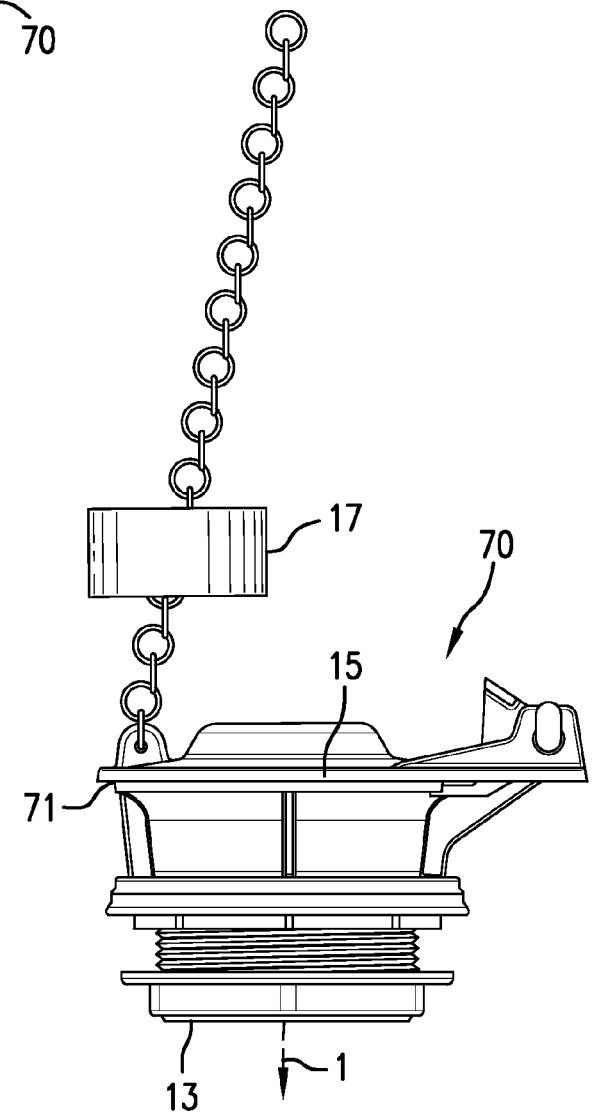
FIG. 10 is a side elevational view of the jet flush valve of the toilet assembly of FIG. 9.
Figure 11:
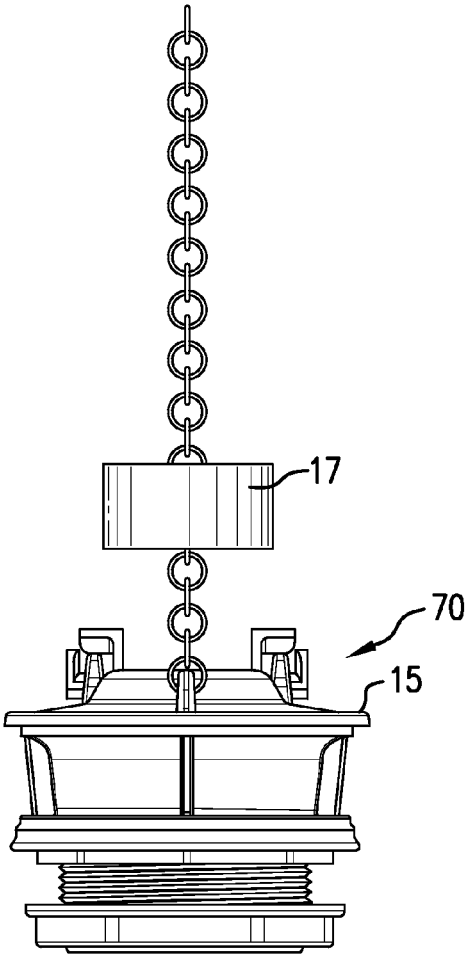
FIG. 11 is a front elevational view of the jet flush valve of the toilet assembly of FIG. 9.
Figure 12:
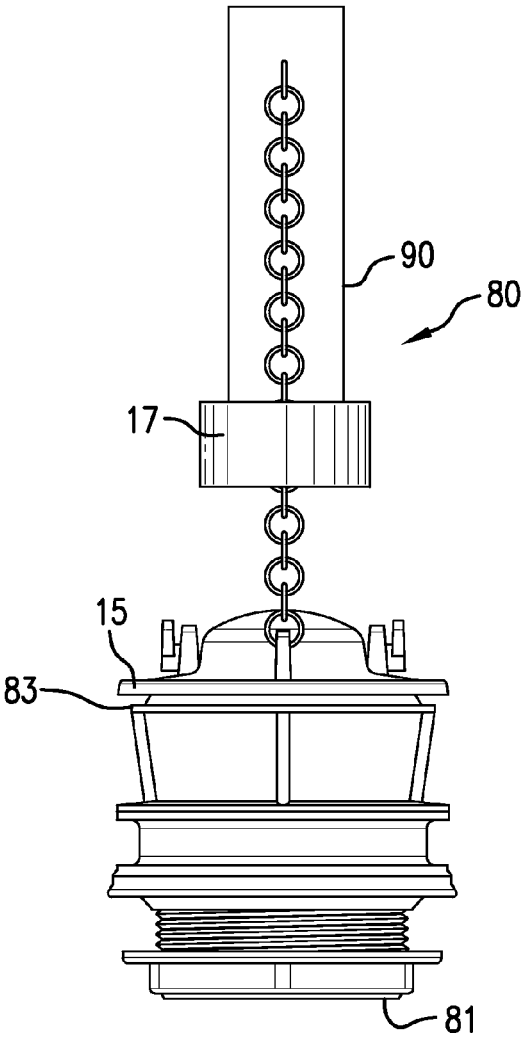
FIG. 12 is a front elevational view of the rim flush valve of the toilet assembly of FIG. 1 having an overflow tube.
Figure 13:
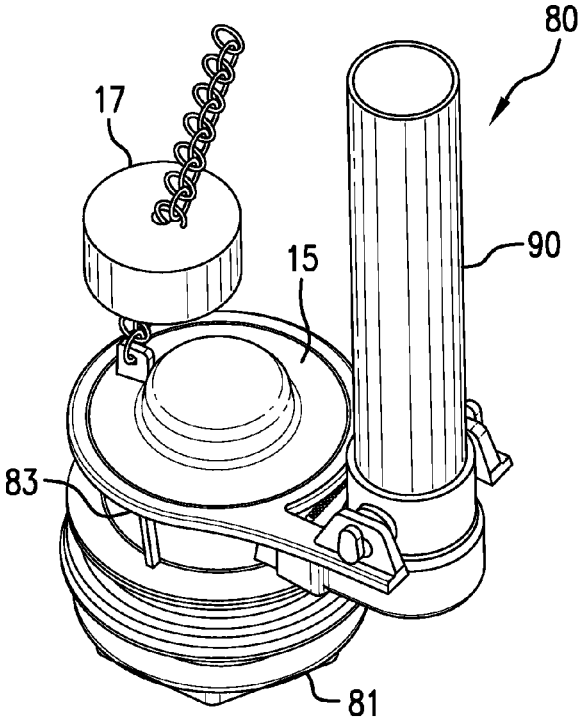
FIG. 13 is a perspective view of the rim flush valve of FIG. 12.
Figure 14:
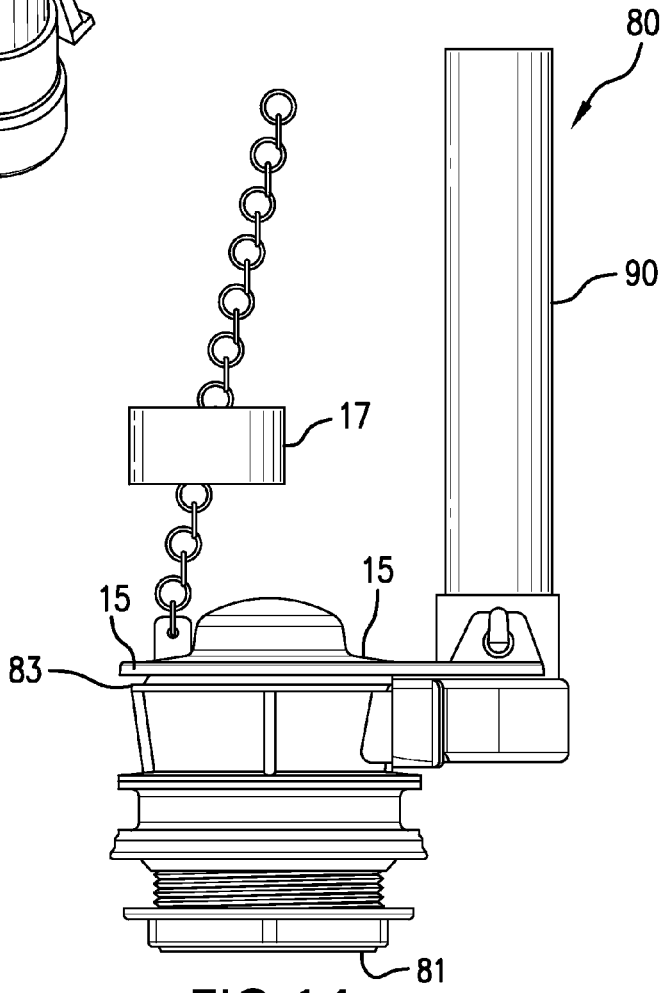
FIG. 14 is a side elevational view of the rim flush valve of FIG. 12.

In the embodiment as shown in FIG. 3, the shelf 27 can extend around almost the entire interior surface before terminating to induce a vortex flow effect for cleaning. A rim shelf design can also accommodate multiple rim shelves and multiple rim inlets as described in co-pending U.S. Publication No. 2013/0219605 A1, incorporated herein by reference in relevant part in terms of describing rimless features and as shown in the alternate "rimless" embodiment 410 of FIG. 28. A similar design as shown in U.K. Patent Application No. GB 2 431 937 A or any future variations of such designs, wherein the bowl is formed without the traditional hollow rim and water is directed around a contoured interior surface of the bowl in an upper perimeter portion forming a shelf or similar geometrical feature in the contour of the bowl surface as shown that allows fluid to pass around at least a partial path around the bowl entering the interior of the bowl at a location(s) which are transversely displaced form the rim inlet may be used as well. It should also be understood that standard rim channels having a rim inlet port that feeds into a rim channel defined by a traditional upper rim, and having one or more rim outlet ports for introducing washing water into the interior area of the bowl may also be used in the embodiment described herein (see FIG. 16 and embodiment 110). Such rim may be pressurized or not pressurized and have various features as described in further details below with respect to the embodiment 110. The rim features of embodiment 110 may be incorporated into the rimless version shown in FIGS. 1-13 or FIG. 28 without departing from the scope of the invention.

Figure 30:
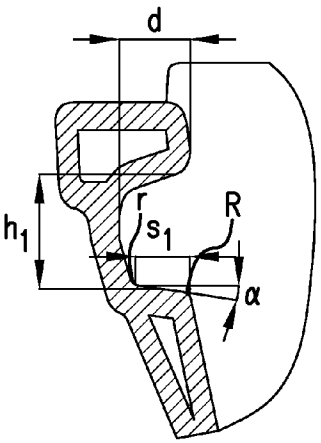
FIG. 30 is an enlarged longitudinal cross-sectional view taken along line 30-30 of FIG. 29 showing the depth of the rim shelf and height of the area formed in the upper peripheral area of the toilet bowl at the location of the rim shelf near the location of the rim inlet port.
Figure 31:
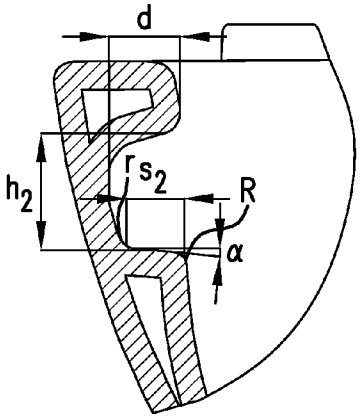
FIG. 31 is an enlarged longitudinal cross-sectional view taken along line 31-31 of FIG. 29 showing the depth of the rim shelf and height of an area formed in the upper peripheral area of the toilet bowl at the location of the rim shelf at a location approximately mid-way between the rear to the front of the bowl.
Figure 32:
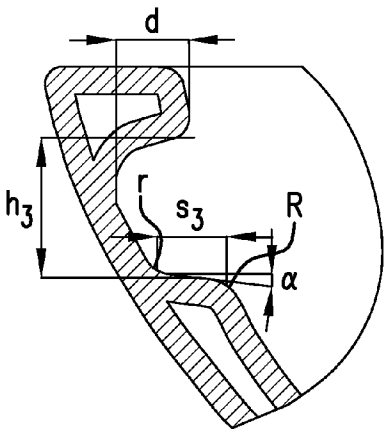
FIG. 32 is an enlarged longitudinal cross-sectional view taken along line 32-32 of FIG. 29 showing the depth of the rim shelf and height of an area formed in the upper peripheral area of the toilet bowl at the location of the rim shelf at a location at the front of the bowl.

In the assembly 10, as noted above, the shelf 17 may be inset. As shown in FIGS. 30-34, the shelf 27 is in a contour having a relatively constant, and preferably constant, depth d as measured transversely from the interior surface of the toilet bowl into the contour and a height h measured longitudinally from the shelf 27 to an upper surface 47 above the shelf. The shelf width s varies along the rim flow path from the rim outlet port. The contour has an inwardly extending portion 43 and an upper surface 47 above the shelf 27 that extends along the shelf but the shelf changes in size to provide a deeper shelf in the area where the contour has a shelf width $s_1$ and a height $h_1$ which is somewhat larger than the depth to accommodate strong flow of fluid from the rim inlet port as seen in FIG. 30, and maintaining a reasonably large shelf size in a position approximately mid-way between the rear and front of the bowl (see, FIG. 31) as rim flow continues along the shelf towards the front of the bowl as shown in FIG. 32 (see $s_2$ and $s_3$). While the depth d is relatively constant, the height h begins to elongate towards the front of the bowl (see $h_2$ and $h_3$) while the shelf width decreases (see $s_2$ and $s_3$). The depth preferably in one embodiment herein remains between about 10 mm to about 30 mm. Height in varies from about 35 mm to about 50 mm at the outset of flow to about 35 mm to about 50 mm at the mid-way point between rear and the front of the bowl, and to about 40 mm to about 55 mm at the front of the bowl. The shelf width is illustrated by s, wherein s is the transverse measurement taken along a tangent from a first curvature radius r at the inset edge of the shelf to the second radius of curvature R where the shelf tips downward. The shelf is at an angle $\alpha$ with the tangent from the first radius. The angle $\alpha$ in this embodiment varies and as shown is 7°, 5°, 7°, 22° and 31° as the shelf progresses along the paths in FIGS. 30-34, respectively. As the angle increases the radii enlarge and the shelf width s disappears in favor of a downward slope as the shelf terminates.

Figure 33:
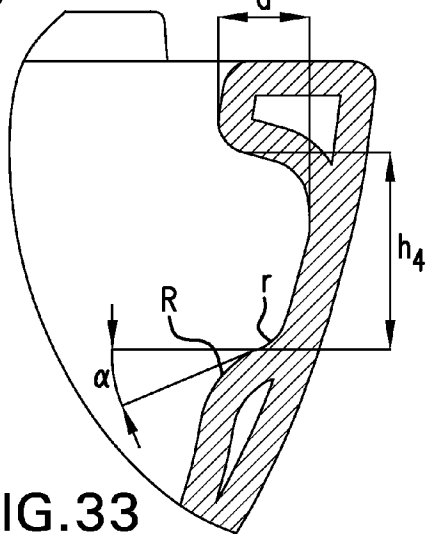
FIG. 33 is an enlarged longitudinal cross-sectional view taken along line 33-33 of FIG. 29 showing the depth of the rim shelf and height of an area formed in the upper peripheral area of the toilet bowl at the location of the rim shelf at a location approximately mid-way between the front and the rear of the bowl on a side of the bowl opposite the view in FIG. 31.
Figure 34:
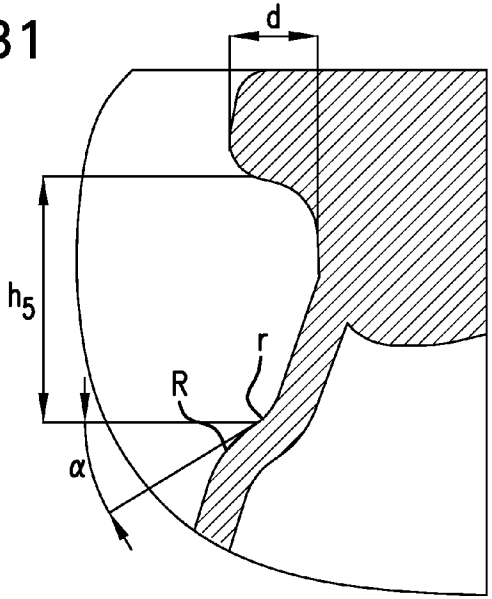
FIG. 34 is an enlarged longitudinal cross-sectional view taken along line 34-34 of FIG. 29 showing the depth of the rim shelf and height of an area formed in the upper peripheral area of the toilet bowl at the location of the rim shelf at a location at the rear of the bowl.
Figure 35:
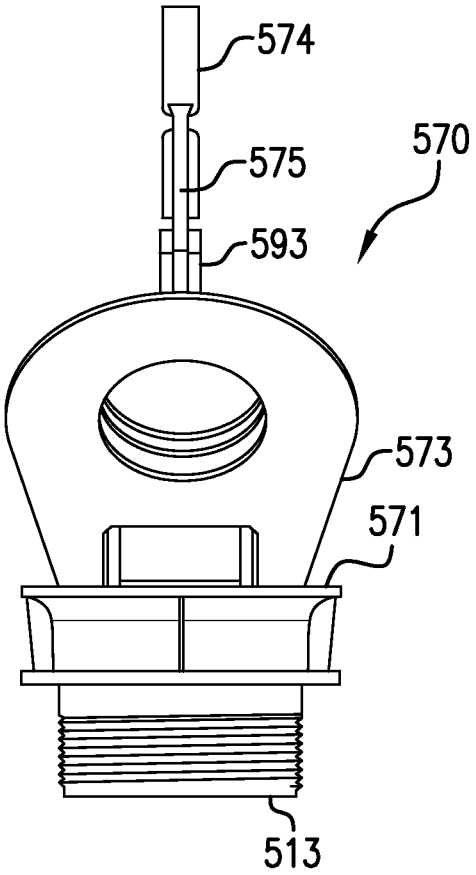
FIG. 35 is a front elevational view of jet valve for use in the embodiments of the invention herein shown in an open state in an embodiment of the jet valve having a flapper and a back flow preventer mechanism with a hold-down linkage.
Figure 36:
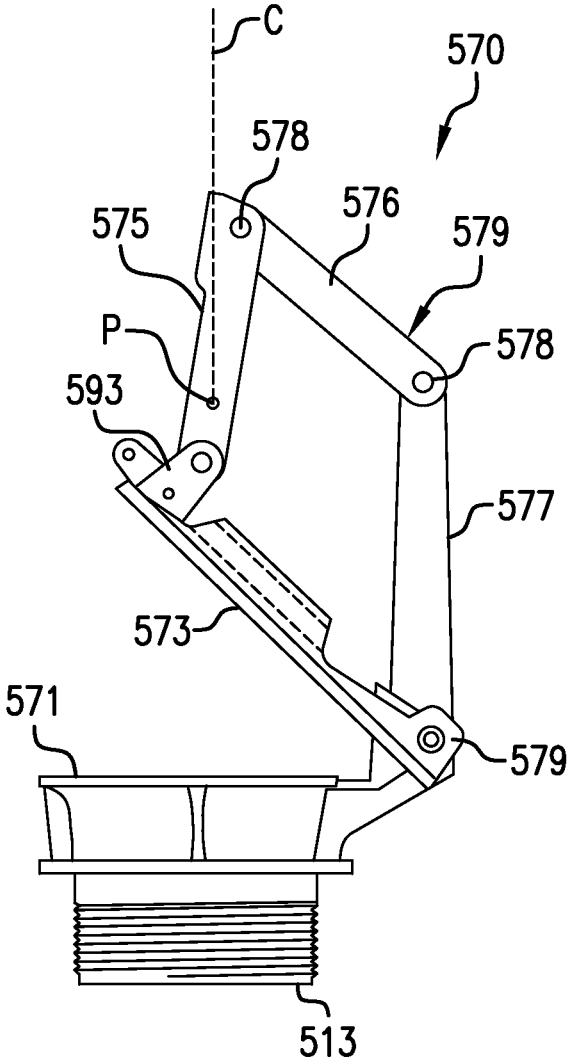
FIG. 36 is a right side elevational view of the jet valve of FIG. 35.

As flow continues to the opposite side of the bowl as shown in FIG. 33 at the midway point traveling from the front of the bowl towards the rear of the bowl at FIG. 34, the depth d remains constant, but the height elongates further from about 45 mm to about 60 mm at the mid-way point in FIG. 33 to the rear of the bowl where it is about 50 mm to about 65 mm. As the height elongates ($h_4$ and $h_5$), the shelf 27 decreases to a curve and ultimately terminates.

The bowl assembly also includes a jet 20 defining at least one jet channel, such as jet channels 38. The jet 20 has an inlet port 18 in fluid communication with the outlet 13 of the jet flush valve 70 and a jet outlet port 42 positioned in a lower or bottom portion 39 of the bowl 30. The jet outlet port may be configured in varying cross-sectional shapes and sizes for discharging fluid to a sump area 40 of the bowl 30. Additional optional areas or pathways may be provided so long as closed jet fluid path is maintained, including multiple jet outlets if desired or multiple additional pathways or openings to space within the bowl, provided the space is primed and any holes or outlets are below the water line in the sump to avoid impact on the jet trap seal depth. Additional jet outlets are preferably below the primary outlet. As best seen in FIGS. 3C to 3G the shape of the internal jet including space created by the bowl geometry around the channels 38 is larger than the channels themselves and extends between inlet 18 and outlet 13. The jet shape is illustrated in the top plan view, bottom perspective view, right side elevational view, back view and left side elevational views of FIGS. 3C to 3G, respectively. The shape or common areas may vary provided the interior space of the jet 20 remains primed in use.

The sump area 40 is in fluid communication with an inlet 49 to the trapway 44 having a weir 45. The closed jet fluid pathway 1 includes the jet channel(s) 38. The jet flush valve 70 is preferably positioned at a level L above the weir 45 of the trapway. The closed jet fluid pathway 1 preferably extends from the outlet 13 of the jet flush valve 70 to the outlet port 42 of the jet 20. Once the assembly is primed, the closed jet fluid pathway 1 is capable of remaining primed with fluid to keep air from entering the closed jet fluid pathway before actuation of and after completion of a flush cycle.

The closed jet fluid pathway may include a jet manifold (not shown) by inserting a space or area between the inlet and the jet path and providing fluid communication through a jet manifold inlet opening and an outlet (not shown). The toilet bowl assembly may have a rim manifold (not shown). Any such rim manifold would also have to have a rim manifold inlet opening in communication with the outlet 81 end of the rim flush valve assembly 80 and for receiving fluid from the outlet 81 of the rim flush valve assembly 80 and an outlet to deliver flow to the rim inlet. Such rim and jet manifolds are described in the embodiment of FIG. 16. In embodiment 10 herein, the rim 32 is a rimless shelf (although traditional rims with a rim channel may also be used). The shelf extends at least partially around the bowl.

The assembly preferably includes a tank 60 that is in fluid communication with a source of fluid (SF) which may be city water, tank water, well water or the like so that when installed, the assembly is installed, the tank 60 can accept a flow of fluid through the tank into the fill valve. The tank preferably has at least one fill valve 66. The fill valve may be any suitable fill valve commercially available or to be developed so long as it provides an adequate supply of water to maintain desired volume in the tank to serve the functions described in this disclosure. The tank 60 may be one large open container holding both the rim and jet flush valve assemblies as shown in FIGS. 1-13. The tank may also be modified as described below with respect to embodiment 1010 to have at least one jet reservoir and at least one a rim reservoir. If a divided reservoir is provided, the jet reservoir may include a fill valve or a jet fill valve along with the at least one jet flush valve assembly 70, and the rim reservoir may include the at least one rim flush valve assembly and a tank or rim fill valve. If desired, such a rim reservoir may further accommodate an overflow tube 91 on the rim flush valve assembly 80.

The toilet bowl assembly of FIGS. 1-13 like other embodiments herein is capable of operating at a flush volume of no greater than about 6.0 liters, and preferably no greater than about 4.8 liters, and even more preferably no greater than about 2.0 liters.

The sump area 40 of the bowl preferably has a jet trap 41 defined by the interior surface 36 of the bowl 30 in a lower portion 39 of the bowl. The jet trap 41 has an inlet end 46 and an outlet end 50. The inlet end 46 of the jet trap receives fluid from the jet outlet port 42 and the interior area 37 in a lower portion 39 of the bowl 30 and the outlet end 50 of the jet trap 41 includes and flows into the inlet 49 to the trapway 44. The jet trap has a seal depth as described further hereinbelow. All variations described below with respect to seal depth, jet paths and the measurement of the depth x as shown in embodiment 10, shown, e.g., in FIGS. 1-13 and 29-34 are also readily incorporated into and operable in the embodiment 110 of FIG. 16.

To maintain a siphonic flush toilet assembly such as assembly 10 in a primed state, the initial step is to provide a toilet bowl assembly having the features as described hereinabove and with respect to the various other embodiments herein including 110, 1010, 210, 310 and 410, etc., particularly wherein the closed jet fluid pathway 1 having the jet channel 38 therein extends from the outlet 13 of the jet flush valve 70 to the outlet 42 of the jet 20 so that once primed, the closed jet fluid pathway is capable of remaining primed with fluid to keep air from entering the closed jet fluid pathway before actuation of and after completion of a flush cycle. The flush cycle is actuated by any suitable actuator such as a flush handle H. In one preferred embodiment, the chinaware exterior and the handle H are formed from or incorporate materials herein providing an antimicrobial surface. After initiating the flush cycle by a flush actuator, such as a handle, the handle has a portion in operative connection (which may be detachable or not detachable) to a flush activation bar 75.

Figure 15:
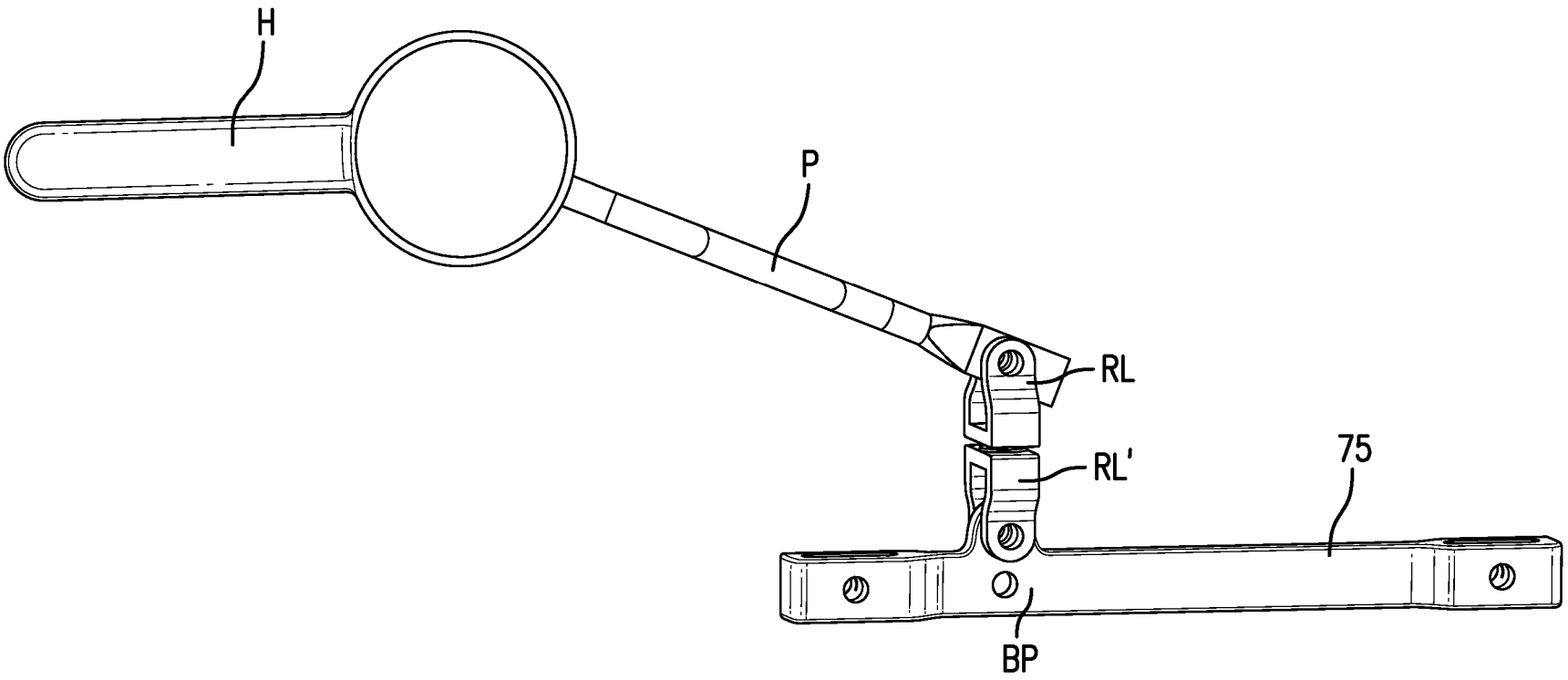
FIG. 15 is a perspective view of a flush actuation bar for the rim and jet valves of the toilet assembly of FIG. 1.

The valves can have an actuator that enables both to open at the same time (which may be done with a standard actuation bar of a flush handle) or can have a timing change and/or adjustment for lift based on the weight of the respective flush valve covers by using a flush actuation handle such as that of FIG. 15 which provides a balancing approach. As best shown in FIG. 15, handle H is in operative connection with a pivot rod P having a rotatable movement linkage RL. Any hinge, pin connection, washer or other rotating connector may be used. The flush activation bar 75 has a balance point BP for movable connection to the pivot rod P through linkage RL. A similar movable and rotatable linkage RL' (which may be the same as rotatable linkage RL) connects the pivot rod and its linkage RL to the flush activation bar 75 at the balance point BP. The balance point is chosen by design to operate with the flush valves so as to specifically and mechanically time the opening of each valve when the handle H is depressed to actuate the flush cycle. When handle H is depressed, the pivot rod and linkage RL are pushed upward at the end having linkage RL. This in turn pulls up on the activation bar 75. It is possible to provide a bar 75 having multiple holes to provide linkages for varying balance points so that only one bar need be manufactured but can be used for a variety of valve cover weights and flush timing patterns.

As the flush cycle is activated, fluid is provided through the at least one jet flush valve assembly and the at least one rim valve, here, through rim flush valve assembly 80. The configuration of the closed jet fluid pathway is such and the timing of the flush cycle optimized so as to maintain the closed jet fluid pathway in a primed state after completion of a flush cycle.

In one embodiment of the method herein, after actuating the flush cycle, the activator bar operates to provide fluid through the at least one jet flush valve assembly at a flow rate sufficient to keep air from entering the jet outlet and to generating a siphon in the trapway. The flow rate is then lowered through the jet channel for about 1 second to about 5 seconds until the siphon breaks; and the flow is maintained at least until the jet outlet port is covered.

Fluid is also preferably provided through the at least one rim flush valve assembly during the flush cycle. When first installed, the toilet may require an initial priming by providing a flow rate through the jet flush valve assembly outlet sufficient to keep air from entering the jet outlet port until the sump fills with fluid as described above. The associated flow rates for carrying out these steps are outlined elsewhere herein. The toilet assembly is capable of being self-priming as described above, and it is preferred that all or substantially all of the air becomes expelled from the jet channel when the toilet is in a state causing the jet channel to have air. It is acceptable for general performance that some minor amount of air may enter the closed fluid jet path while still providing good operation, preferably including up to only about 100 ml in an embodiment such as embodiment 10 shown herein, but acceptable performance can include further amounts of air, but preferably no more than about 500 ml to avoid fall off in performance. The specific quantities may vary by bowl geometry.

The toilet is typically in the primed state, for example, when the toilet is first installed as noted above, although other situations, such as plumbing work or maintenance also can cause such a situation. The user may, of course, manually intervene to prime the toilet assembly upon installation, or as configured, the toilet can self-prime over one or more of the first several flushes of the toilet without user manual intervention.

As shown in FIGS. 1-13 and 29-34 herein, the toilet is able to expel virtually all air in as little as about three flushes, although more or less may be required depending on individual toilet geometry. For self-priming to be complete, two conditions must be met: (1) the flow rate of fluid through the jet flush valve needs to be greater than the flow rate of fluid exiting the jet outlet port so as to provide sufficient energy to displace the air and (2) air must be provided a route of escape from the outlet or up through the jet flush valve assembly. This can be accomplished through modification of the jet channel and/or the jet outlet port geometry and/or cross-sectional area and/or by modification of the flush valve to enhance performance. Thus it is preferred to use a jet flush valve that can contribute a high energy and strong velocity flow into the closed jet fluid pathway through the jet channel. Suitable valves are described in U.S. Pat. No. 8,266,733 and in co-pending U.S. Patent Application Publication No. 2014/0090158 A, both of which are incorporated herein by reference with respect to their teaching of valves having streamlined valve body configurations and having a radiused inlet and/or a weighted cover. Other suitable flush valves are commercially available and are described elsewhere herein with respect to other embodiments of the toilet assemblies described below for which the same flush valves may be used (see also FIGS. 35-68 herein providing for better air release from peeling capability as described below). In addition to a gradually lifting cover, star patterned internal ribs may also impact the speed of air evacuation as discussed further below.

Figure 20:
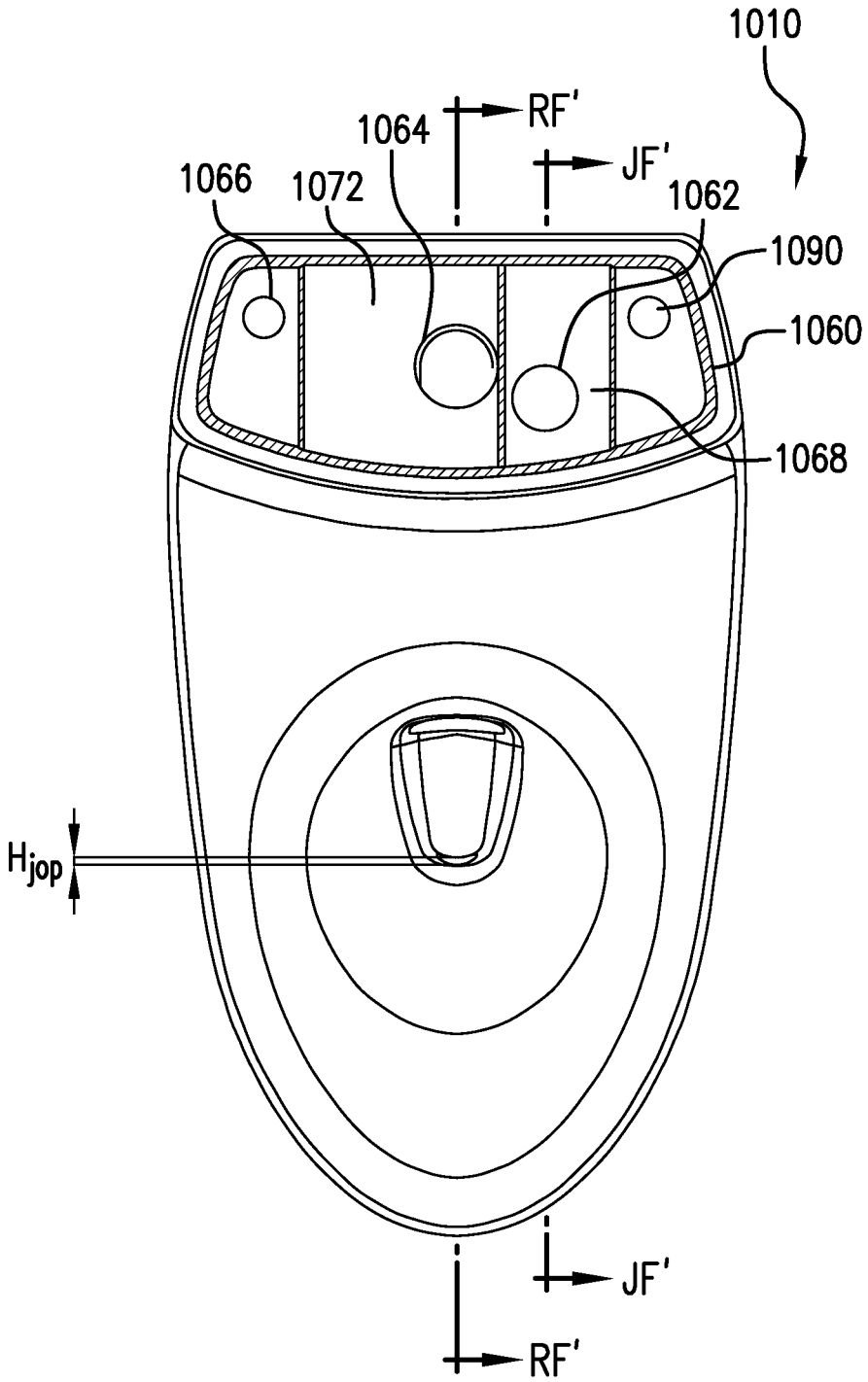
FIG. 20 is a top partial plan view of an alternate embodiment of a siphonic toilet bowl assembly of FIG. 1, having both a jet reservoir and a rim reservoir.
Figure 21:
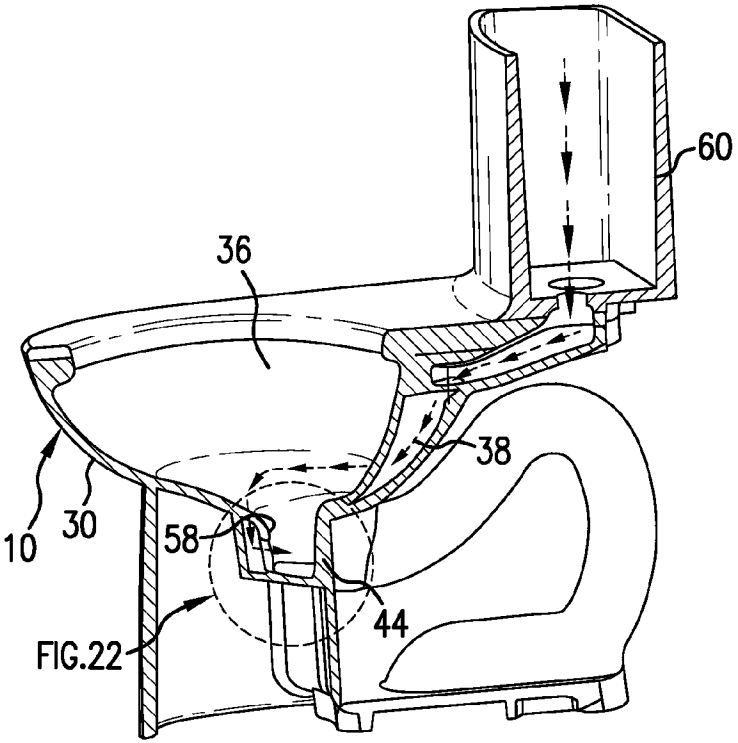
FIG. 21 is a longitudinal cross-sectional view of the siphonic toilet bowl assembly of FIG. 19, taken along line 21-21 and showing the flow of fluid to the jet with the jet flush valve assembly removed.

FIGS. 16 and 20, 21 and 22 show additional embodiments of toilet bowl assemblies described herein. The toilet bowl assembly of FIG. 16, generally referred to herein as 110, has at least one jet flush valve assembly 170 configured for delivery of fluid, such as flush water, to a jet 120, such as a direct-fed jet, and at least one rim flush valve assembly 180 configured for delivery of fluid to a rim 132. With reference to FIG. 21, the toilet bowl assembly 110 also has a jet manifold 112, having a jet manifold inlet opening 114 configured for receiving fluid from an outlet 113 of the jet flush valve assembly 170 and a jet manifold outlet opening 116 for delivery of fluid to a jet inlet port 118. The toilet bowl assembly 110 further has a rim manifold 122, including a rim manifold inlet opening 124 configured for receiving fluid from the rim flush valve assembly 180 and a rim manifold outlet opening 126 for delivery of fluid to a rim inlet port 128.

The assembly 110 further includes a bowl 130 having a rim 132 provided around an upper perimeter portion 133 of the bowl 130. In one embodiment, the rim 132 may define a rim channel 134 as shown. The rim inlet port 128 is in fluid communication with the rim channel 134 so that the rim channel 134 is also in fluid communication through the rim inlet port 128 with the rim manifold outlet opening 126 and the rim channel is also in fluid communication with at least one rim outlet port 129. As used herein, in fluid communication means that the one element of the assembly is structurally positioned so as to be open to flow from another element. The rim outlet port(s) are in fluid communication with an interior area 137 of the bowl 130, wherein the interior area 137 is defined by an interior surface 136 of the bowl 130. The remainder of this assembly is analogous to parts in embodiment 10.

With respect to embodiment 10, the bowl assembly includes a direct-fed jet 20 that has and defines the configuration of at least one jet channel(s) 38 as described above (such jet channels may also be provided to embodiment 110). The channel(s) extend between the jet inlet port 18 and the jet outlet port 42. The at least one jet channel 38 has an inlet port 18 in fluid communication with an outlet opening 16 of jet flush valve. The jet also has a jet outlet port 42 configured for discharging fluid from the jet channel 38 to a sump area 40. The sump area is in fluid communication with a trapway 44 or other toilet exit conduit for draining the toilet bowl 30.

Figure 19:
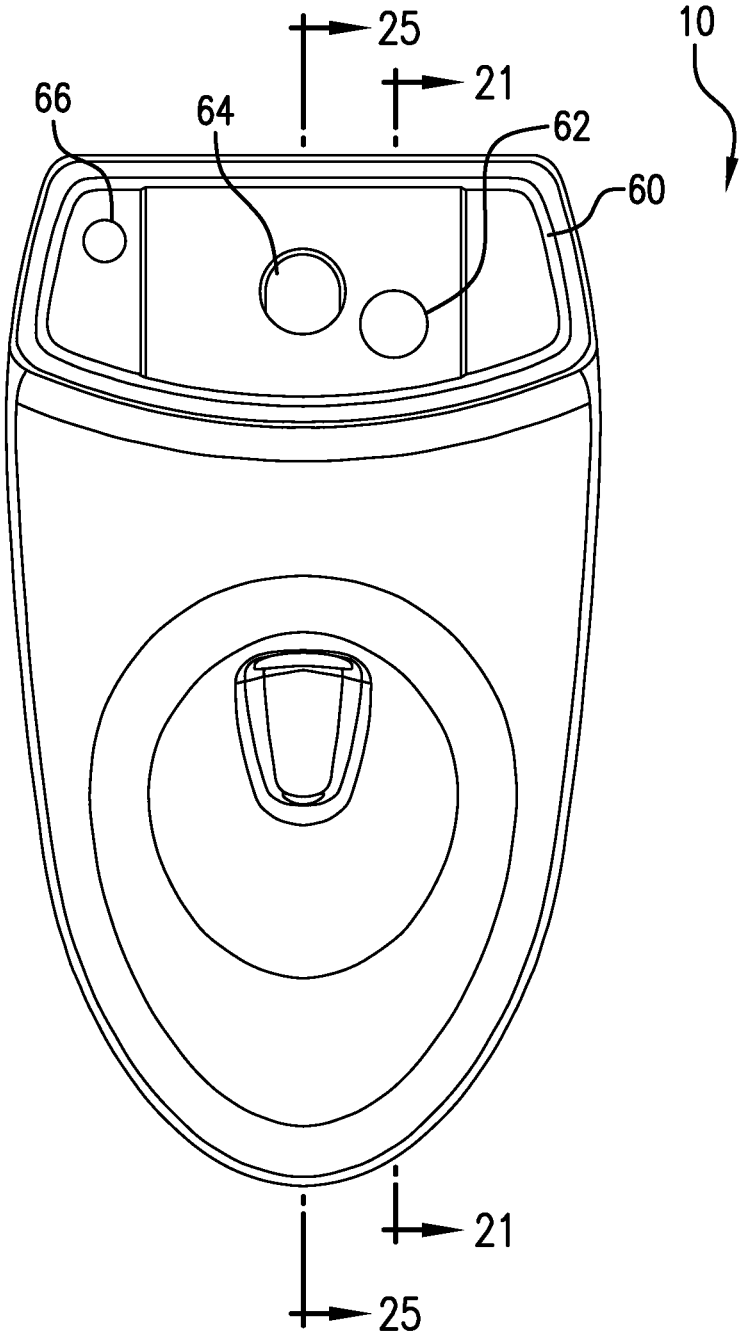
FIG. 19 is a top partial plan view of the siphonic toilet bowl assembly of FIG. 1.

A fluid source (such as flush water) may be used when the bowl is installed to come from an in-line flushmaster-type valve connected directly to a plumbing water inlet in the wall as in many industrial or commercial toilets. The assembly may optionally include a tank 60 as shown in FIGS. 19 and 21. Preferably, tank 60 provides at least one opening 62 for receiving the jet flush valve assembly 70 and allowing fluid from the outlet 13 of the at least one jet flush valve assembly 70 to enter the closed jet fluid path 1 and jet channel(s) 13, and at least one second opening 64 for receiving the rim flush valve assembly 80 and allowing fluid from the outlet 81 of the rim flush valve assembly 30 to enter the rim path to rim outlet port 28 or to any optional rim manifold through a rim manifold inlet opening.

The tank 60 should also include at least one fill valve 66 and, optionally, an overflow tube such as overflow tube 91 shown in the above embodiments, which is preferably associated with the rim flush valve. The tank 60 may be formed as a single, open reservoir housing both the jet flush valve and the rim flush valve in one area as shown in FIG. 19, or alternatively, constructed as two separate reservoirs as shown in embodiment 1010 of FIG. 20. An overflow tube should be operated from the flow of the rim flush fluid RF out of the rim flush valve (associated in any manner with the valve body known in the art or to be developed) and not from the flow of the jet flush fluid JF through the jet flush valve to eliminate any opportunity for air to enter the closed jet fluid path 1. The rim path may be left open to air without the nature of the invention being affected by connection to an overflow tube within the rim path.

The jet flush valve 70 and rim flush valve 80 assemblies may incorporate any standard commercially available flush valve and flapper design, including various designs known or to be developed in the art, for example, the Fluidmaster 502 flush valve. The rim valve may be electrical, mechanical or computer operated as well. Preferably, the toilet bowl assembly 10 has at least one jet flush valve assembly 70 configured for delivery of fluid, such as flush water, to a jet 20 and at least one rim flush valve assembly 80 separately configured for delivery of fluid to a rim outlet port. The flush valve assemblies for use in the present invention may be configured to be a master flush valve that delivers separate fluid flow to the rim and to the jet or, more preferably, is at least one jet flush valve assembly 70 and at least one rim flush valve assembly 80 positioned to deliver independent fluid flow and may be any suitable flush valves known or to be developed in the art such as those described above with respect to embodiment 10 and flush valves 70, 80.

The at least one jet flush valve assembly 70 and at least one rim flush valve assembly 80 can each also be a dual flush valve assembly. An example of a flush valve assembly known in the art which may be preferred for us in the embodiments herein may be found in U.S. Pat. No. 8,266,733 B2, incorporated herein in relevant part by reference. The two valves can be opened and closed simultaneously, or opened and closed at different timing during the flush cycle to further optimize performance. To achieve a cleaner bowl with cleaner post-flush water, it is desirable to open the rim flush valve prior to opening the jet flush valve. In preferred embodiments for a 6.0 liters/flush, the rim flush valve is opened immediately upon initiation of the flush cycle and closed at about 0.1 second to about 5 seconds into the cycle, whereas the jet flush valve is opened at about 1 second to about 5 seconds into the cycle and closed at about 1.2 seconds to about 10 seconds.

For ultra low flush toilets, with three liters/flush, the rim flush valve may be opened immediately upon initiation of the flush cycle and closed at about 1 second to about 3 seconds into the cycle, whereas the jet flush valve is opened at about 0.1 second to about 3 seconds into the cycle and closed at about 1.2 seconds to about 3 seconds. In embodiments herein, with a 54 mm diameter trapway, a volume of only about 1 liter flowing from the fully primed, closed jet channel is required to initiate the siphon, making possible the application of the invention to flush toilets that operate at volumes of 2 liters or less, depending on the desired effectiveness of the bowl wash and the quantity of water directed to that function.

Another embodiment for a dual flush toilet assembly opens a dual flush valve as rim flush valve immediately upon initiation of the flush cycle, which then triggers the jet flush valve (either single or dual flush) to open after the rim dual flush valve. The amount of water delivered to the rim for cleansing pre-siphon would be about 1 liter/flush to about 5 liters/flush, and preferably about 2 liters to about 4 liters/flush, and the amount of water delivered through the jet flush valve to establish a siphon would be about 1 liter/flush to about 5 liters/flush.

In an embodiment such as toilet bowl assembly 110 separate manifolds for separating the fluid flow introduced into the bowl assembly 110 from at least one flush valve assembly and delivering different fluid volumes to the jet 120 and to the rim 132. This is distinguished from a traditional toilet design in which fluid enters a bowl through one toilet inlet, flows into an open single manifold and then flows in an uncontrolled or gravity-controlled manner downward into the jet 120 and into the rim 132. In such prior art designs, the amount and nature of the fluid flow to the rim or direct jet is difficult to control and typically favors the jet over the rim due to gravity and flow momentum. However, by isolating the flow of fluid to the jet 120 and flow of fluid to the rim 132, fluid flow is controlled and the jet and rim received desired flow volumes. In addition, it allows for maintaining a closed jet fluid path 101 including the primed jet channel 138 and preferably a primed jet manifold 112.

Any optional jet manifold 112 is preferably pre-formed into the chinaware or other manufacturing material of the toilet bowl and is arranged in a stacked position and/or juxtaposed to a rim manifold. The manifolds may be juxtaposed but not completely at the same level. The jet manifold 112 may have a jet manifold outlet opening 116 for delivery of fluid to a jet inlet port 118. A rim manifold 122 may include a rim manifold inlet opening 124 configured for receiving fluid in varying amounts, for example, about 0.1 liters to about 5.5 liters, from the rim flush valve assembly 180, preferably from about 0.5 liters to about 4.5 liters. The rim manifold 122 also has a rim manifold outlet opening 126 for delivery of fluid to a rim inlet port 128. The flow of fluid through the jet 120 may travel directly down the jet channel(s) 138 and out the jet outlet port 142 and enter the sump area 140 at a time different from the entry of water passing through the rim channel 134 and one of these flows may stop before the other, but through at least a portion of the flush cycle, the flow preferably occurs simultaneously. These flow rates are selected to maximize cleaning of the interior surface 137 of the toilet bowl 130 before evacuating the sump area 140.

In another embodiment, the rim channel 134 can be powered directly by line pressure from typical residential or commercial plumbing lines. The opening and closing of flow to the rim can be controlled with mechanical pilot valves similar to those currently used as toilet fill valves or electronically with solenoid valves.

The bowls herein such as bowl 30, 130 may have varied configurations, but most bowls are pre-molded to be generally round or an elongated oval or elliptical shape when viewed transversely from the top of the bowl. In the embodiment described and shown herein, the bowl 30 has a generally elliptical shape. Bowl 130 has a rim 132 provided around an upper perimeter thereof and defining a rim channel 134. The rim channel has an inlet port 128 (at a transition point between the manifold and the rim channel where the rim channel cross-section becomes more uniform) in fluid communication with the rim manifold outlet opening 126 and at least one rim outlet port 129, preferably multiple such outlets, in fluid communication with an interior area 136 of the bowl assembly 110. Bowl 130 further has a jet 120 provided so that the jet channel(s) preferably pass along the exterior surface 135 of the bowl 130 or within the wall of the bowl so that the jet outlet port 142 is located in a lower portion 139 of the bowl 130.

In various embodiments herein such as toilet 10, the jet 20 defines at least one jet channel 38 having a jet outlet port 42 configured for discharging fluid to a sump area 40, and then to an entrance to a trapway 44 and to a toilet outlet O which can connect to a sewage outlet.

Figure 16:
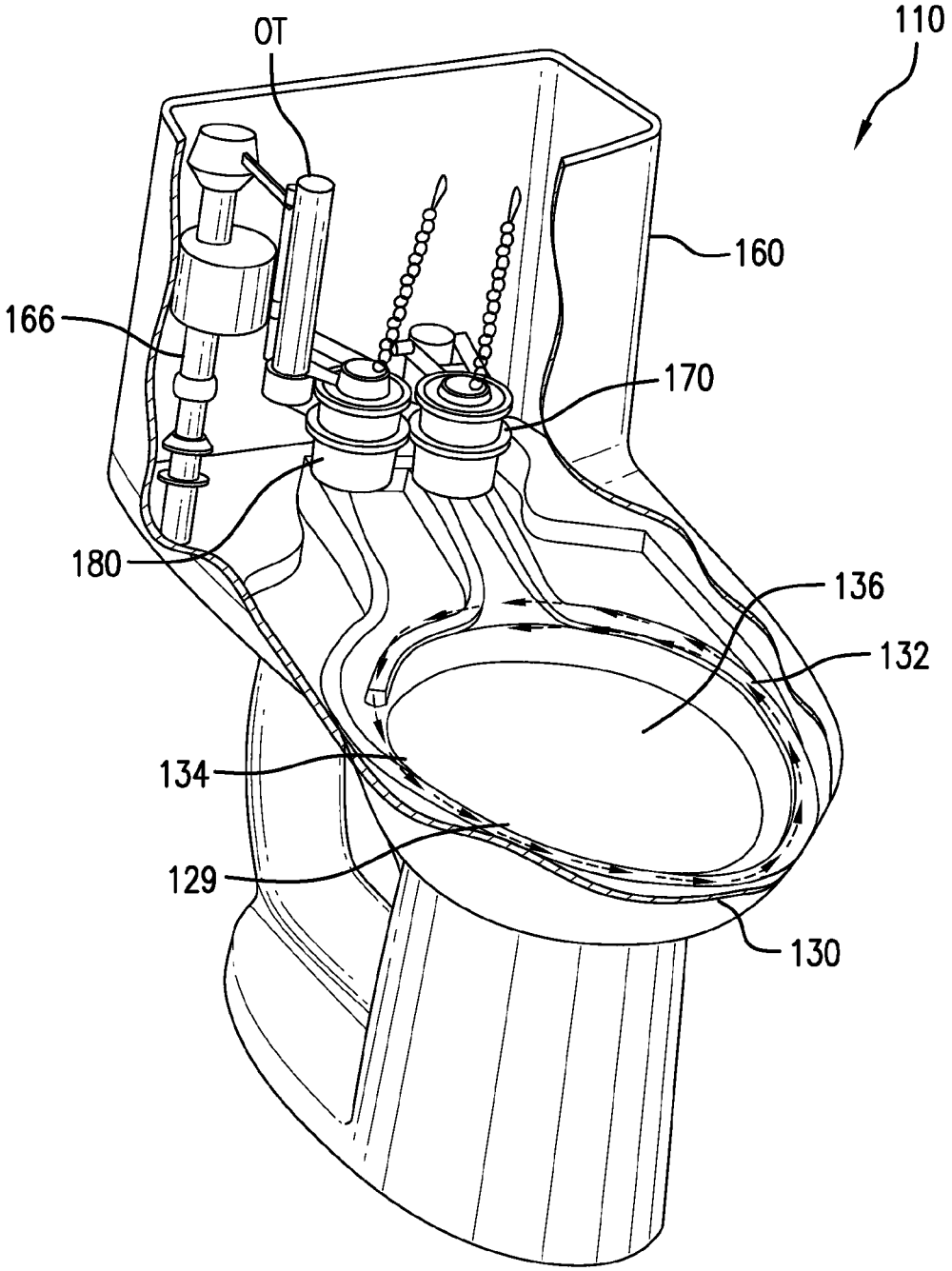
FIG. 16 is a front perspective view of a siphonic toilet bowl assembly according to one embodiment of the invention having a rim channel and at least one rim outlet port.
Figure 18:
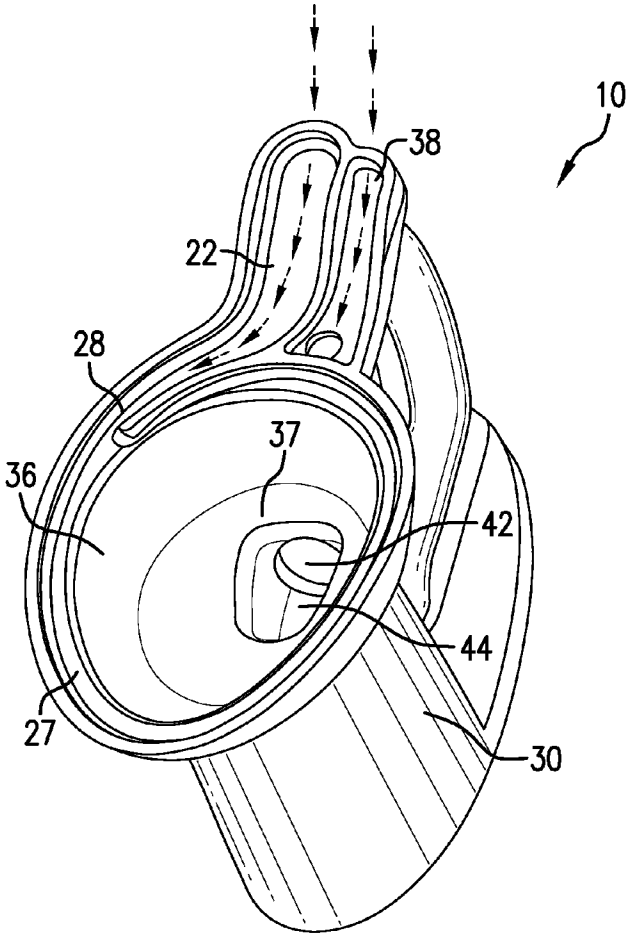
FIG. 18 is an perspective cross-sectional view of the siphonic toilet bowl assembly of FIG. 17.
Figure 17:
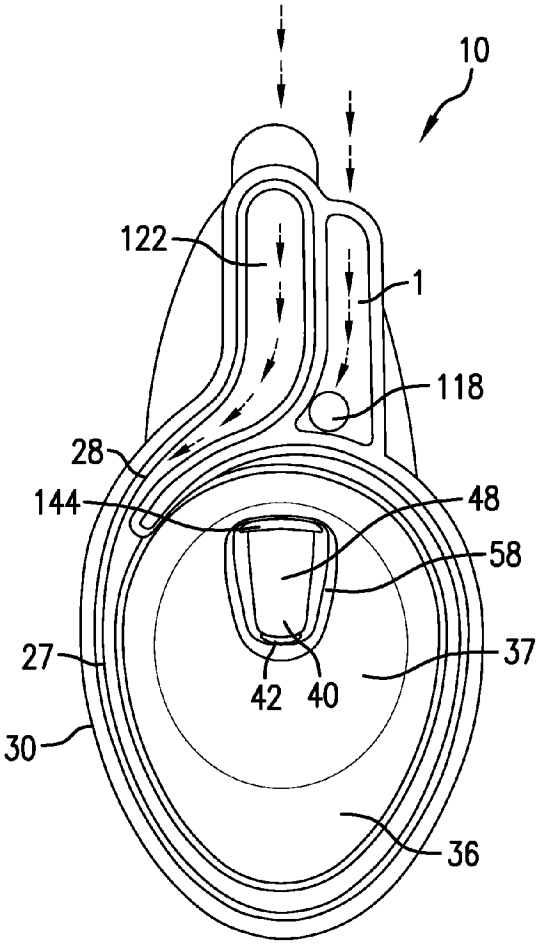
FIG. 17 is a is a transverse cross-sectional top view of the siphonic toilet bowl of FIG. 1 showing the rim channel inlet port and initial rim and jet flow.

In the embodiment of FIG. 16, some of the flush water is directed through the rim channel 134 and flows through openings 129 positioned in the rim 132 providing liquid communication between the channel 134 and the interior area of the bowl 130 so as to disperse water over the entire surface of the bowl 30, which serves to cleanse the bowl during the flush cycle. The water that flows through the rim channel 134 may also in some embodiments herein be pressurized upon exiting the rim outlet ports 129 or from an external fluid source as described above. Depending on the size of the outlet ports, toilet geometry and flow rate, pressurization can cause a strong pressurized stream of water for cleansing the bowl as well as contributing to the siphon. The remainder of the flush water from a separate jet valve assembly 170 is directed to the jet 120.

The jets 20, 120 herein and the at least one jet channel(s) 38, 138 provide a more energetic and rapid flow of flush water to the trapway entrance 44, 144, enabling toilets to be designed with even larger trapway diameters, however, care should be taken to minimize bends and constrictions that can impact operation and to improves the performance in bulk waste removal relative to non-jetted and/or rim jetted bowls.

The at least one jet channel 38 is designed to extend within the interior of the toilet bowl assembly 10 so as to pass around the exterior surface of the toilet bowl 30 but is also positioned to be at least partially within a space defined within the toilet bowl assembly body 10 generally under or beneath the interior area wall 36 of the bowl 30. Multiple jet channels of varying size may be used, for example, two symmetrical channels on either side of the bowl 30 deliver a "dual fed" flow of fluid to the jet 20.

Figure 23:
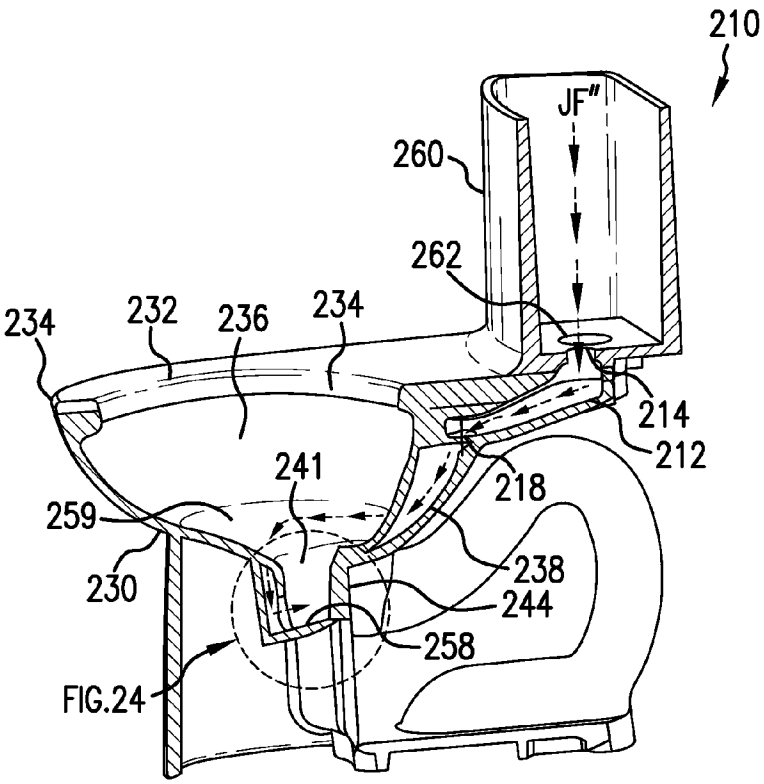
FIG. 23 is a longitudinal cross-sectional view of an alternative embodiment of a siphonic toilet bowl assembly to that of FIG. 21 showing the flow of fluid to a jet with the jet flush valve assembly removed and in which at least a portion of the wall of the toilet bowl in a sump area is upwardly inclined toward a trap inlet from the jet outlet port.

The jet outlet port 42 is configured for discharging fluid from the jet channel 38 to a sump area 40, which is in fluid communication with a trapway 44. The jet outlet port 42 preferably has a height $H_{jop}$ in one embodiment herein, as shown in FIG. 23, of about 1.0 cm to about 10 cm, preferably about 1 cm to about 6 cm, and most preferably about 1 cm to about 4 cm as measured longitudinally across the inner diameter of the jet channel 38. Regardless of the height $H_{jop}$, the cross-sectional area of the jet outlet port should be maintained at an area of about 2 $cm^2$ to about 20 $cm^2$, more preferably of about 4 $cm^2$ to about 12 $cm^2$, and most preferably of about 5 $cm^2$ and 8 $cm^2$. In one embodiment herein, the height $H_{jop}$ of the jet outlet port 42 at an upper surface 54 or uppermost point is preferably positioned at a seal depth x below an upper surface 56 of the inlet 49 to the trapway 44 as shown and is measured longitudinally through the sump area 40. The seal depth x preferably is about 1 cm to about 15 cm, more preferably about 2 cm to about 12 cm, and most preferably about 3 cm to about 9 cm to help prevent passage of air into the jet channel 38 through outlet port 42. This distance should also preferably be equal to or below the minimum level of fluid in the sump area 40 to avoid a break in the jet channel 38 and to maintain a primed state in the jet channel 38 of the toilet bowl assembly 10 with fluid from the jet flush valve assembly 70 or other flush valve before actuation of and after completion of a flush cycle.

As discussed above, maintaining a primed jet channel 38, i.e., a closed jet fluid path 1, greatly reduces turbulence arid resistance to flow, improves toilet performance, and enables lower volumes of water to be used to initiate siphon. Air in the jet channel 38 hampers the flow of flush water and restricts the flow of the jet 20. Furthermore, air, if not purged, can be ejected through the jet outlet port 42 and enter into the trapway 44, which can retard the trap siphon and affect clearance of bowl 30 fluid and waste.

To improve the cleaning function of the bowl in rim channel embodiments such as 110, it is also a preferred option to design the toilet assembly so that the rim is pressurized during the flush cycle. Pressurization of the rim channel 134 is preferably achieved by maintaining the relative cross-sectional areas as in relationship (I):

$$A_{rm}>A_{rip}>A_{rop}<6cm^2 \quad (I)$$

wherein $A_{rm}$ is the longitudinal cross-sectional area of the rim manifold 122, $A_{rip}$ is the cross-sectional area of the rim inlet port 28, and $A_{rop}$ is the total cross-sectional area of the at least one rim outlet port 29. Preferably, the cross-sectional area $A_{jm}$ of the jet manifold 112 is from about 20 $cm^2$ to about 65 $cm^2$ and the cross-sectional area $A_{rm}$ the rim manifold 122 is from about 12 $cm^2$ to about 50 $cm^2$. The cross-sectional area $A_{jm}$ of the jet manifold 12 is measured at a distance about 7.5 cm downstream from the center of the jet flush valve inlet opening 162. Likewise, the cross-sectional area $A_{rm}$ of the rim manifold 122 is measured at a distance about 7.5 cm downstream from the center of the rim flush valve inlet opening 164. Maintaining a preferred geometry of the water channels within these parameters and otherwise avoiding constrictions or bends that impact performance allows for a toilet bowl assembly 110 that maximizes the potential energy available through the gravity head of the water available from a fluid source, or in a tank, which becomes extremely critical when reduced water volumes are used for the flush cycle. In addition, maintaining the geometry of the water channels within these parameters and avoiding constrictions and overly small passageways in the jet or trap enables preferred pressurization of the rim and jet channels in a direct-fed jet toilet, maximizing the performance in both bulk removal and bowl cleaning Since there are preferably a plurality of rim outlet ports which can be of varying sizes depending on the desired design, the area of the rim outlet ports is intended to be the sum of all of the individual areas of each such outlet port. Similarly, if multiple jet flow channels 118 or multiple jet outlet/inlet ports are used, then the jet channels 118 or any multiple ports 142 would be the sum of the areas of the jet channels or jet ports, respectively. Further, to achieve the benefits of pressurization in the rim, it is preferred that the jet channel not be made overly small or constricted to avoid clogging and poor performance when functioning with the pressurized rim as described in U.S. Pat. No. 8,316,475, incorporated in relevant part with respect to sizing of rim and jet channels and toilet geometry in a pressurized rim siphonic toilet design.

Figure 22:
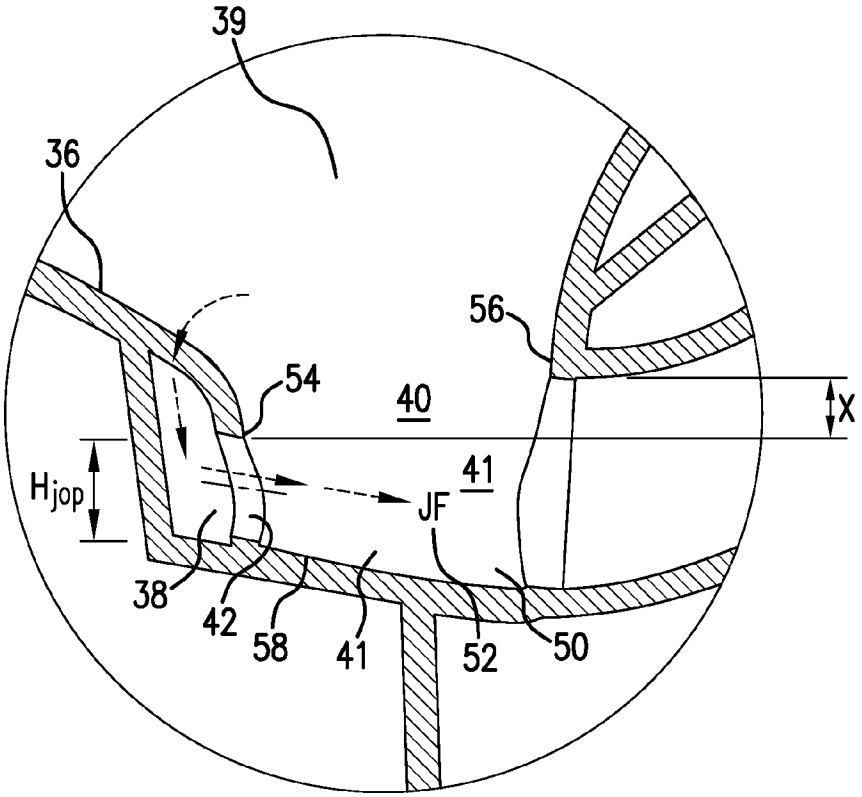
FIG. 22 is a greatly enlarged, partially cut-away cross-sectional view of the sump area of FIG. 21.
Figure 24:
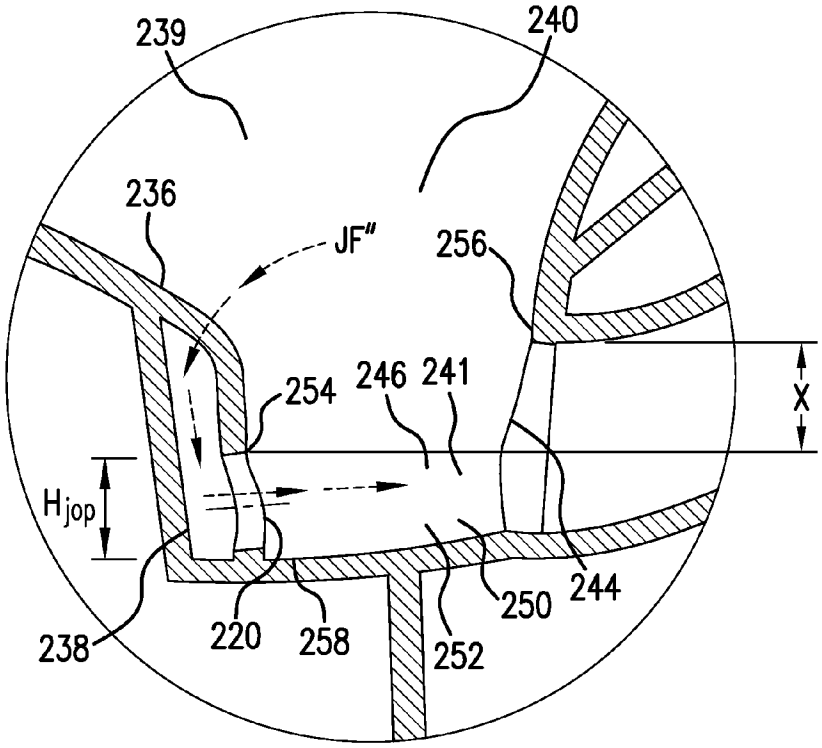
FIG. 24 is a greatly enlarged, partially cut-away cross-sectional view of the sump area of FIG. 23.
Figure 27:
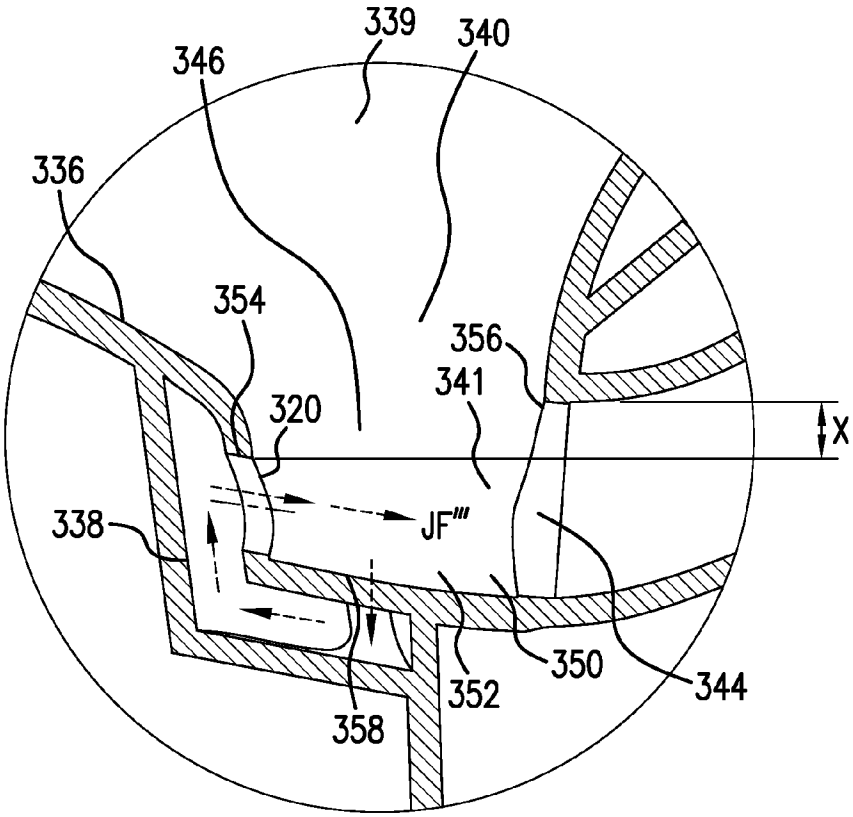
FIG. 27 is a greatly enlarged, partially cut-away cross-sectional view of the sump area of FIG. 26.

The sump area 40 of the toilet bowl 30 in embodiment 10, collects water from the rim, the jet channel 38, flush water and waste for evacuation. The sump area 40 is located in a bottom portion 39 of the bowl 30, and defines a trap 41 for the jet 20 by an interior surface 36 of the bowl 30 and extending longitudinally from a trap inlet end 46 to a trap outlet end 50, wherein the inlet end 46 has an opening 48 for receiving fluid from the jet outlet port 42. The trap outlet end 50 has an opening 52 for fluid exiting the bowl to an entrance to a trapway 44. The jet trap 41 has a seal depth x, as shown in FIGS. 22, 24 and 27, that is the distance between the topmost point on an upper surface 54 of the inlet to the trapway 44 and the topmost point on an upper surface 54 of the jet outlet port 42.

The jet trap seal depth x is measured preferably so as to maintain a distance of about 1 cm to about 15 cm, more preferably 2 cm to about 12 cm, and most preferably 3 cm to about 9 cm to assist in maintaining the siphon in the sump area 40. When the jet trap seal depth x is sufficiently large, it establishes a buffer level of fluid in the sump area 40 that helps ensure the trapway will break siphon before the level of water in the jet trap 41 can be pulled below the depth at which the seal of the jet channel 38 will be broken, thereby preventing the passage of air into the jet channel 38 and maintaining the jet channel 38 in a fully primed state. Conversely, in some embodiments, the jet trap seal depth x can be equal to 0 or less than 0 (when above the trap) and still maintain a primed state in the jet channel 38 and path 1 by adjusting the rate of flow through the jet flush valve assembly 70.

In the sump area 40, at least a portion of the interior surface 36 has a inclined portion 58 that may be upwardly inclined towards the trap entrance from the jet outlet port 42 so as to increase the seal depth x of the jet channel 38 and decrease the likelihood of air entering the jet channel 38 during or after a flush cycle. The seal depth x can be further extended by forming a jet channel 38 that temporarily dips below the floor of the sump before rising to the jet outlet port 42 at the sump floor. The seal depth x can also be increased by reducing the diameter of the jet outlet port 42. Preferably, the height $H_{jop}$ of the jet outlet port 42 can be reduced to form a circular, oval or oblong outlet, which would help to maintain sufficient cross-sectional area and flow through the jet 20 while increasing the seal depth x of the jet channel 38.

FIG. 20 shows an alternate embodiment generally referred to herein as assembly 1010, but for the feature of a tank 1060 with separate reservoirs as described below in all other respects is the same and analogous reference numbers refer to analogous elements herein. The tank 1060 may include at least one jet reservoir 1068 and at least one a rim reservoir 1072, and the jet reservoir 1068 may include a jet fill valve 1090 and the at least one jet flush valve assembly, which may be the same as in assembly 10, as configured for delivery of fluid to the jet manifold inlet opening 1062, and the rim reservoir 1072 may have a rim fill valve 1092 and the at least one rim flush valve assembly, which may be the same as in assembly 110, configured for delivery of fluid to the rim manifold inlet opening 1064. This may be a partial transverse division of the tank 1060, allowing for the use of one fill valve, or the tank division may be a permanent pre-molded casting of the tank into multiple reservoirs. If an overflow tube is optionally present in both the jet reservoir 1068 and the rim reservoir 1072, the overflow tube has to be operated from the flow RF' of the rim flush fluid and not from the flow JF' of the jet flush fluid.

FIGS. 23 and 24 show another embodiment generally referred to herein as assembly 210. But for the feature of the sump area inclined wall being configured in a upwardly inclined or tapered position toward the entrance of the trapway 244 as described below in all other respects is the same as the embodiment 10. The sump area wall 258 as shown in FIGS. 23 and 24 is designed to extend around and enclose the sump area 240. The jet outlet port 242 is positioned so the fluid JF" from the jet channel 238 enters into the bowl sump area 240 so as to merge with fluid that has entered the toilet bowl from the rim through the at least one rim outlet port (not shown). The jet fluid flow JF" and the rim fluid flow RF" merges at that point (and with waste and other fluid if present) and then flows together generally downwardly along the bowl interior surface 236 and over the sump wall into the sump area 240 into the trapway entrance 244 for expulsion through the sewage drain. At least a portion of a wall 258 may be upwardly inclined if desired to increase the seal depth x of the jet channel 238 that helps to prevent air from entering the jet channel 238 during or after the flush cycle. When the seal depth x is sufficiently large, it establishes a buffer level of fluid in the sump area 240 by helping to ensure the trapway 244 will break siphon before the level of water in the jet trap 241 can be pulled below the depth at which the seal of jet channel 238 will be broken, thereby preventing the passage of air into the jet channel 238 and maintain the jet manifold 212 in a fully primed state.

Figure 25:
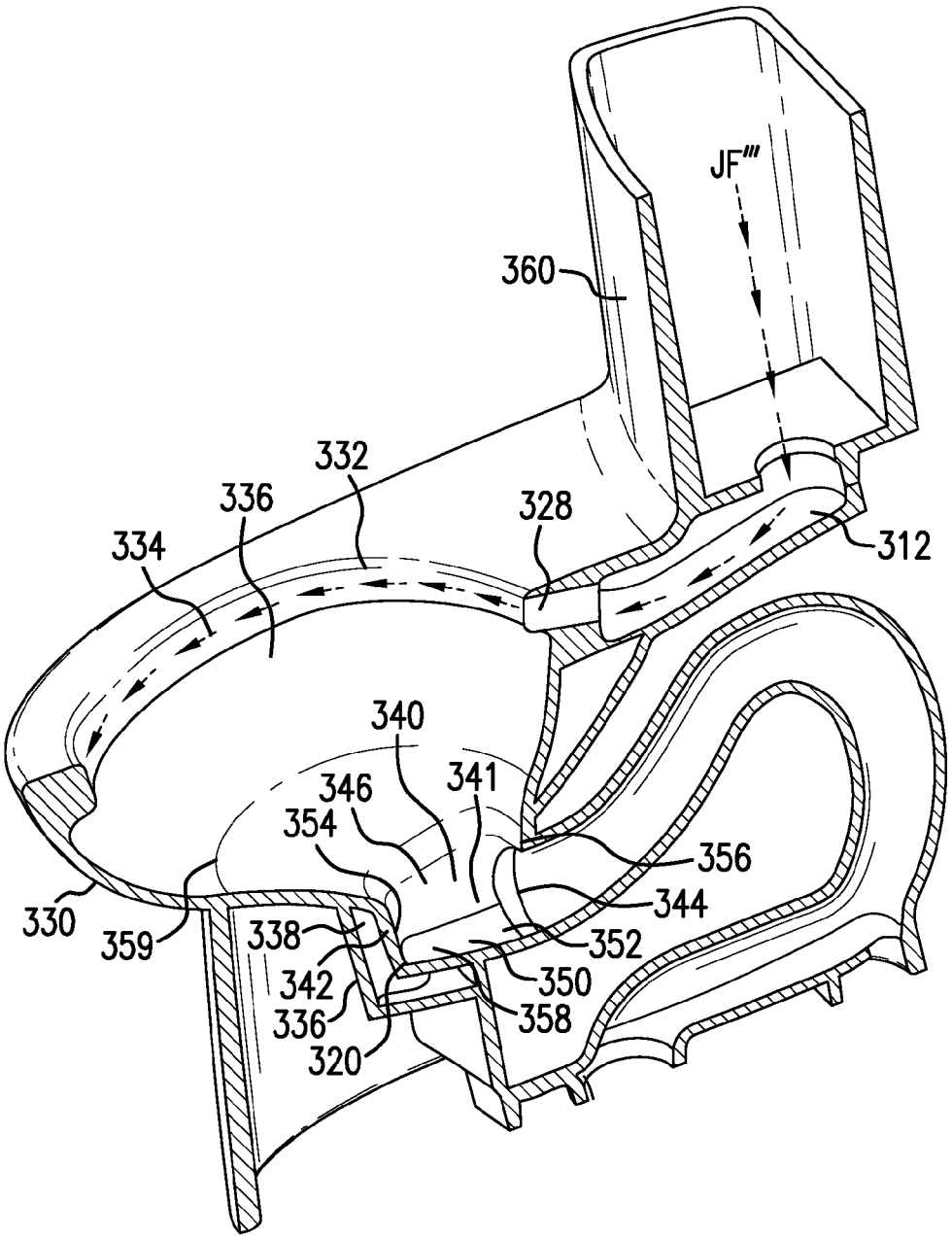
FIG. 25 is an isometric longitudinal cross-sectional view of an alternative embodiment of a siphonic toilet bowl assembly of the invention, in which the jet flow passes under the bowl and showing the flow of fluid to the rim with the rim flush valve assembly removed.
Figure 26:
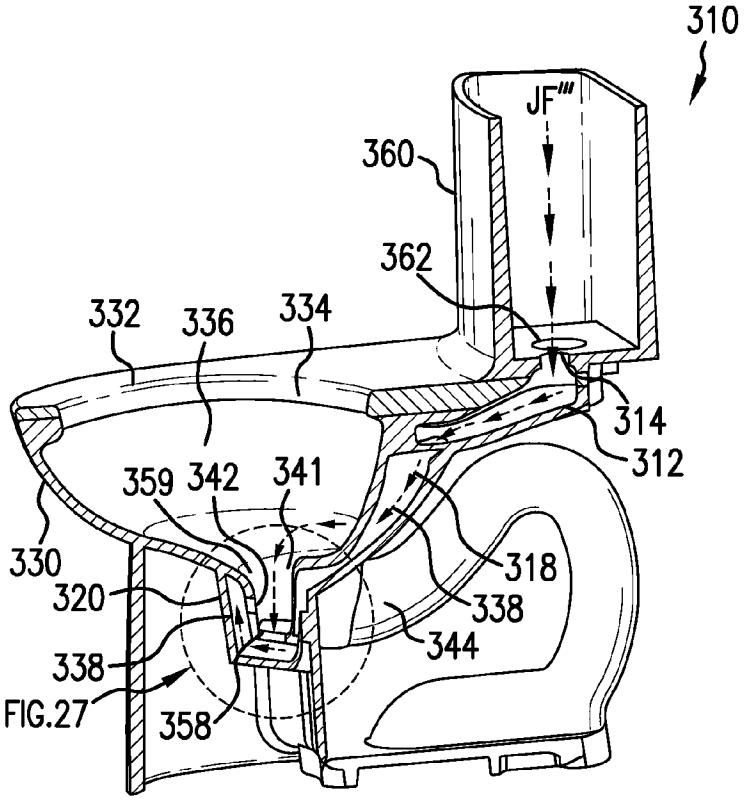
FIG. 26 is a longitudinal cross-sectional view of the siphonic toilet bowl assembly of FIG. 25 showing the flow of fluid through the jet.

FIGS. 25-27 show a different embodiment to those of FIGS. 16-24 generally referred to herein as assembly 310. But for the feature of the at least one jet channel 338 being under the bowl sump area 340 as described below in all other respects is the same as embodiment 110. The at least one jet channel 338 is designed to extend within the interior of the toilet bowl assembly 310 so as to be located behind the interior wall 336 and the sump area wall at the rear of the bowl 330 but is also positioned to be at least partially within a space defined within the toilet bowl assembly body 310 generally under the interior wall 336 and the sump area wall 358 of the bowl 330. The at least one jet channel 338 passing under or below the sump area 340 and ends within the sump area wall 358 so as to position the jet outlet port 342 directly opposite to the entrance to the trapway 344. The advantage of this construction is that at least one jet channel 338 will more easily stay primed and thus, eliminate air in the jet channel 338 as its design is gravitationally able to maintain full jet fluid JF"' capacity and the level of fluid in the jet channel is inherently under the level of the fluid or flush water in the bowl at both pre-actuation and post-actuation of a flush cycle. The routing of the jet channel 338 below the floor of the sump further increases the seal depth x of the jet channel 338 beyond what can be accomplished by a sloped sump floor embodiment such as that pictured in FIGS. 25 and 24, offering greater assurance that the trapway will break siphon before the level of the water in the jet trap 341 can be pulled below the seal depth x at which the seal of the jet channel 338 will be broken, thereby preventing the passage of air into the jet channel 338 and maintaining the jet manifold 312 in a fully primed state.

Figure 28:
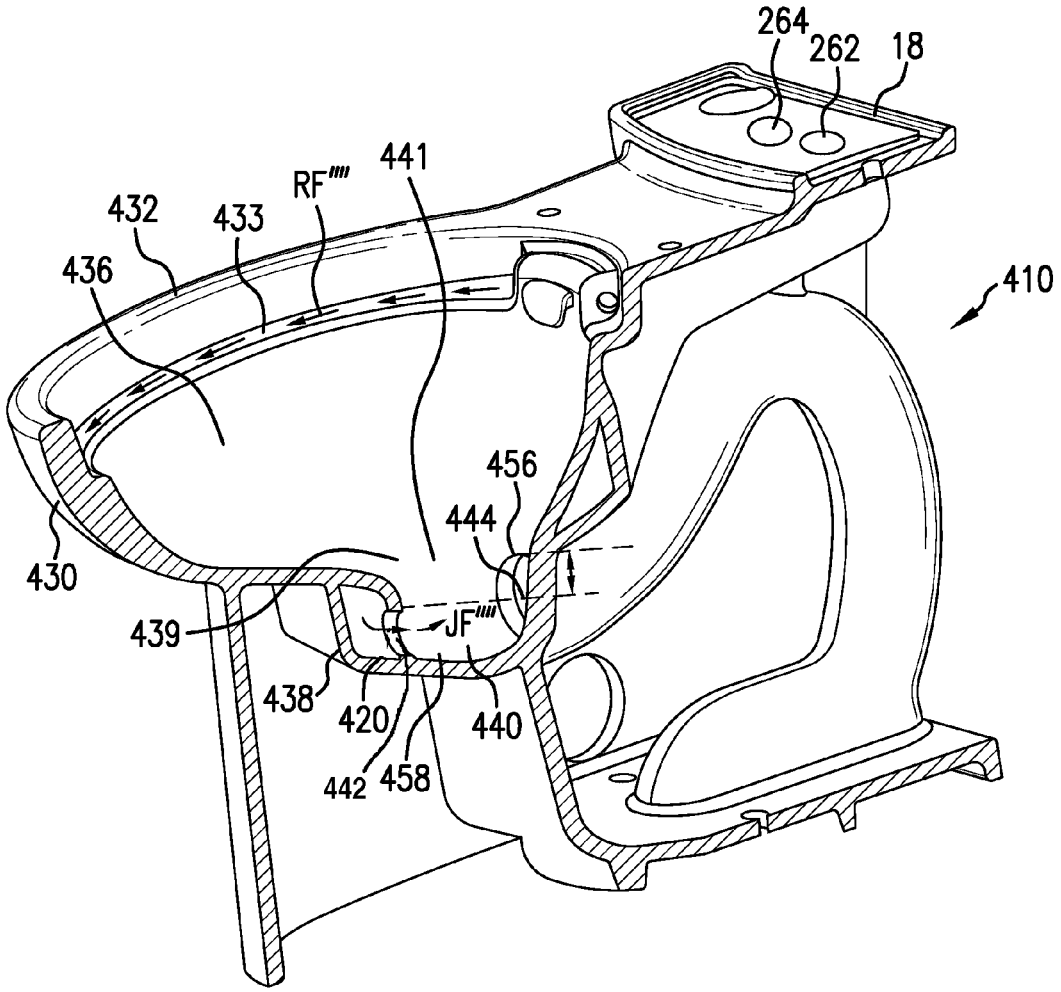
FIG. 28 is an isometric longitudinal cross-sectional view of an alternative embodiment of a siphonic toilet bowl assembly of the invention, showing the flow of fluid to an upper perimeter portion of the rim with the rim flush valve and the jet flush valve assemblies removed.
Figure 29:
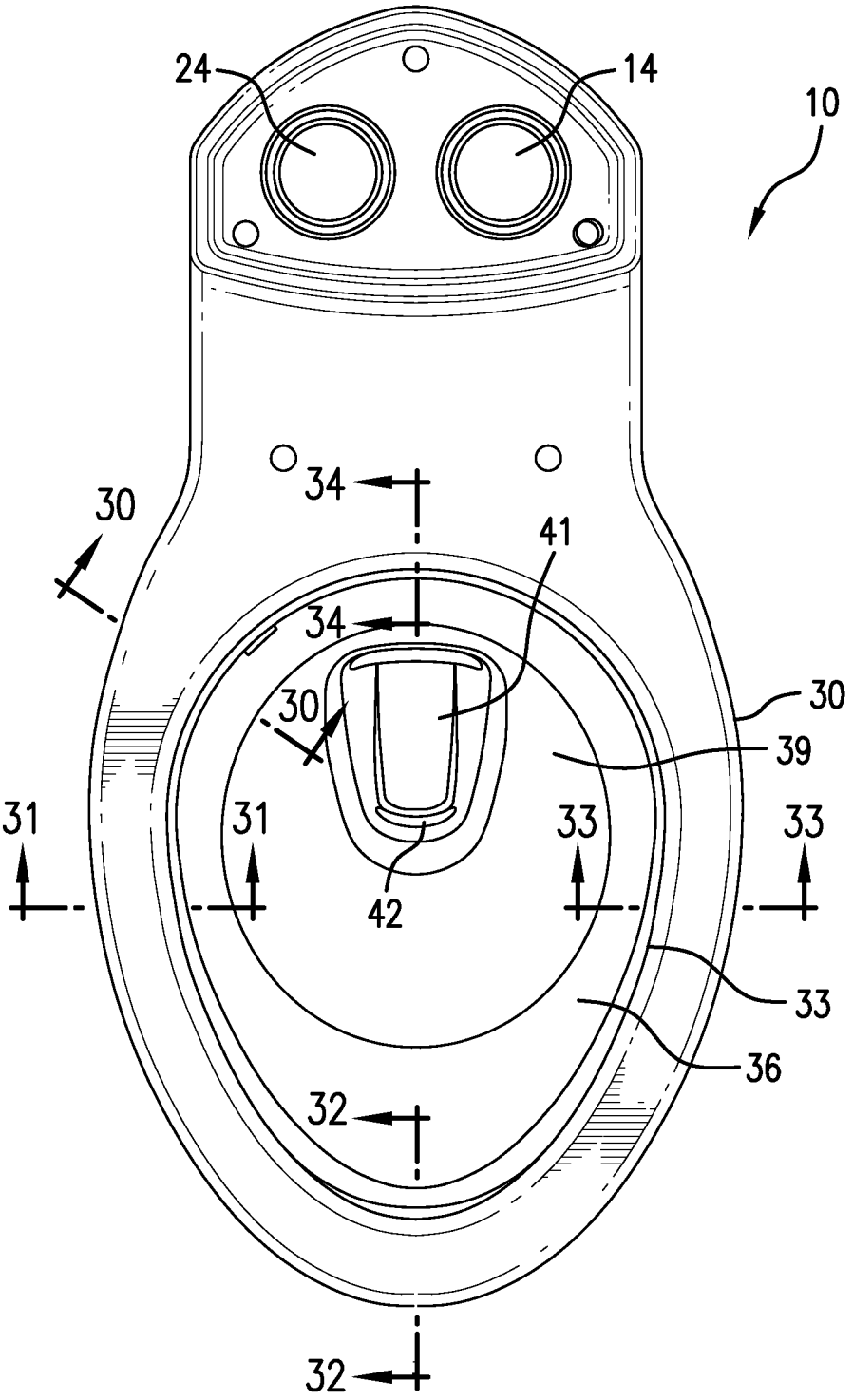
FIG. 29 is a transverse cross-sectional view of the toilet of FIG. 4B for illustrating various longitudinal cross-sectional views of the rim shelf as shown in FIGS. 30-34.

FIG. 28 shows a different embodiment to those of FIGS. 16-27 generally referred to herein as assembly 410. But for the feature of the upper peripheral portion 433 around an upper perimeter of a bowl 430 as described below in all other respects is the same. The rim 432 has an upper peripheral portion 433 which is positioned around the inside of the upper perimeter of the bowl 430 so that fluid RF"" from the rim manifold enters into the bowl for washing down waste in the sump area 440 and to merge with fluid that has entered the toilet bowl from the jet channel 438 and expelled through the jet outlet port 442. The jet fluid flow JF"" and the rim fluid flow RF"" merges at that point (and with waste and other fluid if present) and then flow together generally downwardly along the bowl interior surface 436 and over the sump wall 458 into the sump area 440 into the trapway entrance 444 for expulsion through the sewage drain. When the seal depth x is sufficiently large, it helps to establish a buffer level of fluid in the sump area 440 that assists in ensuring the trapway will break siphon before the level of water in the jet trap 441 can be pulled below the depth at which the seal of the jet channel 438 will be broken, thereby preventing the passage of air into the jet channel 438 and maintaining the jet manifold in a fully primed state.

In another embodiment a rimless version of the embodiment is pictured in FIG. 28, flow of fluid enters from rim inlet ports behind a distributor and around a rim shelf in two opposite directions on the upper peripheral portion 433 and passes at least partially around the interior surface of the bowl, thereby forming cleaning action. In a preferred embodiment, upper peripheral portion 433 can be formed so as to guide the flush water downward as it flows around the perimeter of the bowl 430. This embodiment is similar to the assembly of FIG. 1-13 but has a different rim shelf design.

In an embodiment of the preferred method of the invention, after providing, such as by manufacturing, a toilet bowl assembly 10, such as the one described herein, jet is primed with fluid JF from the at least one jet flush valve assembly 70 before actuation and after actuation of a flush cycle. The method herein may be practiced on any of the embodiments herein, including assemblies 10, 1010, 110, 210, and 310, 410, etc.; however, for convenience, an exemplary embodiment of the method will be described with references to assembly 10, embodied in FIGS. 1-13. Analogous parts in alternative embodiments may also be used if practicing the invention using other embodiments.

Priming of the jet manifold 12, jet inlet port 18 and the at least one jet channel 38 before actuation of a flush cycle occurs by opening a flapper or cover of the jet valve flush assembly 70 and allowing fluid (such as flush water) to flow into the jet inlet port 18 and the at least one jet channel 38 upon installation of the toilet bowl assembly 10 onto an installation surface. This priming will automatically occur with the first activation of a flush cycle. When the rim flush valve 80 and the jet flush valve 70 close, water will be maintained in the jet channel 38 and jet manifold 12, held in place by the force that atmospheric pressure exerts on the surface of water in the bowl 10. If any small air pockets remain in the at least one jet channel 38 or jet manifold 12 after the first flush, they will be ejected upon subsequent flushes to yield a fully primed system.

After the initial priming of the toilet bowl assembly of the embodiments herein, a user will actuate a flush cycle. In a standard prior art toilet bowl assembly, a flush valve assembly, such as those described herein, and an overflow tube are provided for use. A flush valve cover connected to the flush valve assembly and a bulb are both connected to a pivot arm. The pivot arm is attached to the top of the flush valve cover and includes a link for attachment to a chain that can be used to lower and raise the valve cover through actuation of any standard valve actuator such as a flush handle and lever, etc. In use, the pivot arm of the flush valve cover is attached to an overflow tube using a standard connection that protrudes from the overflow tube and opens and closes over the inlet opening of the flush valve assembly.

When the flush cycle has been initiated or actuated in the current invention, a flush valve cover opens on both the rim flush valve assembly and the jet flush valve assembly and allows for fluid to pass through the at least one jet flush valve assembly 70 into the jet and rim. These may open simultaneously or through a time delay system as known or to be developed in the art to allow for optimal flow rates through the toilet bowl assembly 10, such as by using the flush activation bar 75 noted above.

Following actuation of a flush cycle and after completion of the flush cycle, the jet the jet inlet port 18 and the at least one jet channel 38 remain in a primed state as long as (1) the depth of water in the reservoir feeding the jet flush valve is not allowed to fall to the level of the inlet 71 to the jet flush valve 70 before the jet flush valve 70 is closed and (2) the seal of the jet channel 38 is not broken during or after the flush cycle. If both of these conditions are met, the closed jet fluid path 1 including the jet channel 38 and the jet manifold 12 will remain fully primed and ready for the next flush cycle.

The invention will now be described with respect to the following non-limiting Example:

EXAMPLE

Table 1 summarizes data from 20 flushes completed using three different toilets. The present invention was tested based on the embodiment shown herein in FIGS. 1-13 and 29-34. Prior art toilets tested required 79-82% of the flush water to be directed to the jet to achieve desired hydraulic performance of the siphon. The toilet made according to the present invention provided essentially equivalent hydraulic performance using less than 30% of the flush water directed to the jet, thereby allowing the remainder of the water to be used for significant improvement to bowl cleaning.

TABLE 1

| | | Main Flush [l] | Peak Rate [l/s] | Time to Peak [s] | Time to 2500 ml/s [s] |
|---|---|---|---|---|---|
| Prior Art Toilet "K" | Average | 4.343 | 3.239 | 0.778 | 0.405 |
| 79% of Main Flush | STD | 0.068 | 0.116 | 0.144 | 0.03 |
| Volume Through Jet | MAX | 4.458 | 3.478 | 0.99 | 0.45 |
| | MIN | 4.219 | 2.994 | 0.55 | 0.35 |
| Prior Art Toilet "T" | Average | 4.367 | 3.94 | 0.6 | 0.322 |
| 82% of Main Flush | STD | 0.186 | 0.112 | 0.039 | 0.016 |
| Volume Through Jet | MAX | 4.829 | 4.175 | 0.69 | 0.36 |
| | MIN | 4.106 | 3.762 | 0.54 | 0.3 |

TABLE 1-continued

| | | Main Flush [l] | Peak Rate [l/s] | Time to Peak [s] | Time to 2500 ml/s [s] |
|---|---|---|---|---|---|
| Present Invention | Average | 4.456 | 3.547 | 0.982 | 0.583 |
| 27% of Main Flush | STD | 0.052 | 0.131 | 0.088 | 0.084 |
| Volume Through Jet | MAX | 4.584 | 3.794 | 1.12 | 0.72 |
| | MIN | 4.377 | 3.234 | 0.81 | 0.45 |

The various embodiments herein, 10, 110, 1010, 210, 310, 410, etc. may each benefit from variations in the jet flush valve herein. Optional and unique features may be provided to the jet flush valve designs noted above to improve operation of the various embodiments. In use, should the toilet ever become clogged, or for some other reason, the toilet needs plunging for various plumbing reasons, it is important to release the clog but prevent back-flow up the closed jet pathway through the jet valve which is in a constant primed state. Backflow is not a concern in conventional toilets as they are open to atmosphere. In the present primed invention, it is an issue due to the weight of the water and the existing column of water in the jet channels. One way to modify the jet flush valves herein so as to resist back-flow is by providing a back-flow preventer device to the jet flush valve. Such devices will now be described with respect to a jet flush valve otherwise analogous to jet flush valve 70 herein.

Although the flush valve designs discussed above are very effective against the backflow of water that could occur on plunging, added levels of protection may be desired in some embodiments. Intentionally breaking the prime, i.e., letting air into the closed jet channel and opening it to atmosphere greatly reduces the potential for backflow.

FIGS. 35-38 show an embodiment of a jet flush valve, referred to herein as jet flush valve 570 having a flapper cover 573 and a back-flow preventer mechanism 574 that has a hold-down linkage configuration. The cover 573 may be the same as cover 15 of valve 70 in assembly 10. As shown, the cover 573 is fitted with a first front linkage mount 593 for attaching the hold down linkage. The linkage assembly in the back-flow preventer mechanism 574 includes a first front linkage arm 575 having an attachment point P for a chain C to connect to an actuator mechanism (such as in FIG. 15) to allow lifting of the cover 573. Such a chain can include a float as described above.

The first linkage arm is connected by a hinge pin such as pin 578 to a second linkage arm 576, but other hinge connectors, pins, living hinges, molded pins, rivets or similar mechanisms may be used. Similarly, linkage arm 576 is connected by a similar hinge connector to a third linkage arm 577 which is also pivotally mounted to a back hinge mount 579. In use, if the flapper is lifted, the back-flow preventer hold-down linkage lifts and bends freely as shown so as to form an angle of less than about 180° between the first and second linkage arms when fully opened.

Figure 37:
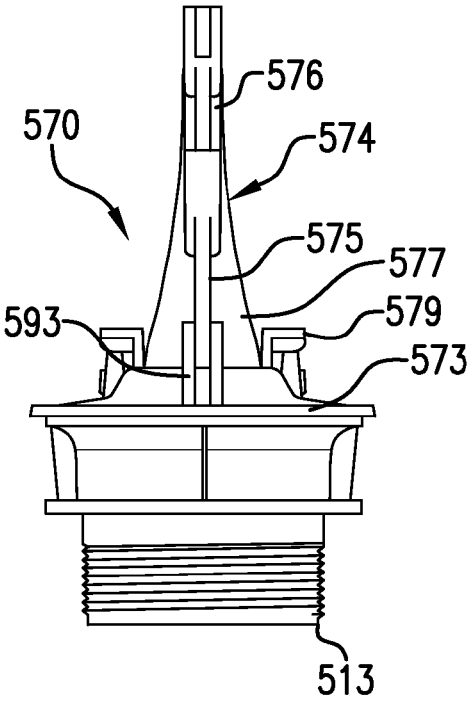
FIG. 37 is a front elevational view of the jet valve of FIG. 35 in the closed state.
Figure 38:
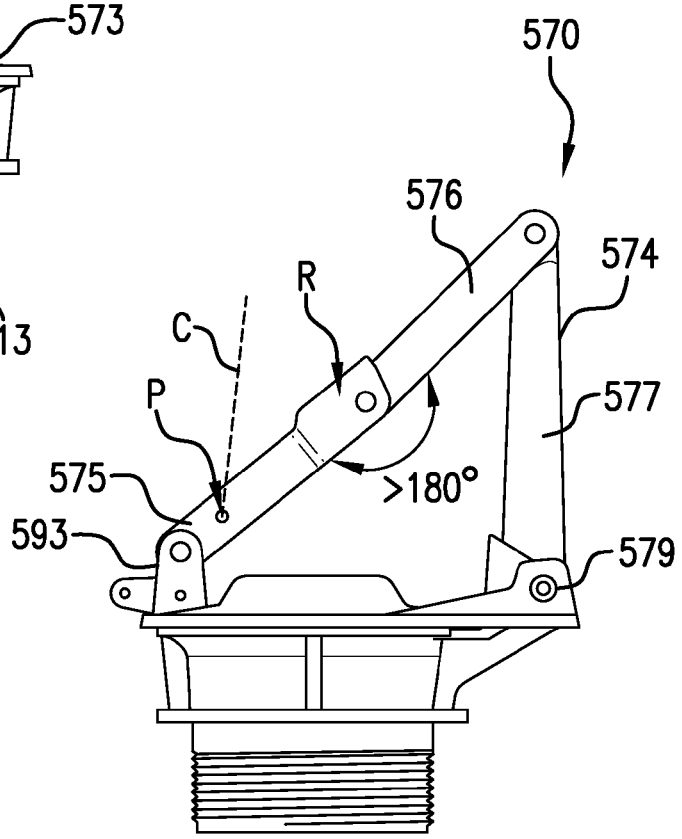
FIG. 38 is a right side elevational view of the jet valve of FIG. 37.
Figure 39:
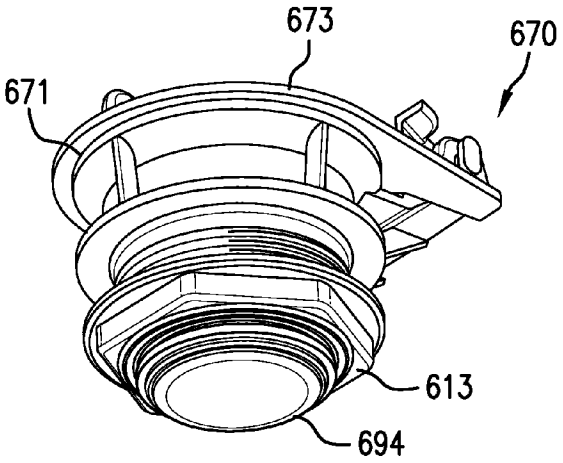
FIG. 39 is a bottom perspective view of a further jet valve for use in the embodiments of the invention herein shown in a closed state in an embodiment of the jet valve having a flapper and lower poppet opening.
Figure 40:
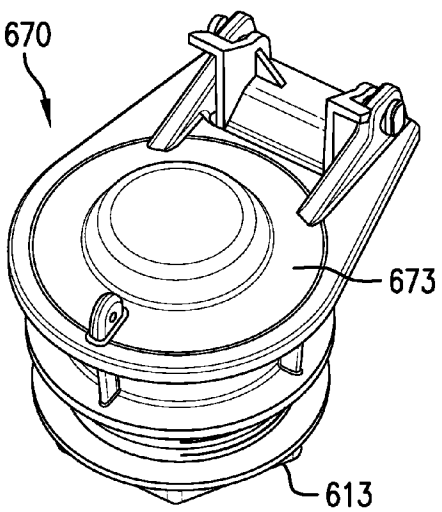
FIG. 40 is a top perspective view of the jet valve of FIG. 39.
Figure 41:
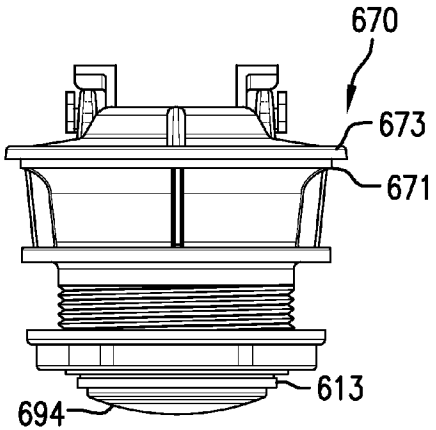
FIG. 41 is a front elevational view of the jet valve of FIG. 39.
Figure 42:
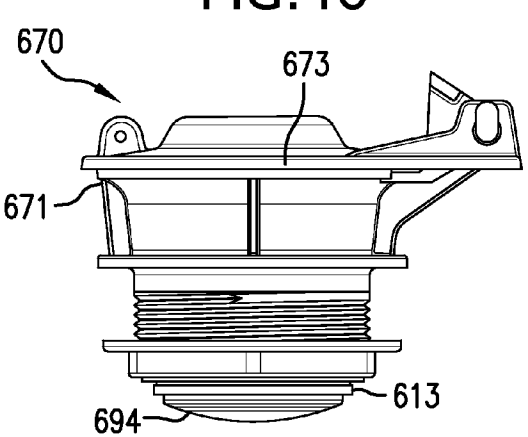
FIG. 42 is a right side elevational view of the jet valve of FIG. 39.
Figure 45:
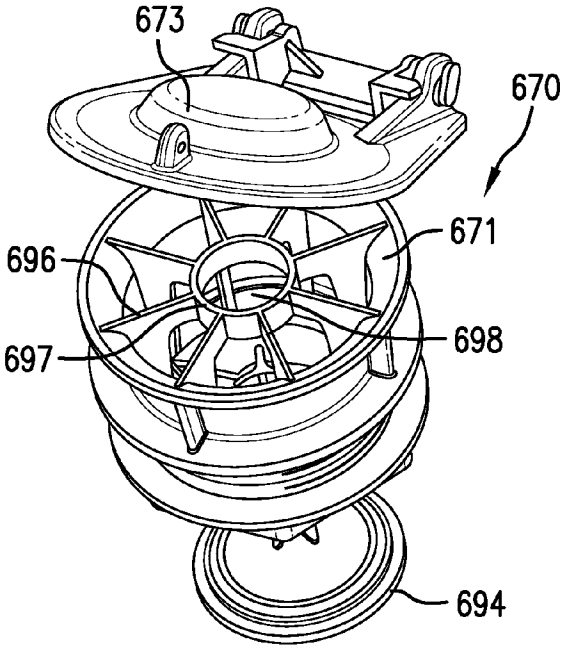
FIG. 45 is a top perspective view of the jet valve of FIG. 44 showing a star-configuration internal rib structure.
Figure 44:
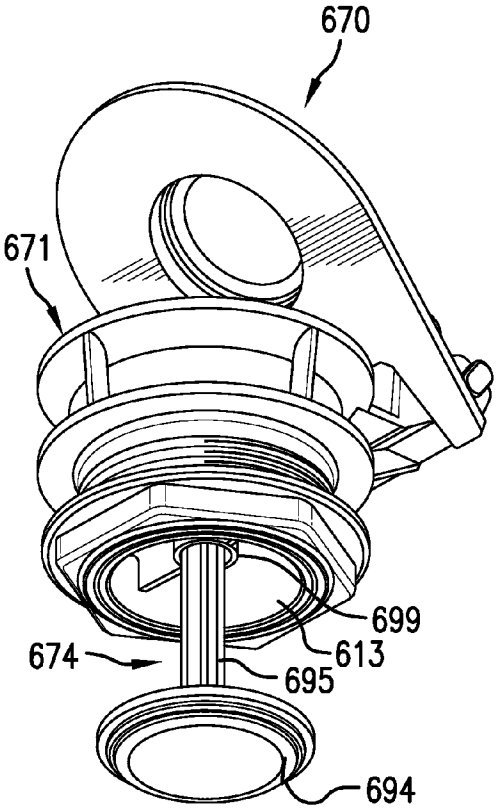
FIG. 44 is a bottom perspective view of the jet valve of FIG. 39 in an open state.
Figure 43:
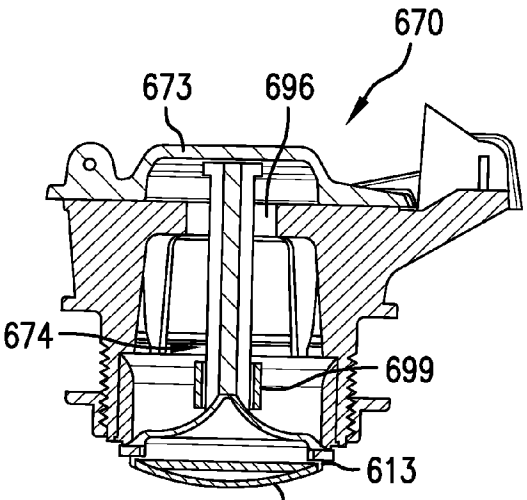
FIG. 43 is a longitudinal cross-sectional view of the jet valve of FIG. 39.
Figure 48:
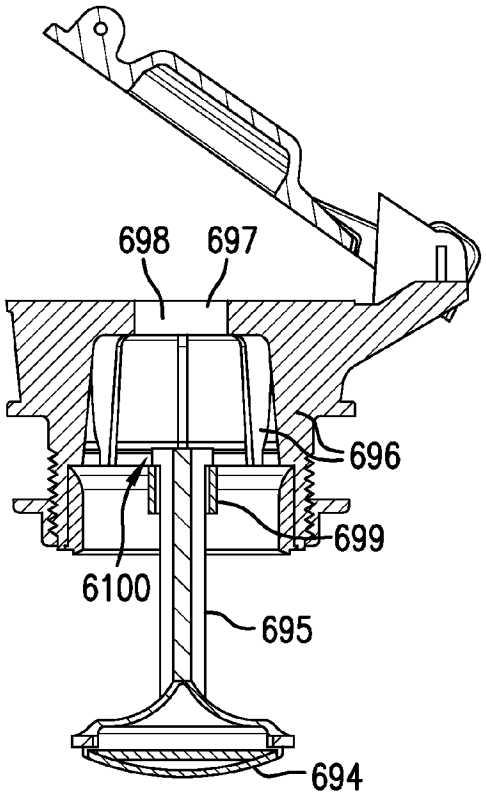
FIG. 48 is a longitudinal cross-sectional view of the jet valve of FIG. 44.
Figure 47:
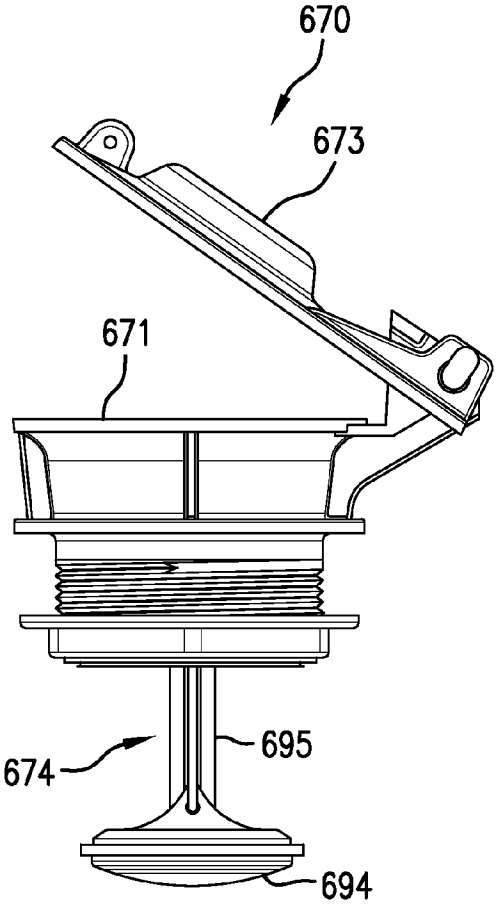
FIG. 47 is a right side elevational view of the jet valve of FIG. 44.
Figure 46:
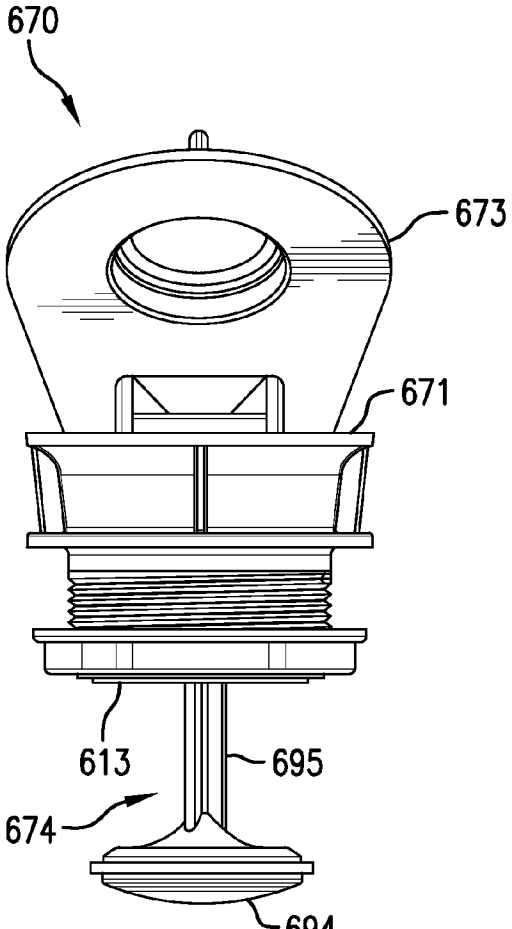
FIG. 46 is a front elevational view of the jet valve of FIG. 44.
Figure 51:
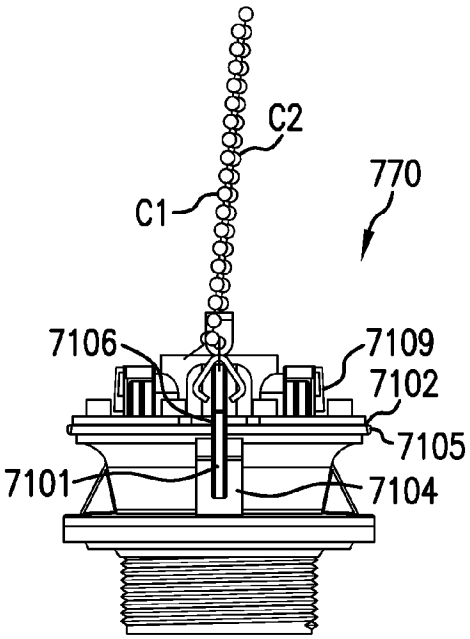
FIG. 51 is a front elevational view of the jet valve of FIG. 49.
Figure 50:
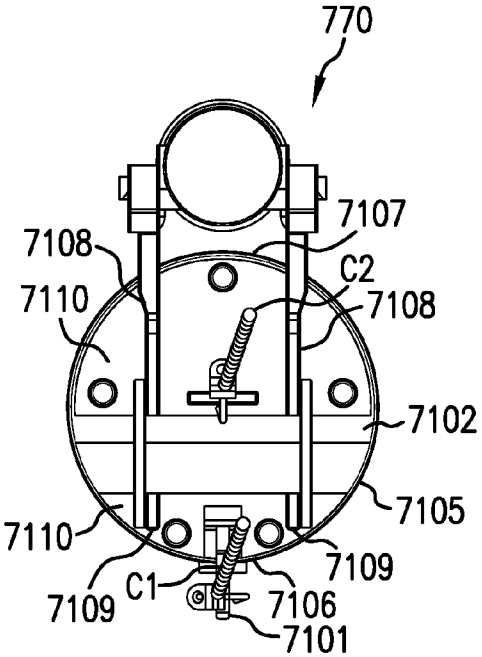
FIG. 50 is a top plan view of the jet valve of FIG. 49.
Figure 49:
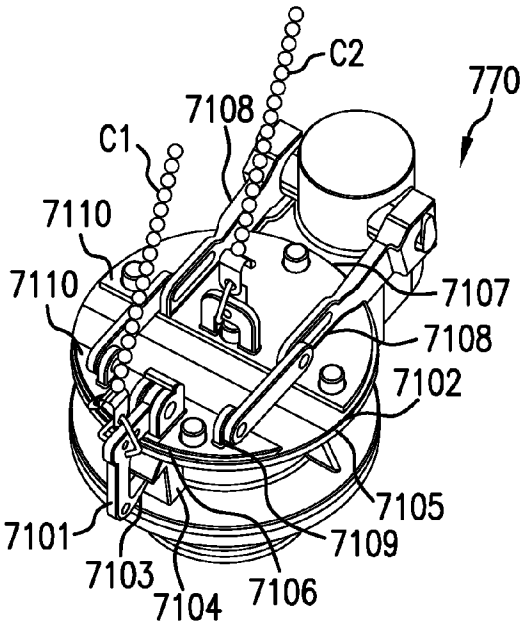
FIG. 49 is a top perspective view of a further jet valve for use in the embodiments of the invention herein shown in a closed state and having a back-flow preventer mechanism including a peel-back flapper cover and a hinged mechanism with lifting hook.
Figure 53:
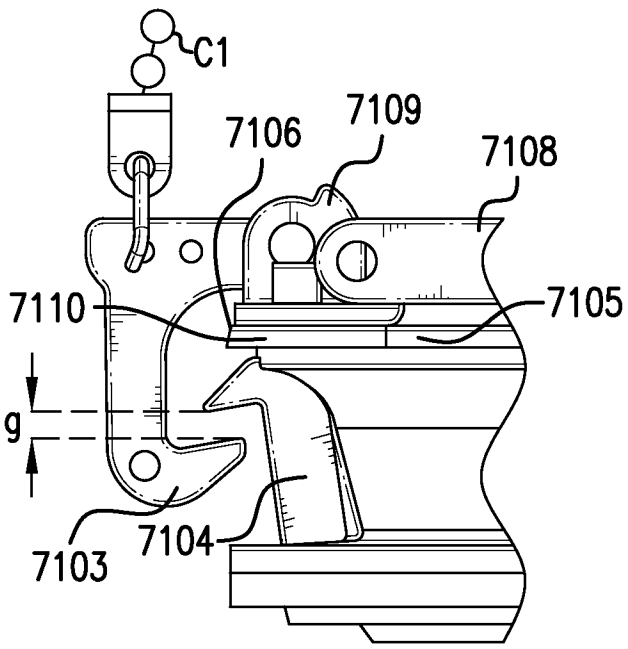
FIG. 53 is an enlarged portion of the valve of FIG. 52 at the location of the hook.
Figure 52:
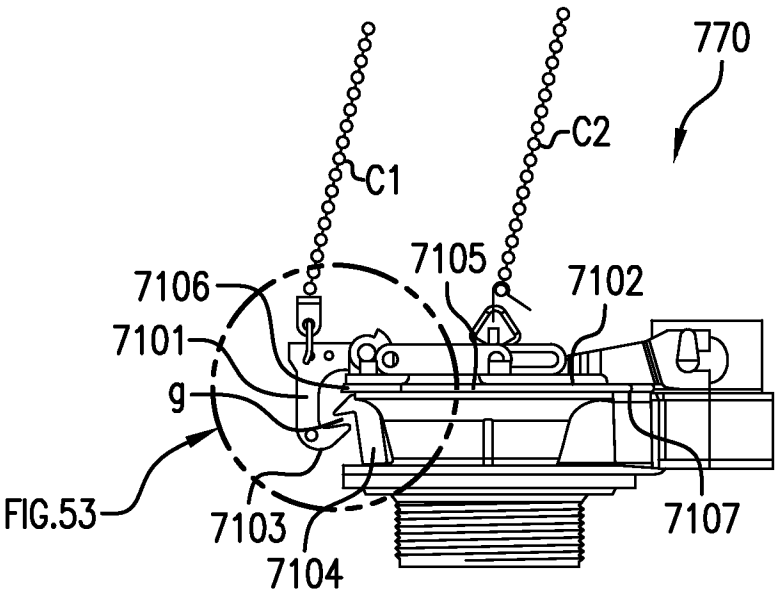
FIG. 52 is a right side elevational view of the jet valve of FIG. 49.
Figure 54:
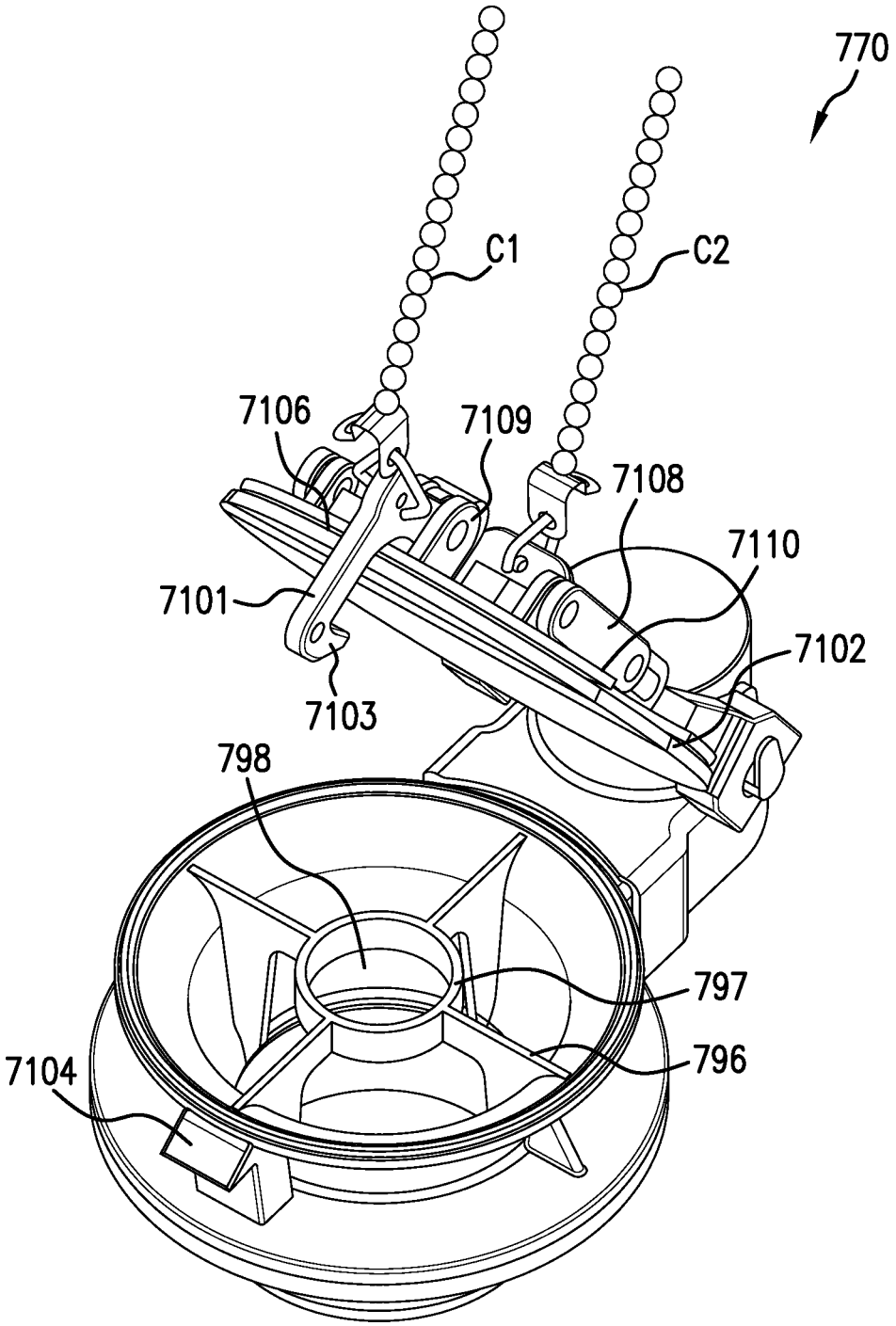
FIG. 54 is a top perspective view of the jet valve of FIG. 49 is an open state and showing internal star-configuration ribs.
Figure 56:
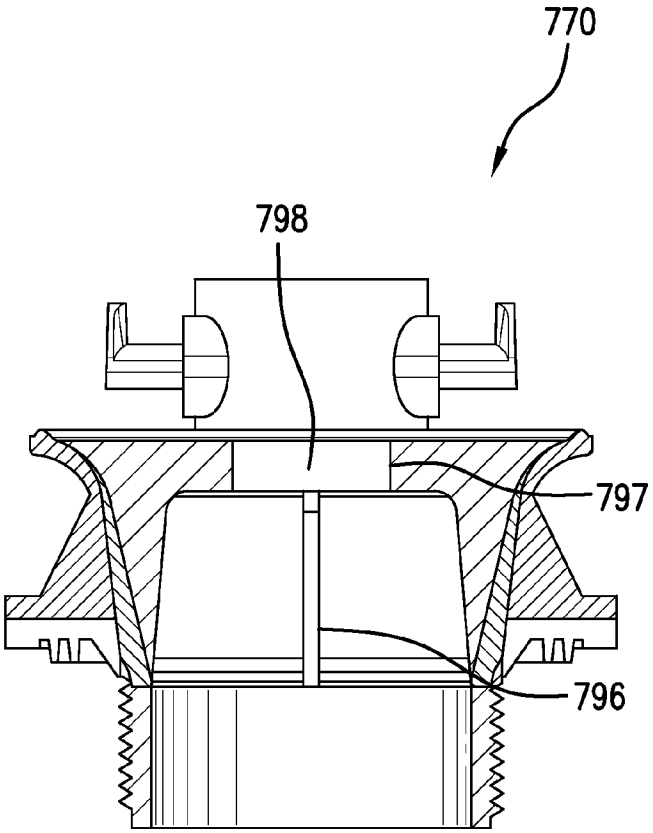
FIG. 56 is a longitudinal cross-sectional view taken along line 56-56 of FIG. 55.
Figure 55:
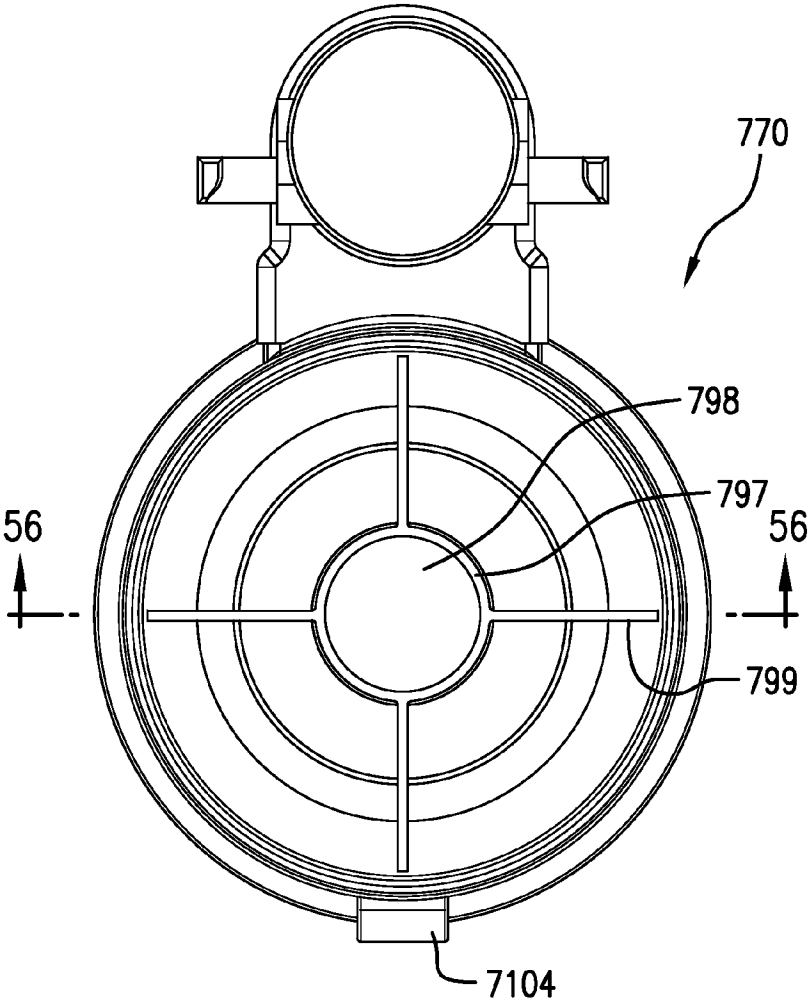
FIG. 55 is a top plan view of the body of the jet valve of FIG. 49 showing the internal star-configuration ribs.
Figure 57:
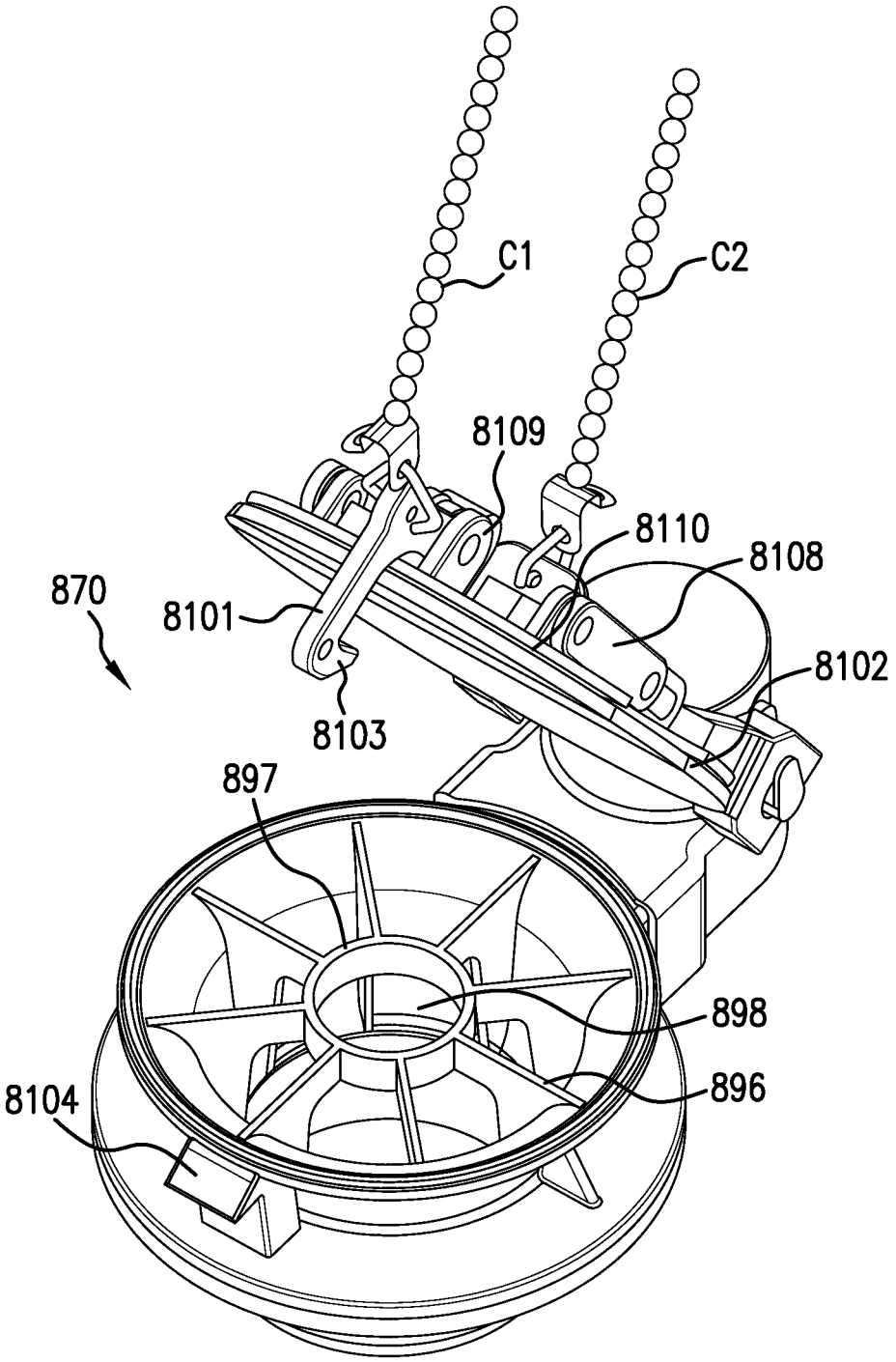
FIG. 57 is a top perspective view of a further embodiment like that of FIG. 49 but having ribs with an alternate internal star-configuration.

When closed, the back-flow preventer prevents flow from pushing back on the flapper cover 573 by positioning of the linkage arms so that the first and second linkage arms are more aligned at their joint area R in a more rigid position where they would remain absent action on chain C at point P (see FIGS. 37 and 38 showing valve in closed position).

Another embodiment 670 of a jet flush valve wherein the back-flow preventer mechanism 674 is a moveable buoyant poppet hat 694. FIGS. 39-43 show the valve 670 in a closed position wherein the poppet hat 694 is pressed against the area of the outlet 613 of the valve 670 in a sealing manner.

The upward weight of flush water on the closed valve prevents water entering the interior of the valve. Back flow cannot enter the bottom of the jet flush valve when the valve is closed due to the poppet hat and pressure from within the primed closed jet path as described above. If a solid poppet hat (not as buoyant) is used, more force for operation would be necessary and a spring or other tension mechanism can be used to connect the hat to the guide.

As shown in FIGS. 45-48, the jet flush valve 670 when opened allows for full flow through the valve body by virtue of lifting of cover 673 (such as by a chain or other flush actuator as described above with respect to valve 70). When the cover 673 is lifted flush water enters the previously primed valve and the continued downward flow pushes out the poppet hat 694. The poppet hat 694 is preferably partially elastomeric or polymeric to sealingly engage against the valve at the outlet 613. The poppet hat 694 is on a post 695 (which as shown best in FIG. 45, may be ribbed in cross-sectional design (or simply a round post).

The post has a top end 699, opposite where it connects to the poppet hat 694, which is configured to have a flange 6100. The flange acts as a stop against a centrally positioned poppet post guide ring 699 within the valve body beneath a ribbed structurally supported configuration. As shown best in FIG. 45, a "star" configuration of ribs 696 extending outwardly from a central hub 697 is shown. An opening 698 extends through the hub, allowing the poppet post to easily pass through in an upward direction when the valve is in the closed position (see FIG. 43). When open, the post passes downward under flow pressure until the flange 6100 contacts the guide ring 699 in a fully extended position so that the poppet hat 694 will not unnecessarily obstruct flow.

A further embodiment of a back-flow preventing jet flush valve 770 is shown in FIGS. 49-56. In this embodiment, the back-flow preventing mechanism 774 is a hook 7101. The hook 7101 is fitted on the front end of the cover 7102 of the jet flush valve 770 which is different from the other covers in the other embodiments as described below. The hook 7101 has an extending hook arm 7103 that meets a catch 7104 positioned on the outside of the jet valve body. The hook arm 7103 should have some gap g between it and the facing surface 7105 of the catch 7104, but the gap should be as small as possible to provide a tight closure against backflow but not so small that the hook cannot easily clear when the valve is opened, and swing around the catch 7104, preferably the gap is about 1 mm to about 5 mm.

A unique feature of the jet flush valve 770, aside from the back-flow preventer mechanism 774, is the cover 7102. The cover is not a simple lift-off flapper cover, but is a "peel-away" cover. This design enables opening of the jet valve from front of the cover along the edge towards the back of the cover. The structure is formed so as to be flexible or partly-flexible. An elastomer or other flexible polymer (such as a flexible silicone or polyvinyl chloride) or other similar material accepted and rated for plumbing use may be adapted for the flexible portion. The ability to more slowly peel the valve cover upward along the edge 7105 of the front 7106 of the valve cover 7102 towards the back 7107 by peeling is beneficial to reduce activation force as there is water above and below the cover. The applicants have discovered that use of a flexible or semi-flexible cover to allow peeling along the edge is beneficial to achieving a good self-priming aspect to the jet flush valve and closed jet path. A rigid flapper cover such as a hard cover with a standard disc seal may provide more difficulty in self priming. By peeling and slowly opening, the valve 770 allows any trapped air to escape. It is preferred that at least about 50% of the cover 7102 is flexible in the front 7106 of the cover half way back towards the back 7107 of the cover. The back half of the cover need not be flexible.

To operate the peel mechanism and lift the hook back-flow preventer mechanism, a first chain C1 operates with the toilet's flush actuation mechanism to lift the hook 7101 when the valve is being opened, and once lifted, the front 7106 of the cover peels and lifts upwards. As it lifts, the hinged arms 7108 (which may be formed using any suitable hinge/hinge connection materials and structures as noted above with respect to embodiment 570) are bent upwards. The hinged arms 7108 are mounted using hinge mounts 7109 to optional cover plates 7110 (which may be metallic, polymeric, or elastomeric) to assist in peeling the front 7106 of the cover 7102 upwards. Any suitable flush actuator may be used and/or modified to connect to the chains C1, C2. Once C1 has lifted the front of the cover upward peeling away at the end 7105, the back portion of the cover is lifted. A separate, second chain C2 is provided which may have a float thereon as described above.

The interior of the valve 770 preferably also has a "star" configuration using a structure formed of ribs 796 linking the body of the valve to a central hub 797 through which an opening 798 extends. Flow can easily pass through the rib structure, but the structure helps to support the weight of flush fluid on the valve by extending radially across the body of the valve. The flapper has two times the force requirement to open, so the supports assists in operation, and further are design to facilitate escape of air by using a shaped baffles or ribs as shown. The number of ribs can impact flow if there are too many ribs or the ribs are too large or shaped in an inconvenient manner.

FIGS. 64-68 show the same embodiment of valve 770 but with an optional overflow tube 791 incorporated thereon. Overflow tube 791 includes an upper housing 769 for incorporating therein any of a variety of standard valves V as a further check against back-flow through the jet valve and which can allow for air to enter and escape. The valve can be manually turned to the open position to break the prime and enable plunging without back flow. Breaking of the prime might also be desirable in other circumstances, such as before maintenance or repair. Any suitable valve such as a ball valve, disc valve or the like may be incorporate therein. A valve V is shown schematically in the partial sectional view of FIG. 67. The housing 769 is optional and other direct connection valves may be used. The valve is then manually reset by the user to the working position and the toilet can be returned to the primed state. Preferably, the valve can incorporate a check valve that automatically opens and remains open when a positive pressure, exceeding that experienced during a normal flush cycle, is experienced in the closed jet channel, allowing air to enter the channel and break the prime. This check valve is then manually reset by the user to the working position, and the toilet can be returned to the primed state. Most preferably, the check valve returns to the closed position after a delay of about 5 seconds to about 60 seconds, not requiring manual intervention on the part of the user. This can be accomplished electromechanically or mechanically with, for example, a flapper-type valve with liquid-dampened hinges.

Figure 59:
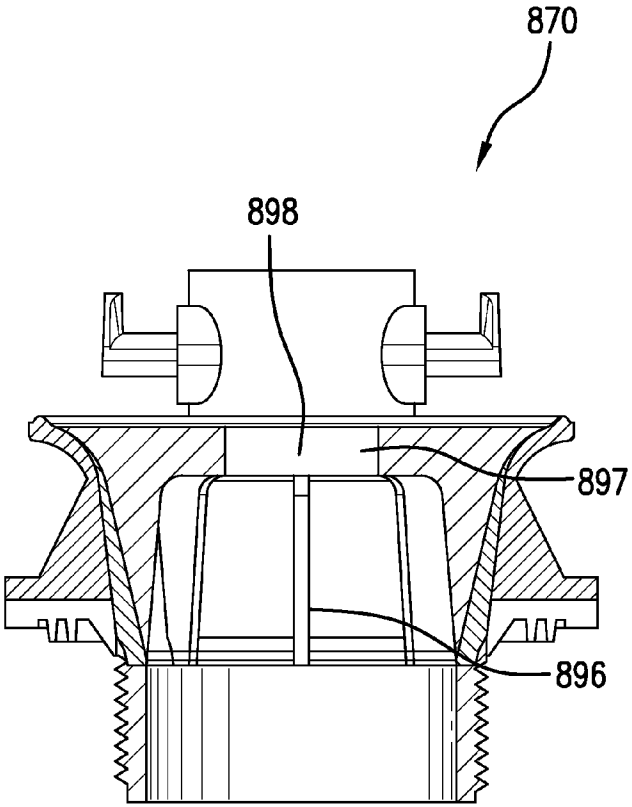
FIG. 59 is a longitudinal cross-sectional view taken along line 59-59 of FIG. 58.
Figure 58:
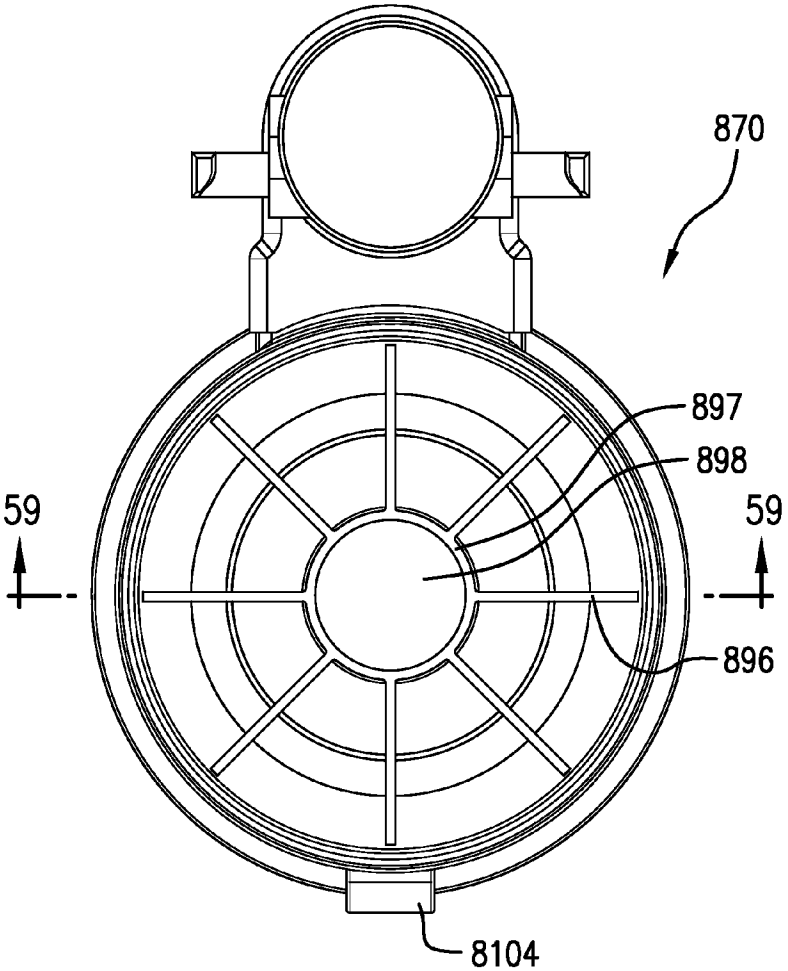
FIG. 58 is a top plan view of the body of the jet valve of FIG. 57 showing the internal start-configuration ribs.
Figure 61:
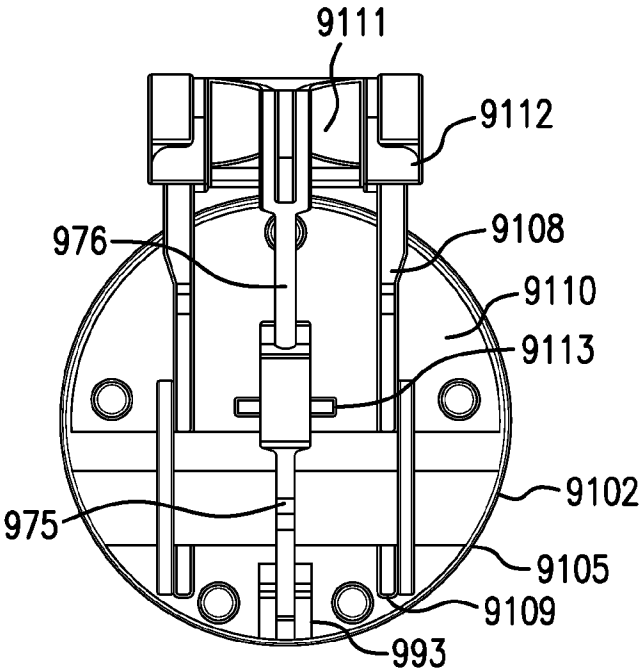
FIG. 61 is a top plan view of the jet valve of FIG. 60.
Figure 60:
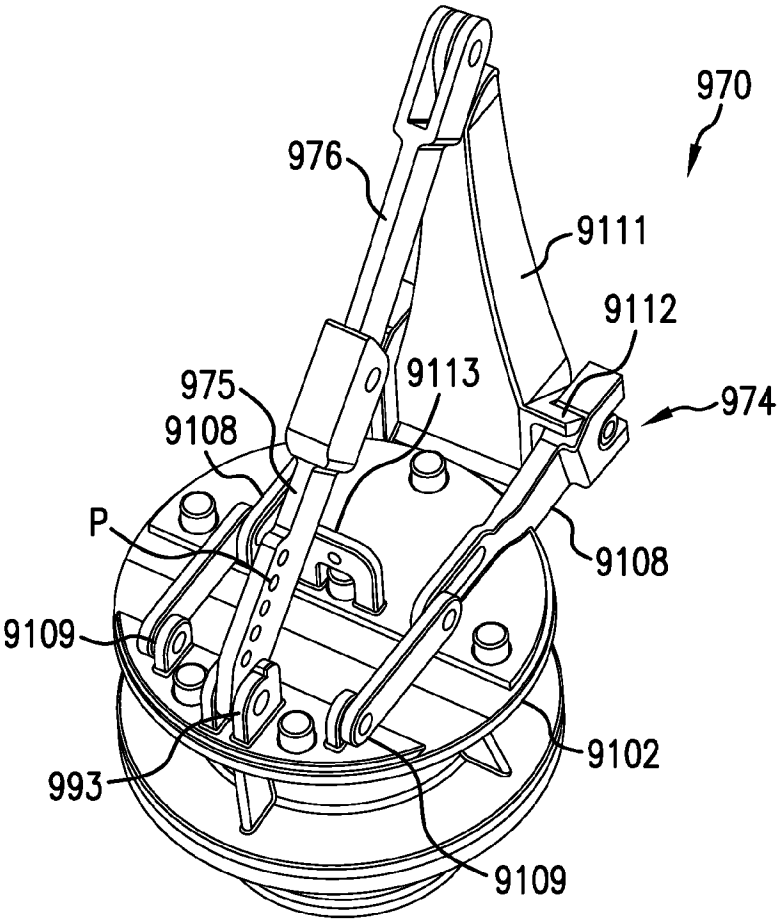
FIG. 60 is a top perspective view of a further jet valve for use in the embodiments of the invention herein shown in a closed state and having a back-flow preventer mechanism including a peel-back flapper cover and a hold-down linkage.
Figure 63:
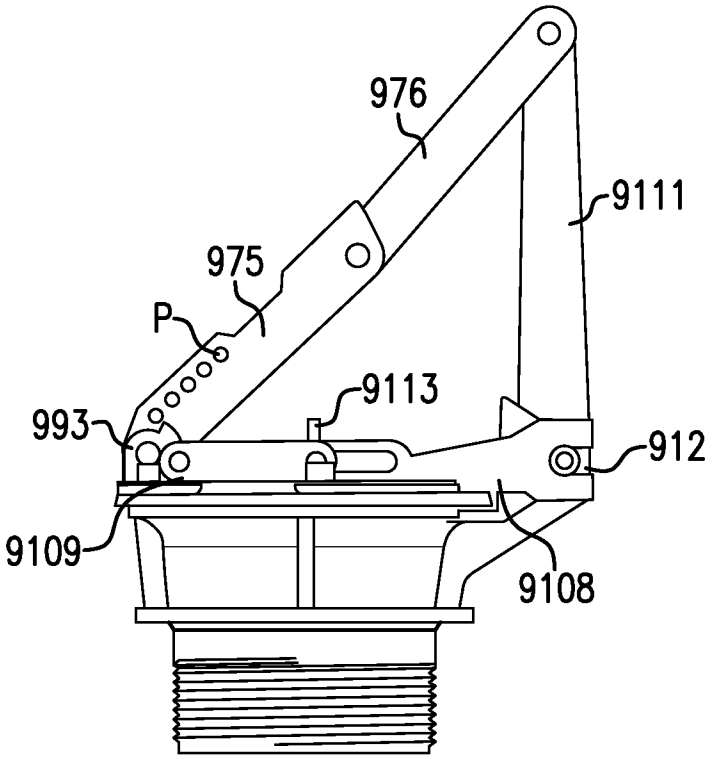
FIG. 63 is a right side elevational view of the jet valve of FIG. 60.
Figure 62:
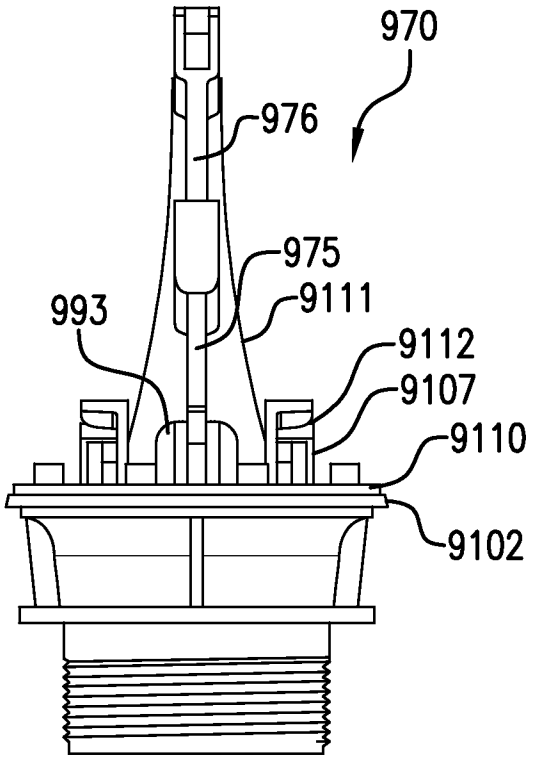
FIG. 62 is a front elevational view of the jet valve of FIG. 60.
Figure 64:
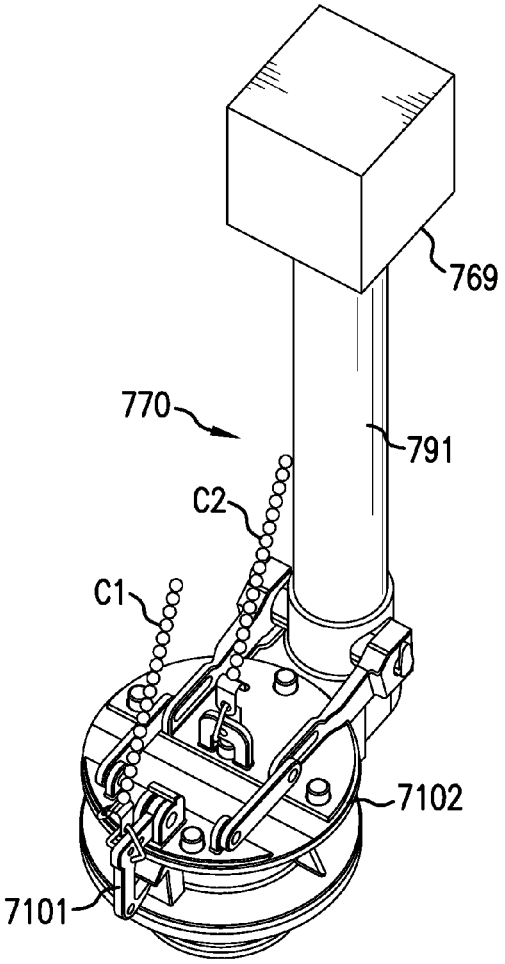
FIG. 64 is a perspective view of a modification of the jet valve of FIG. 49 for use in the embodiments of the invention herein shown in a closed state and having a back-flow preventer mechanism including a peel back cover, but including an optional feature of an overflow tube for housing a further back-flow prevention device such as a check valve.
Figure 65:
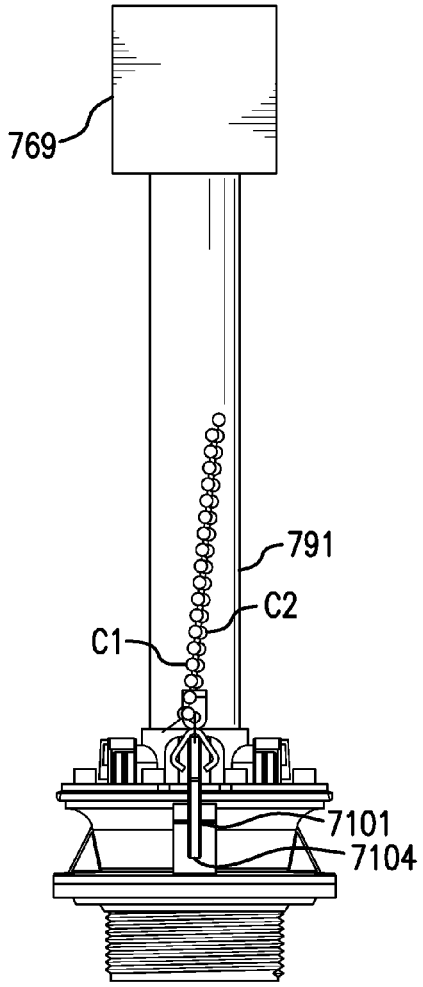
FIG. 65 is a front elevational view of the jet valve of FIG. 64.
Figure 66:
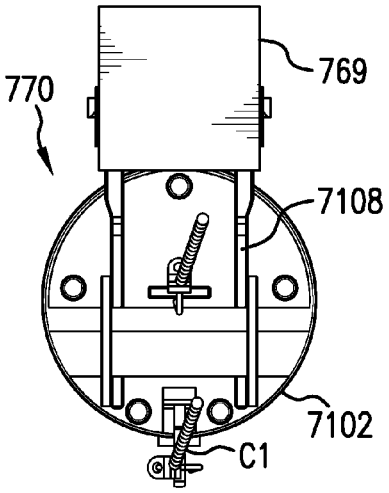
FIG. 66 is a top elevational view of the jet valve of FIG. 64.
Figure 68:
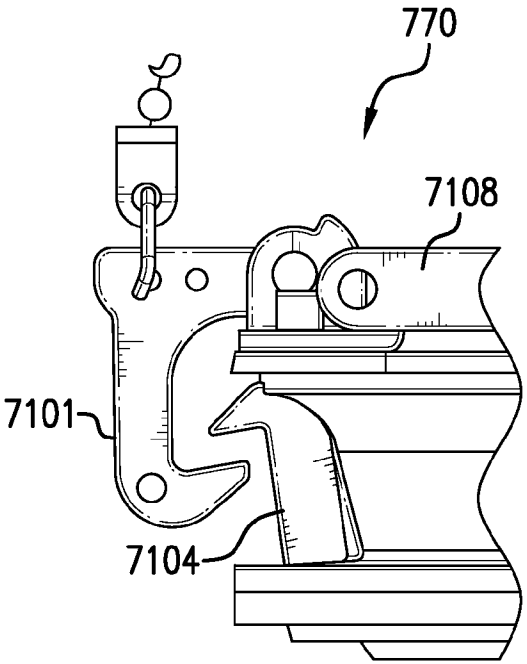
FIG. 68 is an enlarged portion of the jet valve of FIG. 67 showing the lifting hook mechanism.
Figure 67:
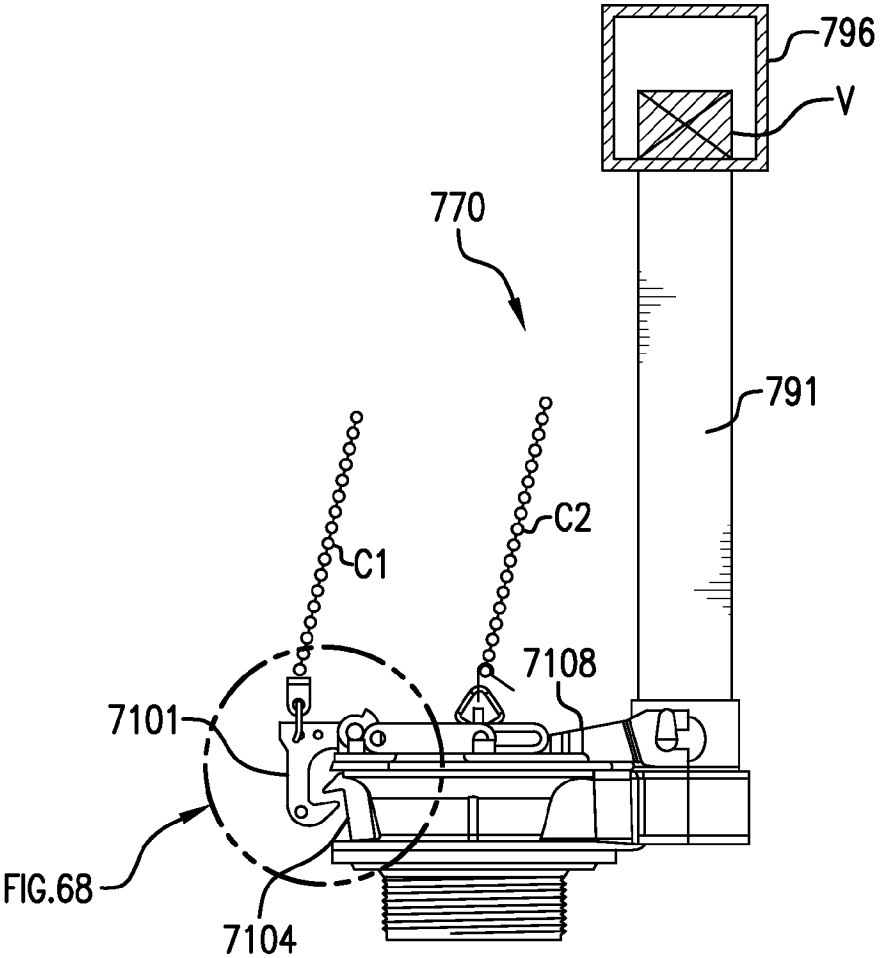
FIG. 67 is a right side elevational view of the jet valve of FIG. 64.

FIGS. 58 and 59 show an identical embodiment 870 to that of jet flush valve 770 having like reference numbers referring to identical parts therein with the exception that in flush valve 870, the star configuration of the support structure has 8 ribs instead of 4 as shown in valve 770. It should be understood by one of ordinary skill in the art that the number and variation of such ribs can be modified to provide varying degrees of structural support without unnecessarily inhibiting flow through the valve and to maximize and facilitate air expulsion.

FIGS. 60-63 show an embodiment of a flush valve 970 having a the backflow-preventer mechanism 974 which is a hold-down linkage configuration similar to that of valve 570 with the exception that instead of a single downward third linkage arm, the embodiment 970 includes a bridging structure 9111 that is larger in width as it extends downwardly. The bridging structure 9111 acts as a third linkage arm, but divides the downward resistance toward hinged arms 9108. Such hinged arms 9108 attach at hinge mounts 9109 and operate to provide the cover 9102 with the ability to "peel" upward like embodiments 770 and 870. The front portion of the back-flow preventer mechanism 974 includes first and second hinged linkage arms 975, 976 similar to those of embodiment 570. The second linkage arm is linked through a standard hinge connection to the top of the bridging structure 9111 which then engages through a hinge structure 9112 the rear of the hinged arms 9108. The first linkage arm is connected to the front 9106 of the cover 9102 through a hinge mount 993. A chain (not shown) may be attached at point P as described in embodiment 570 to life the front of the cover 9102, but unlike the embodiment 570, the cover 9102 is flexible like cover 7102 in embodiment 710 and so may be peeled upward. Further an additional chain may be used as in embodiment 710 to raise the back half of the cover 9102 at the position of grommet 9113 or a similar structure as is shown for chain C2 in embodiment 710.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A siphonic flush toilet assembly, the toilet bowl assembly comprising at least one jet flush valve assembly having a jet flush valve inlet and a jet flush valve outlet, the jet flush valve assembly configured for delivery of fluid from the jet flush valve outlet to a closed jet fluid pathway;

at least one rim valve assembly having a rim valve inlet and a rim valve outlet, the rim valve assembly configured for delivery of fluid from the rim valve outlet to at least one rim inlet port; and a bowl having an interior surface defining an interior bowl area and comprising (a) the at least one rim inlet port for introducing water to an upper perimeter area of the bowl;

(b) a jet defining at least one jet channel, the jet having an inlet port in fluid communication with the jet flush valve outlet and a jet outlet port positioned in a lower portion of the bowl and configured for discharging fluid to a sump area of the bowl, wherein the sump area is in fluid communication with an inlet to a trapway having a weir and the closed jet fluid pathway comprises the at least one jet channel;

wherein the jet flush valve assembly is positioned above the weir of the trapway and wherein the closed jet fluid pathway comprising the at least one jet channel extends from the jet flush valve outlet to the jet outlet port and once primed, the closed jet fluid pathway is capable of remaining primed with fluid and assisting in preventing air from entering the closed jet fluid pathway before actuation of and after completion of a flush cycle.

2. The siphonic flush toilet bowl assembly according to claim 1, wherein the toilet bowl assembly further comprises a rim manifold, wherein the rim manifold has a rim manifold inlet opening for receiving fluid from the rim valve outlet and a rim manifold outlet opening for delivery of fluid to the rim inlet port; and wherein the bowl comprises a rim that extends at least partially around an upper perimeter of the bowl, the rim defining a rim channel extending from the at least one rim inlet port around the upper perimeter of the bowl and having at least one rim outlet port in fluid communication with an interior area of the bowl, and wherein the at least one rim inlet port is in fluid communication with the rim manifold outlet opening.

3. The siphonic flush toilet bowl assembly according to claim 1, wherein the bowl has a rim that comprises a rim shelf extending transversely along an interior surface of the bowl in an upper perimeter area thereof from the at least one rim inlet port at least partially around the bowl so that fluid is able to travel along the rim shelf and enter the interior space of the bowl in at least one location displaced from the at least one rim inlet port.

4. The siphonic flush toilet bowl assembly according to claim 1, wherein the system further comprises a tank configured for receiving fluid from a source of fluid, the tank containing at least one fill valve.

5. The siphonic flush toilet bowl assembly according to claim 4, wherein the tank includes at least one jet reservoir and at least one rim reservoir, the at least one jet reservoir comprising a jet fill valve and the at least one jet flush valve assembly, and the rim reservoir comprising the at least one rim valve assembly.

6. The siphonic flush toilet bowl assembly according to claim 5, wherein the at least one rim reservoir further comprises a rim fill valve, the rim valve is a rim flush valve assembly and the rim flush valve assembly comprises an overflow tube.

7. The siphonic flush toilet assembly according to claim 1, wherein at least a portion of an interior wall of the toilet bowl in the sump area is upwardly inclined from the jet outlet port toward the inlet of the trapway.

8. The siphonic flush toilet bowl assembly according to claim 1, wherein the toilet is capable of operating at a flush volume of no greater than about 6.0 liters.

9. The siphonic flush toilet bowl assembly according to claim 8, wherein the toilet is capable of operating at a flush volume of no greater than about 4.8 liters.

10. The siphonic flush toilet system according to claim 9, wherein the toilet is capable of operating at a flush volume of no greater than about 2.0 liters.

11. The siphonic flush toilet bowl assembly according to claim 1, wherein the at least one jet channel is positioned to extend at least partially around a lower portion of an exterior surface of the bowl.

12. The siphonic toilet bowl assembly according to claim 1, wherein the sump area of the bowl has a jet trap defined by the interior surface of the bowl and having an inlet end and an outlet end, wherein the inlet end of the jet trap receives fluid from the jet outlet port and the interior area of the bowl and the outlet end of the jet trap is in fluid communication with the inlet to the trapway; and wherein the jet trap has a seal depth.

13. The siphonic flush toilet bowl assembly according to claim 12, wherein an upper surface of the jet outlet port is within the jet trap and is positioned at a seal depth below an upper surface of the inlet to the trapway as measured longitudinally through the sump area.

14. The siphonic flush toilet bowl assembly according to claim 13, wherein the jet trap seal depth is about 1 cm to about 15 cm.

15. The siphonic flush toilet bowl assembly according to claim 14, wherein the jet trap seal depth is about 2 cm to about 12 cm.

16. The siphonic flush toilet bowl assembly according to claim 15, wherein the jet trap seal depth is about 3 cm to about 9 cm.

17. The siphonic flush toilet bowl assembly according to claim 1, wherein the at least one rim valve is a rim flush valve assembly having a rim flush valve body extending from the rim valve inlet to the rim valve outlet and a rim flush valve cover.

18. The siphonic flush toilet bowl assembly according to claim 12, wherein the at least one jet channel is positioned to pass at least partially under the bowl.

19. The siphonic flush toilet bowl assembly according to claim 1, wherein the at least one jet flush valve assembly comprises a jet flush valve body extending from the jet flush valve inlet to the jet flush valve outlet and a jet flush valve cover, and wherein the at least one jet flush valve assembly also comprises a back-flow preventer mechanism.

20. The siphonic flush toilet bowl assembly according to claim 19, wherein the jet flush valve cover is at least partly flexible and is able to be peeled upwardly upon opening.

21. The siphonic flush toilet bowl assembly according to claim 19, wherein the back-flow preventer mechanism is one or more of a hold-down linkage mechanism, a hook and catch mechanism, a poppet mechanism, and a check valve.

22. The siphonic flush toilet bowl assembly according to claim 1, wherein the at least one jet flush valve assembly comprises a jet flush valve body extending from the jet flush valve inlet to the jet flush valve outlet and a jet flush valve cover.

23. The siphonic flush toilet bowl assembly according to claim 22, wherein the jet flush valve cover is at least partly flexible and is able to be peeled upwardly upon opening.

24. The siphonic flush toilet bowl assembly according to claim 23, wherein the jet flush valve cover further comprises hinged arms and/or at least one grommet for attachment of a chain having a float thereon.

25. The siphonic flush toilet bowl assembly according to claim 23, further comprising a back-flow preventer mechanism.

26. A method of maintaining a siphonic flush toilet assembly in a primed state, the method comprising, (a) providing a toilet bowl assembly, comprising at least one jet flush valve assembly having an jet flush valve inlet and a jet flush valve outlet, the at least one jet flush valve assembly configured for delivery of fluid from the jet flush valve outlet to a closed jet fluid pathway;

at least one rim valve assembly having a rim valve inlet and a rim valve outlet, the at least one rim valve assembly configured for delivery of fluid from the rim valve outlet to at least one rim inlet port; and a bowl having an interior surface defining an interior bowl area and comprising (i) the at least one rim inlet port for introducing water to an upper perimeter area of the bowl; (ii) a jet defining at least one jet channel, the jet having an inlet port in fluid communication with the jet flush valve outlet and a jet outlet port positioned in a lower portion of the bowl and configured for discharging fluid to a sump area of the bowl, wherein the sump area is in fluid communication with an inlet to a trapway having a weir and the closed jet fluid pathway comprises the at least one jet channel; the at least one jet flush valve is positioned above the weir of the trapway and the closed jet fluid pathway comprising the at least one jet channel extends from the jet flush valve outlet to the jet outlet port and, once primed, the closed jet fluid pathway is capable of remaining primed with fluid and assisting in preventing air from entering the closed jet fluid pathway before actuation of and after completion of a flush cycle;

(b) actuating a flush cycle;

(c) providing fluid through the at least one jet flush valve assembly and the at least one rim valve assembly; and (d) maintaining the closed jet fluid pathway in a primed state after completion of a flush cycle.

27. The method of maintaining a siphonic flush toilet bowl assembly in a primed state according to claim 26, wherein the toilet bowl assembly further comprises a rim manifold, wherein the rim manifold has a rim manifold inlet opening configured for receiving fluid from the rim valve outlet and a rim manifold outlet opening for delivery of fluid to the at least one rim inlet port; and wherein the bowl comprises a rim around the upper perimeter of the bowl and the rim defines a rim channel extending from the at least one rim inlet port at least partially around the upper perimeter of the bowl and having at least one rim outlet port in fluid communication with an interior area of the bowl; and the at least one rim inlet port is in fluid communication with the rim channel and with the rim manifold outlet opening, and the method further comprises introducing fluid from the rim valve outlet into the interior area of the toilet bowl through the rim manifold inlet opening, the rim manifold outlet opening, the at least one rim inlet port, the rim channel and the at least one rim outlet port.

28. The method of maintaining a siphonic flush toilet bowl assembly in a primed state according to claim 26, wherein the rim comprises a rim shelf extending transversely along an interior surface of the bowl in an upper perimeter area thereof from the at least one rim inlet port at least partially around the interior surface of the bowl, wherein the method further comprises introducing fluid from the rim shelf inlet port so that it travels along the rim shelf and enters the interior space of the bowl in at least one location displaced from the rim inlet port.

29. The method of priming a siphonic flush toilet bowl assembly according to claim 26, wherein the toilet bowl assembly further comprises a tank configured to receive fluid from a source of fluid, the tank having at least one fill valve, and the method further comprises filling the tank using the at least one fill valve and providing fluid from the tank to the bowl through the at least one jet flush valve assembly and the at least one rim valve assembly.

30. The method of priming a siphonic flush toilet bowl assembly according to claim 29, wherein the tank includes at least one jet reservoir and at least one rim reservoir, the at least one jet reservoir comprising a jet fill valve and the at least one jet flush valve assembly configured for delivery of fluid to the jet inlet port, and the rim reservoir comprising the at least one rim valve assembly and configured for delivery of fluid to the at least one rim inlet port through the at least one rim valve assembly, and the method further comprises filling the at least one jet reservoir with fluid from the at least one fill valve before actuating the flush cycle.

31. The method of priming a siphonic flush toilet bowl assembly according to claim 30, wherein the at least one rim reservoir further comprises a rim fill valve and the method further comprises filling the at least one rim reservoir with the rim fill valve.

32. The method of priming a siphonic flush toilet bowl assembly according to claim 30, wherein the method further comprises maintaining the level of fluid in the at least one jet reservoir above the jet flush valve inlet from the at least one fill valve of the tank after completion of a flush cycle.

33. The method of priming a siphonic flush toilet bowl assembly according to claim 26, wherein in a jet trap, an upper surface of the jet outlet port is configured to be positioned at a seal depth below an upper surface of the inlet to the trapway as measured longitudinally through the sump area, and the method further comprises maintaining the seal depth to facilitate the closed jet fluid pathway being primed with fluid from the at least one jet flush valve assembly before actuation of and after completion of a flush cycle.

34. A siphonic flush toilet bowl assembly, comprising at least one jet flush valve assembly configured for delivery of fluid to a direct-fed jet and at least one rim valve configured for delivery of fluid to a rim;

a rim manifold, wherein the rim manifold has a rim manifold inlet opening configured for receiving fluid from the at least one rim valve and a rim manifold outlet opening for delivery of fluid to a rim inlet port;

a bowl having an interior surface defining an interior bowl area and (a) a rim provided around an upper perimeter thereof and defining a rim channel, the rim channel having an inlet port in fluid communication with the rim manifold outlet opening and at least one rim outlet port in fluid communication with an interior area of the bowl, (b) a jet defining at least one jet channel, the jet having an inlet port in fluid communication with a jet flush valve assembly outlet for receiving fluid from the at least one jet flush valve assembly and a jet outlet port configured for discharging fluid to a sump area in a bottom portion of the bowl, wherein the sump area is in fluid communication with an inlet of a trapway, and (c) the sump area of the bowl has a jet trap defined by an interior wall of the bowl and having an inlet end and an outlet end, wherein the inlet end of the jet trap receives fluid from the jet outlet port and the interior of the bowl and the outlet end of the jet trap is in communication with the inlet to the trapway; and wherein the jet trap has a seal depth sufficient to maintain the jet channel and a jet manifold primed with fluid from the at least one jet flush valve assembly before actuation of and after completion of a flush cycle so as to assist in preventing air from entering a closed jet fluid pathway before actuation of and after completion of a flush cycle.

35. A siphonic flush toilet bowl assembly, comprising at least one jet flush valve assembly configured for delivery of fluid to a direct-fed jet and at least one rim valve configured for delivery of fluid to a rim inlet port in an upper peripheral portion of a bowl;

the bowl having an interior surface defining an interior area of the bowl and (a) the upper peripheral portion around an upper perimeter of the bowl configured to direct fluid from the rim inlet port at least partially around the upper peripheral portion of the bowl and into a sump area, (b) a jet defining at least one jet channel, the jet having an inlet port in fluid communication with an outlet of the jet flush valve assembly and a jet outlet port in a lower portion of the bowl configured for discharging fluid to the sump area, wherein the sump area is in fluid communication with an inlet of a trapway, and (c) the sump area in the bottom portion of the bowl has a jet trap defined by an interior surface of the bowl and having an inlet end and an outlet end, wherein the inlet end of the jet trap receives fluid from the jet outlet port and the interior of the bowl and the outlet end of the jet trap is in fluid communication with the inlet to the trapway; and wherein the jet trap is configured to have a seal depth sufficient to maintain the at least one jet channel and a jet manifold primed with fluid from the at least one jet flush valve assembly before actuation of and after completion of a flush cycle so as to assist in preventing air from entering a closed jet fluid pathway before actuation of and after completion of a flush cycle.

36. A method of maintaining a siphonic flush toilet bowl assembly in a primed state, the method comprising (a) providing a toilet bowl assembly, having at least one jet flush valve assembly having a jet flush valve inlet and a jet flush valve outlet, the at least one jet flush valve assembly configured for delivery of fluid from the jet flush valve outlet to a closed jet fluid pathway; at least one rim valve having a rim valve inlet and a rim valve outlet, the rim valve configured for delivery of fluid from the rim valve outlet to a rim inlet port; and a bowl having an interior surface defining an interior bowl area and wherein (i) the rim inlet port is configured for introducing water to one of (A) a rim provided around an upper perimeter of the bowl and defining a rim channel extending from the rim inlet port around the upper perimeter of the bowl and having at least one rim outlet port in fluid communication with an interior area of the bowl or (B) a rim shelf extending transversely along the interior surface of the bowl in the upper perimeter area thereof from the rim inlet port at least partially around the bowl, and (ii) a jet defining at least one jet channel, the jet having an inlet port in fluid communication with the jet flush valve outlet and a jet outlet port positioned in a lower portion of the bowl and configured for discharging fluid to a sump area of the bowl, wherein the sump area is in fluid communication with an inlet to a trapway having a weir and the closed jet fluid pathway comprises the jet channel; wherein the at least one jet flush valve assembly is positioned above the weir of the trapway and wherein the closed jet fluid pathway comprising the jet channel extends from the jet flush valve outlet to the jet outlet port so that once primed, the closed jet fluid pathway is capable of remaining primed with fluid to assist in preventing air from entering the closed jet fluid pathway before actuation of and after completion of a flush cycle;

(b) actuating a flush cycle;

(c) providing fluid through the at least one jet flush valve assembly at a flow rate sufficient to keep air from entering the jet outlet port and to generate a siphon in the trapway; and (d) lowering the flow rate of fluid through the jet channel for about 1 second to about 5 seconds until the siphon breaks.

37. The method of priming a siphonic flush toilet bowl assembly according to claim 36, further comprising (e) continuing flow of fluid until the level of fluid in the sump is above the jet outlet port.

38. The method of priming a siphonic flush toilet bowl assembly according to claim 36, wherein step (c) further comprises providing fluid through the at least one rim valve during the flush cycle.

39. The method of priming a siphonic flush toilet bowl assembly according to claim 36, wherein the method further comprises initial priming of the bowl upon installation by providing a flow rate through the at least one jet flush valve assembly outlet sufficient to keep air from entering the jet outlet port until the sump fills with fluid.

40. A flush valve for use in a siphonic flush toilet bowl, wherein the flush valve has a flush valve body extending from a flush valve inlet to a flush valve outlet and a flapper cover configured to extend over the flush valve inlet, wherein the flush valve further comprises a back-flow preventer mechanism, wherein the flapper cover is at least partly flexible and is able to be peeled upwardly upon opening.

41. The flush valve for use in a siphonic flush toilet bowl assembly according to claim 40, wherein the back-flow preventer mechanism is one or more of a hold-down linkage mechanism, a hook and catch mechanism, a poppet mechanism, and a check valve.

42. The flush valve for use in a siphonic flush toilet bowl assembly according to claim 40, wherein the flush valve cover further comprises hinged arms to assist in lifting the flush valve cover and/or at least one grommet for attachment of a chain having a float.

43. A flush valve for use in a siphonic flush toilet bowl assembly, comprising a flush valve body extending from a flush valve inlet to a flush valve outlet and a flapper cover configured to extend over the flush valve inlet, wherein the flapper cover is at least partly flexible and is able to be peeled upward upon opening.

44. The flush valve for use in a siphonic flush toilet bowl assembly according to claim 43, further comprising a back-flow preventer mechanism.

45. The siphonic flush toilet assembly of claim 1, wherein the jet channel is isolated from the fluid delivered from the rim valve outlet to the at least one rim inlet port and from other pathways open to the atmosphere.

46. The siphonic flush toilet assembly of claim 1, wherein the jet flush valve is closed before a level of water in a tank falls to a level of the jet flush valve inlet.

47. The siphonic flush toilet assembly of claim 1, wherein a seal depth in a jet trap in a sump area is configured to block air from entering the jet outlet port.

48. The siphonic flush toilet assembly of claim 1, wherein a water level in a jet trap does not fall to a level that enables air to travel into the at least one jet channel.

49. The siphonic flush toilet assembly of claim 1, wherein the at least one jet channel comprises at least two jet channels.

50. The flush valve for use in a siphonic flush toilet bowl of claim 40, wherein the flush valve cover further comprises hinged arms.

* * * * *